US008907940B2

(12) United States Patent
Toyomura et al.

(10) Patent No.: US 8,907,940 B2
(45) **Date of Patent: *Dec. 9, 2014**

(54) DRIVING METHOD FOR ORGANIC ELECTROLUMINESCENCE LIGHT EMITTING SECTION

(71) Applicant: Sony Corporation, Tokyo (JP)

(72) Inventors: Naobumi Toyomura, Kanagawa (JP); Katsuhide Uchino, Kanagwa (JP); Tetsuro Yamamoto, Kanagawa (JP)

(73) Assignee: Sony Corporation, Tokyo (JP)

( * ) Notice: Subject to any disclaimer, the term of this patent is extended or adjusted under 35 U.S.C. 154(b) by 150 days.

This patent is subject to a terminal disclaimer.

(21) Appl. No.: 13/668,990

(22) Filed: Nov. 5, 2012

(65) Prior Publication Data

US 2013/0120348 A1 May 16, 2013

Related U.S. Application Data

(63) Continuation of application No. 13/287,805, filed on Nov. 2, 2011, now Pat. No. 8,325,176, which is a continuation of application No. 12/450,266, filed as application No. PCT/JP2008/055045 on Mar. 19, 2008, now Pat. No. 8,094,145.

(30) Foreign Application Priority Data

Apr. 4, 2007 (JP) ..... 2007-098465

(51) Int. Cl.
*G09G 5/00* (2006.01)

(52) U.S. Cl.
USPC ..... 345/212; 345/76; 345/82

(58) Field of Classification Search
CPC ..... G09G 3/30; G09G 3/3208; G09G 3/3233; G09G 3/325; G09G 2330/02; G09G 2330/021
USPC ..... 345/76–84, 90–98, 204–215
See application file for complete search history.

(56) References Cited

U.S. PATENT DOCUMENTS 6,356,026 B1 3/2002 Murto
6,693,388 B2 2/2004 Oomura
(Continued)

FOREIGN PATENT DOCUMENTS

EP 1 580 719 A1 9/2005
JP 2004-191388 A 7/2004
(Continued)

OTHER PUBLICATIONS

Supplementary European Search Report dated Mar. 10, 2010 for corresponding European Application No. 08 72 2435.
Japanese Office Action issued Mar. 21, 2012 for corresponding Japanese Application No. 2007-098465.

*Primary Examiner* — Vijay Shankar
(74) *Attorney, Agent, or Firm* — Rader, Fishman & Grauer PLLC

(57) ABSTRACT

A driving method for an organic EL light emitting section is provided which achieves optimization of a mobility correction process for a transistor of a driving circuit in response to luminance. The light emitting section may include a driving circuit with a driving transistor, an image signal writing transistor and a capacitor section having a pair of electrodes (corresponding to a first node $ND_1$ and a second node $ND_2$). A variable correction voltage which relies upon an image signal voltage is applied to the first node $ND_1$ and a voltage which is higher than a potential of the second node $ND_2$ in a threshold voltage cancellation process is applied to the drain electrode of the driving transistor, between the threshold voltage cancellation process and a writing process, to raise the potential of the second node $ND_2$ in response to a characteristic of the driving transistor.

17 Claims, 25 Drawing Sheets

(56) References Cited

U.S. PATENT DOCUMENTS

| | | | | |
|---|---|---|---|---|
| 7,561,127 | B2 | 7/2009 | Mori et al. | |
| 7,592,981 | B2 | 9/2009 | Maeda | |
| 8,094,145 | B2 * | 1/2012 | Toyomura et al. | 345/212 |
| 8,325,176 | B2 * | 12/2012 | Toyomura et al. | 345/212 |
| 2004/0263057 | A1 | 12/2004 | Uchino et al. | |
| 2005/0093850 | A1 | 5/2005 | Mori et al. | |
| 2006/0170628 | A1 | 8/2006 | Yamashita et al. | |
| 2008/0036706 | A1 | 2/2008 | Kitazawa | |

FOREIGN PATENT DOCUMENTS

| | | | |
|---|---|---|---|
| JP | 2005-024698 | A | 1/2005 |
| JP | 2005-292436 | A | 10/2005 |
| JP | 2006-215213 | | 8/2006 |
| JP | 2007-108381 | A | 4/2007 |
| JP | 2008-052241 | A | 3/2008 |

* cited by examiner

FIG. 1 [5Tr/1C DRIVING CIRCUIT]

FIG. 2 [DISPLAY APPARATUS OF 5Tr/1C DRIVING CIRCUIT CONFIGURATION]

FIG. 3 [5Tr/1C DRIVING CIRCUIT]

FIG. 5 [5Tr/1C DRIVING CIRCUIT]
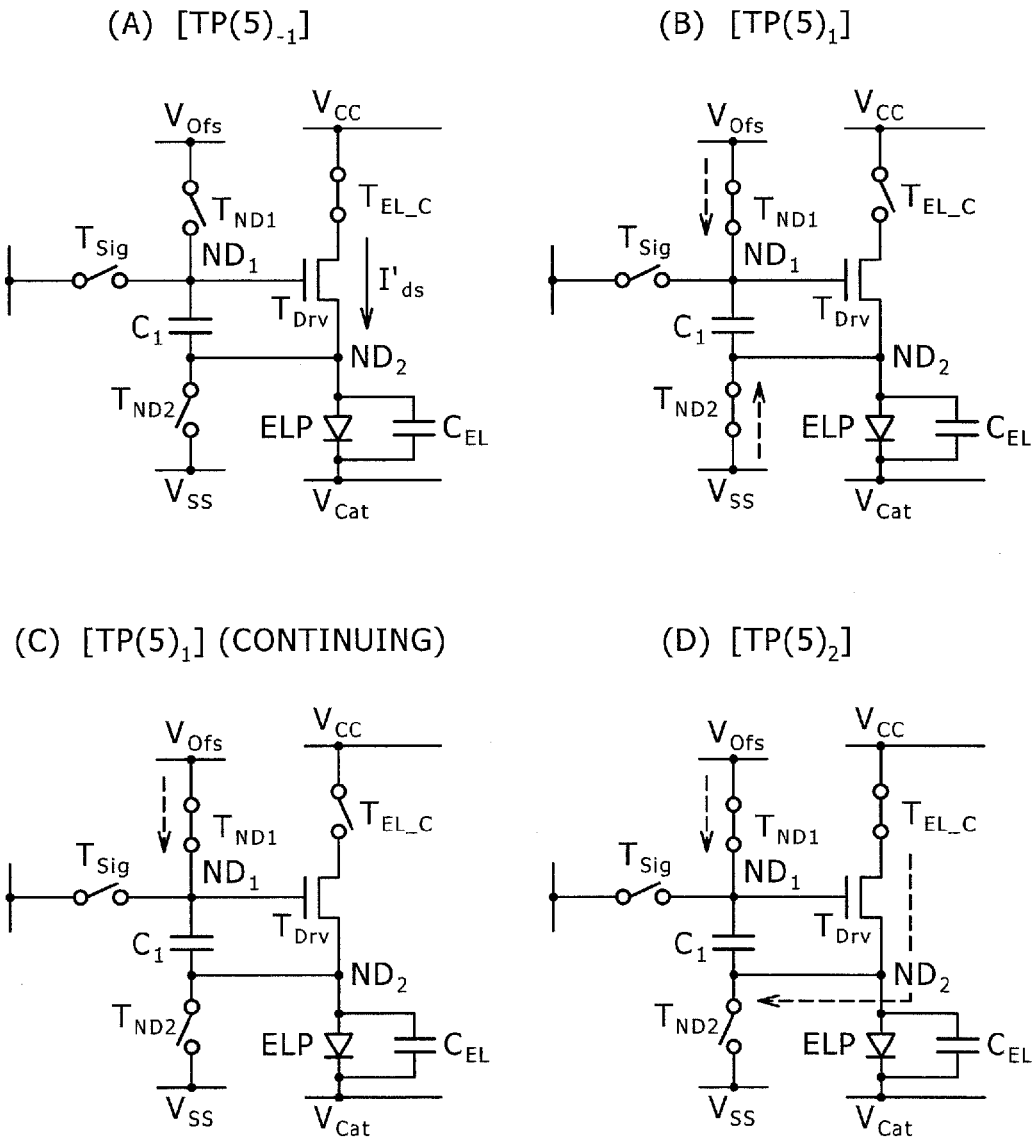

FIG. 6 [5Tr/1C DRIVING CIRCUIT]
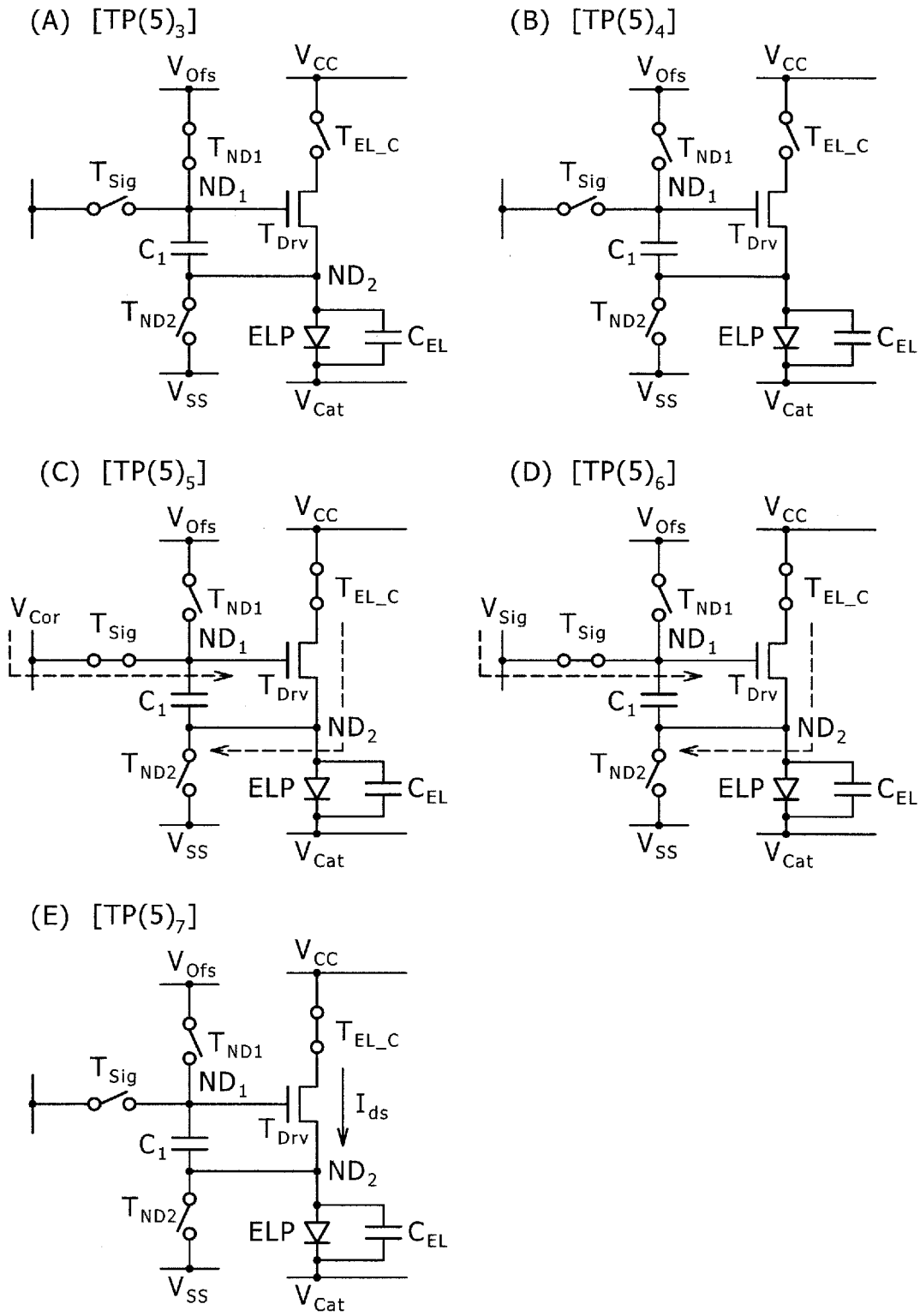

FIG. 7 [4Tr/1C DRIVING CIRCUIT]
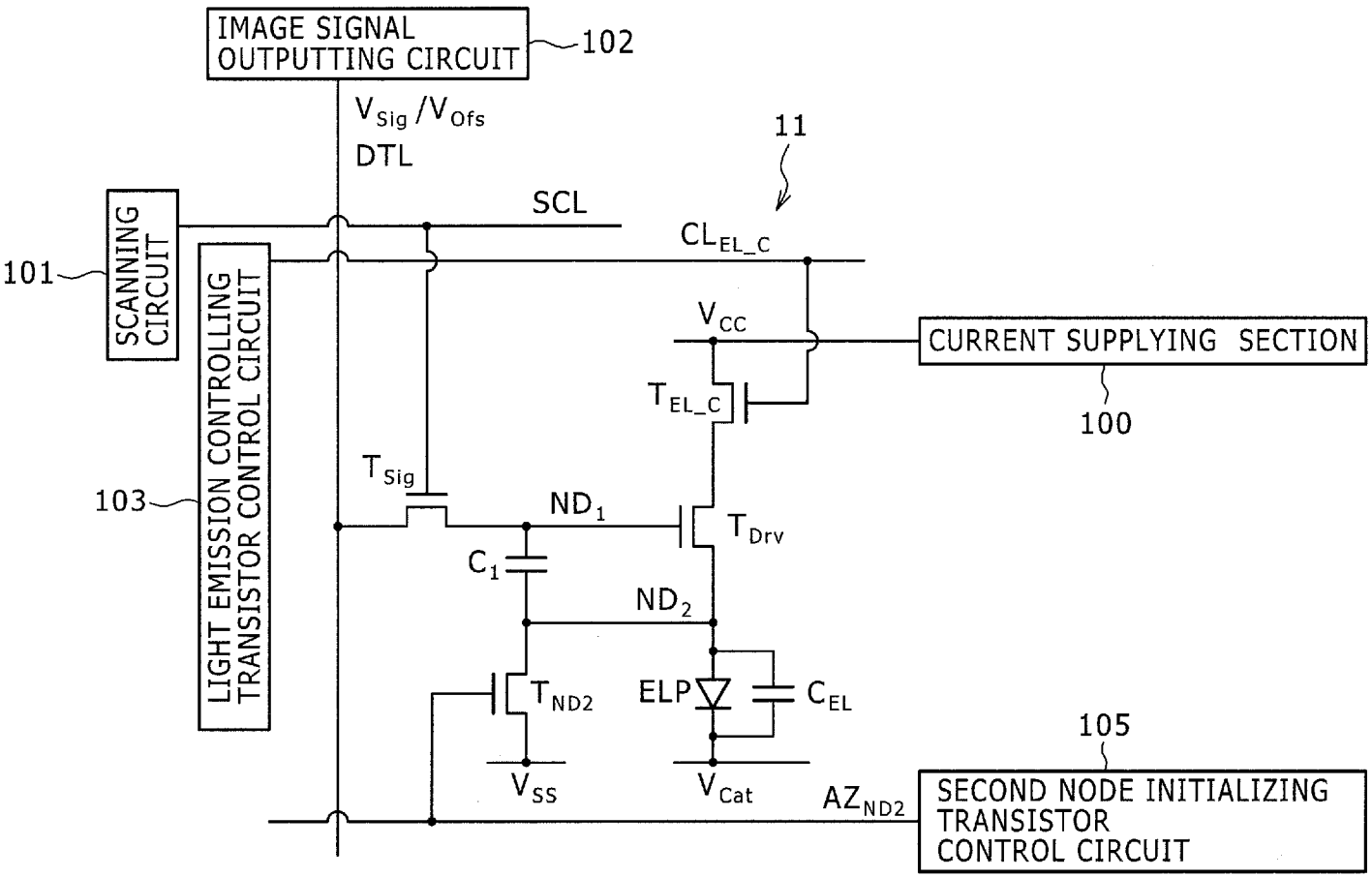

FIG. 8 [DISPLAY APPARATUS OF 4Tr/1C DRIVING CIRCUIT CONFIGURATION]
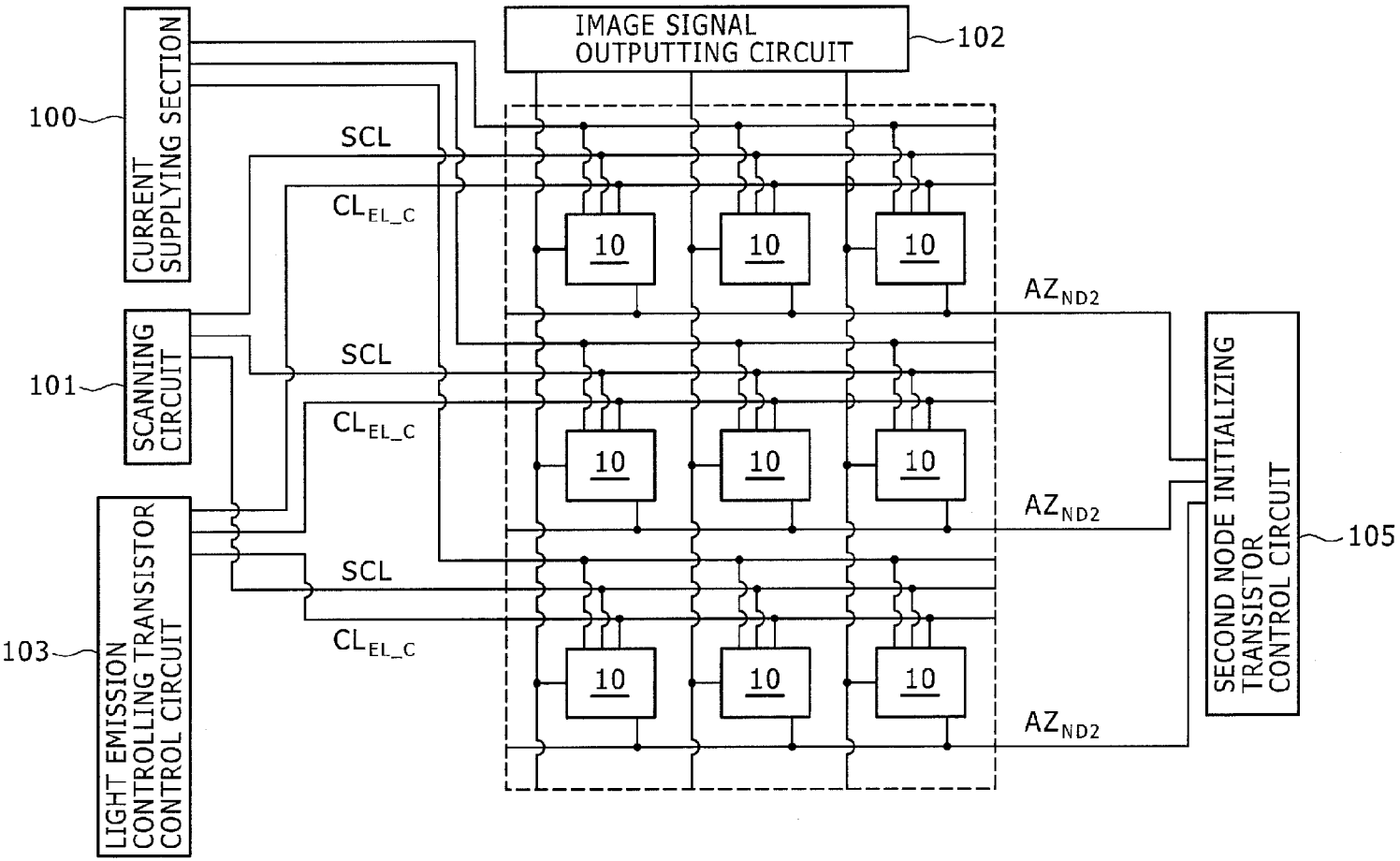

FIG. 9 [4Tr/1C DRIVING CIRCUIT]
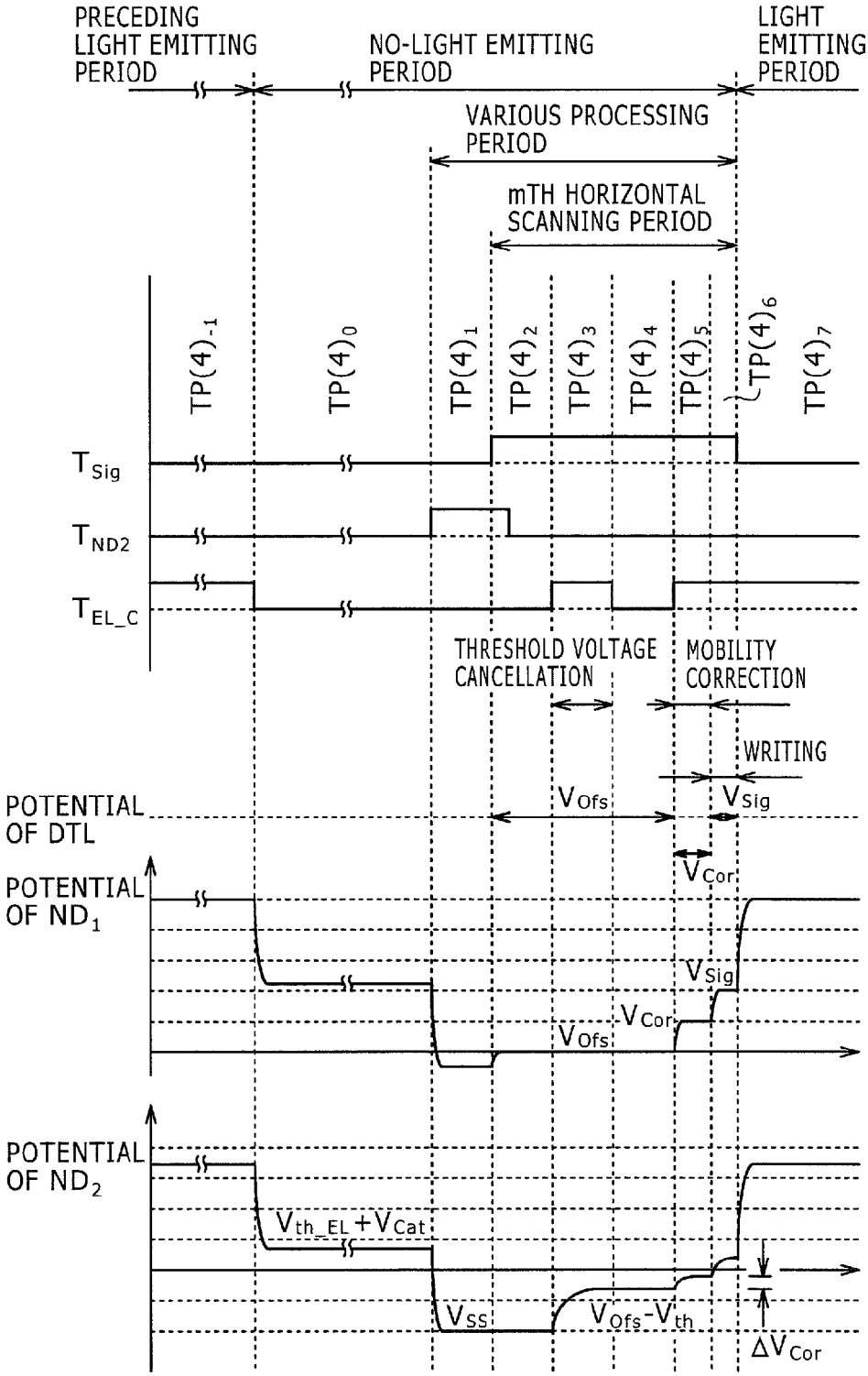

FIG. 10 [4Tr/1C DRIVING CIRCUIT]
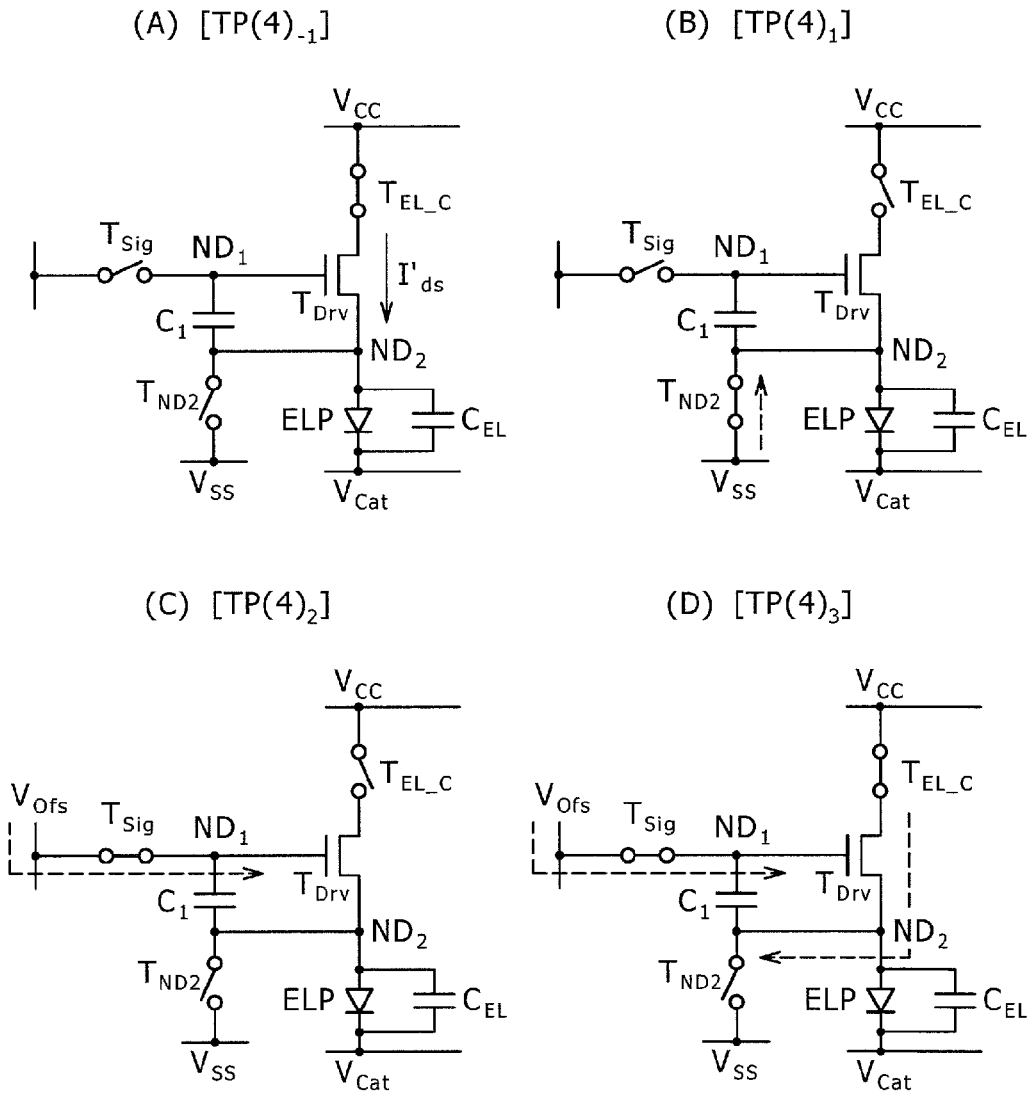

FIG. 11 [4Tr/1C DRIVING CIRCUIT]
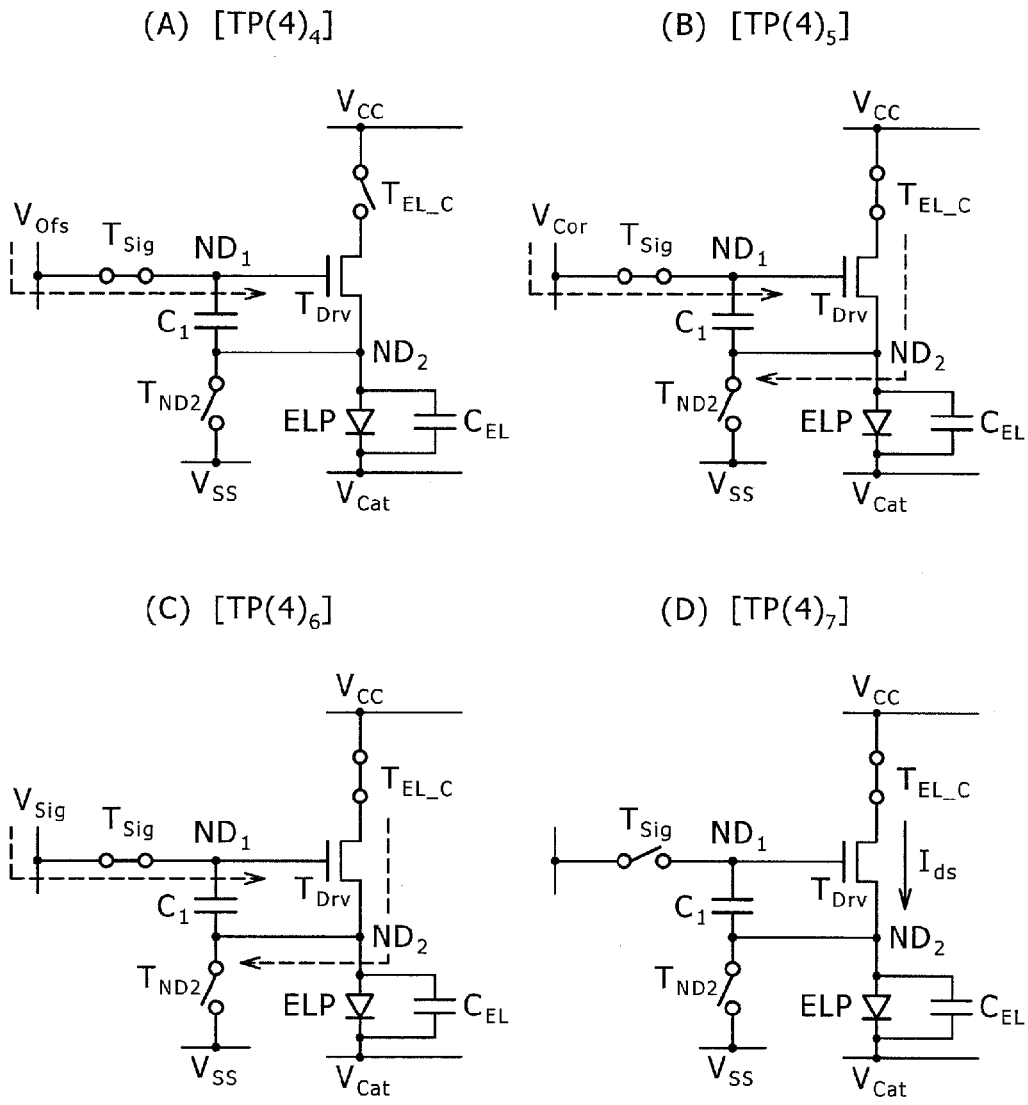

FIG. 12 [3Tr/1C DRIVING CIRCUIT]
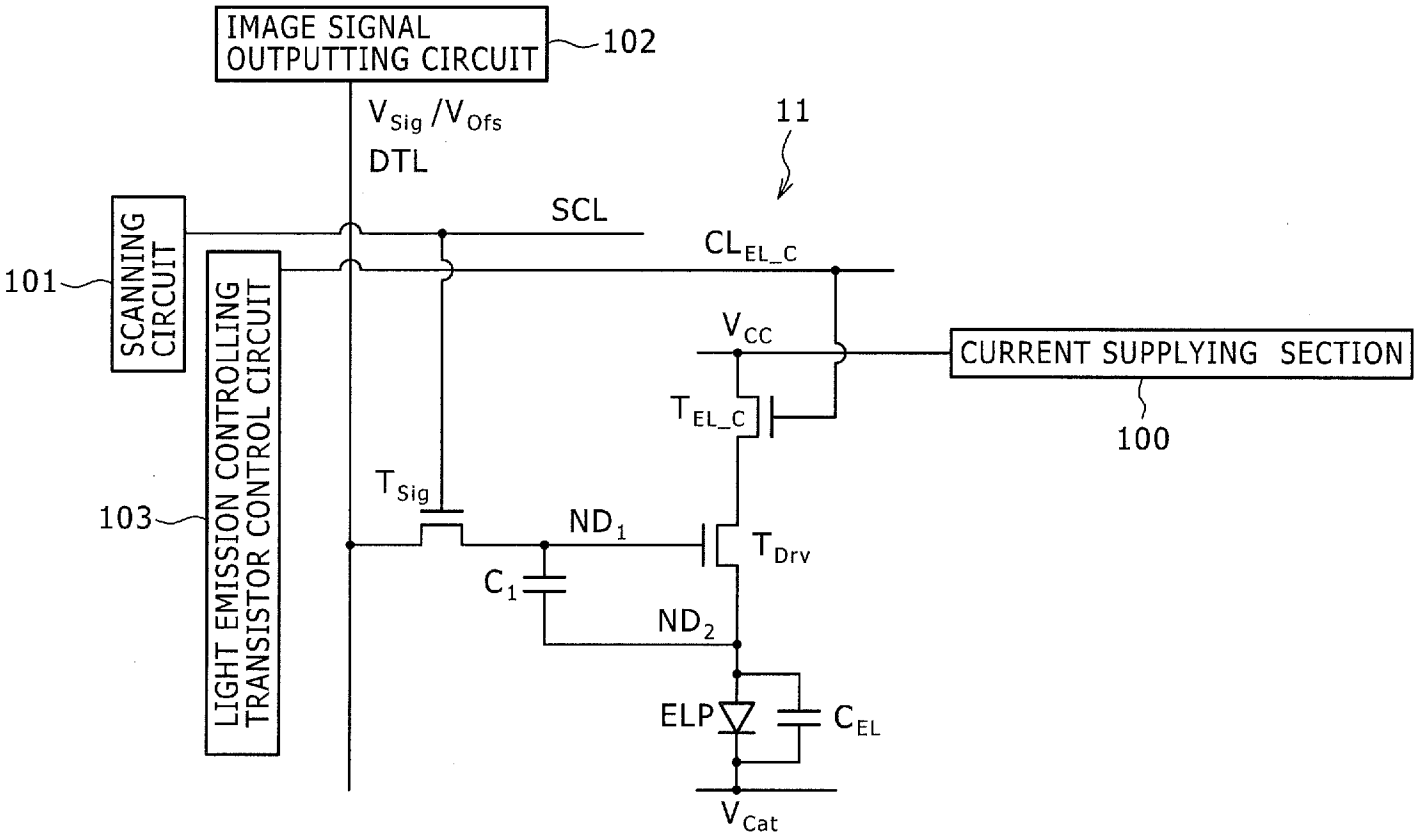

FIG. 13 [DISPLAY APPARATUS OF 3Tr/1C DRIVING CIRCUIT CONFIGURATION]
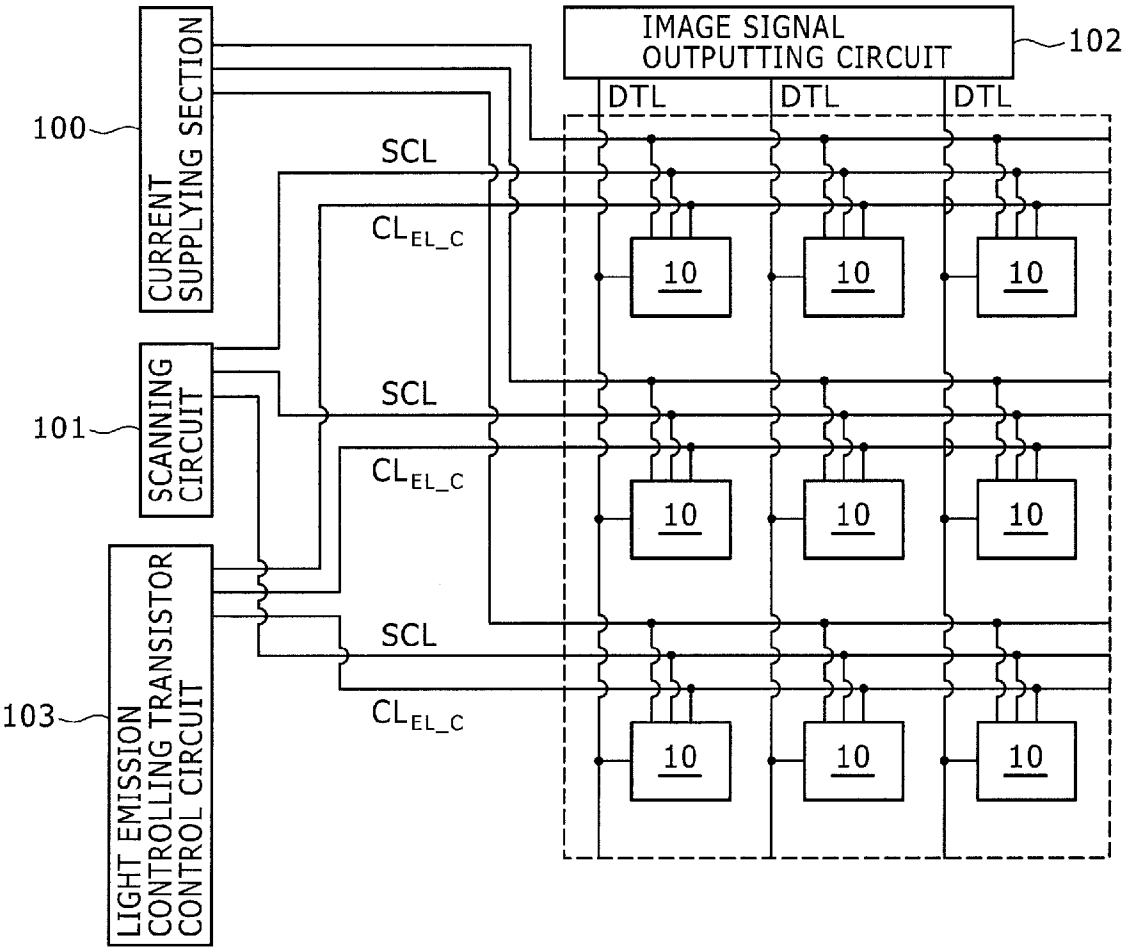

FIG. 14 [3Tr/1C DRIVING CIRCUIT]
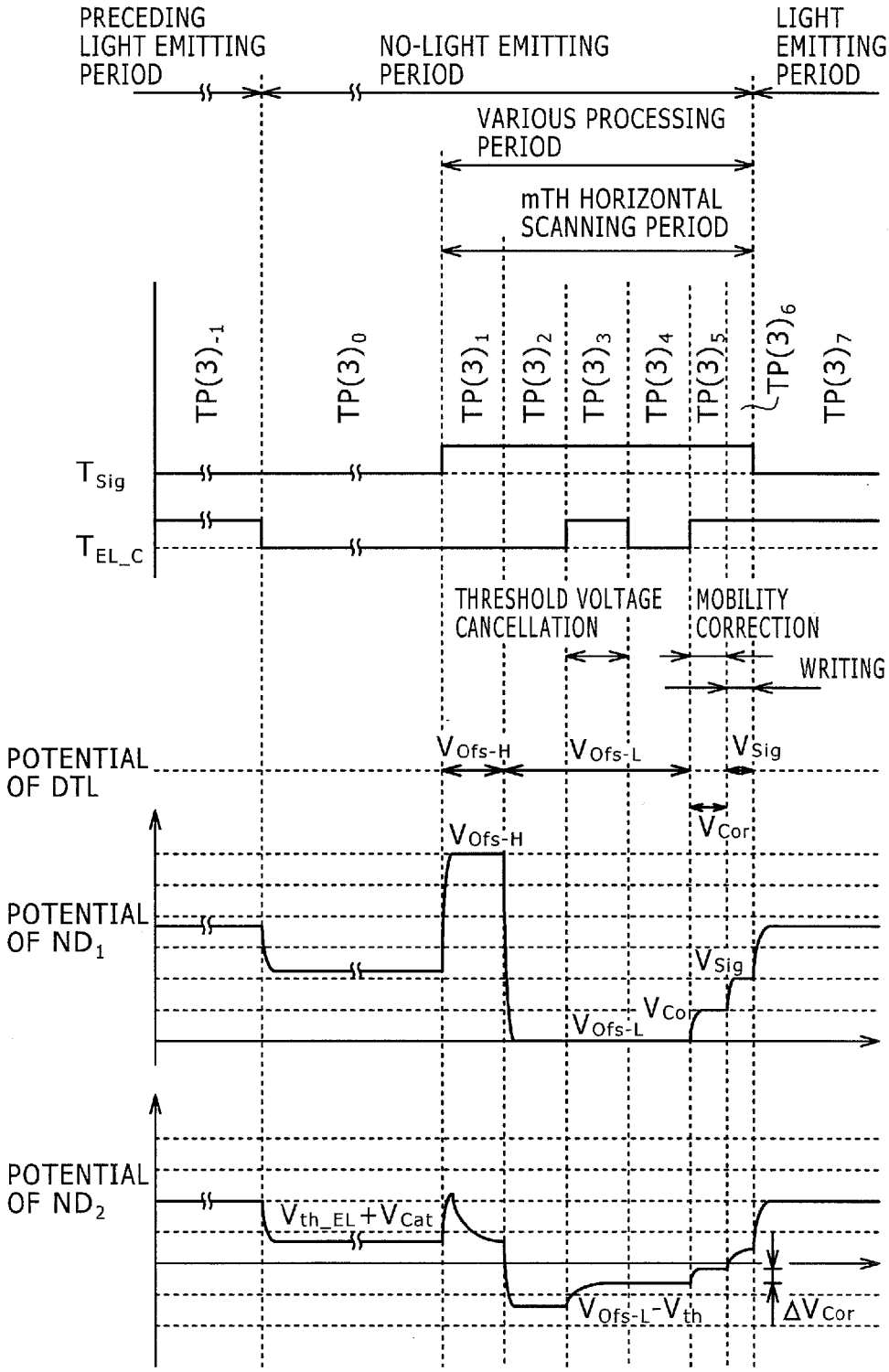

FIG. 15 [3Tr/1C DRIVING CIRCUIT]
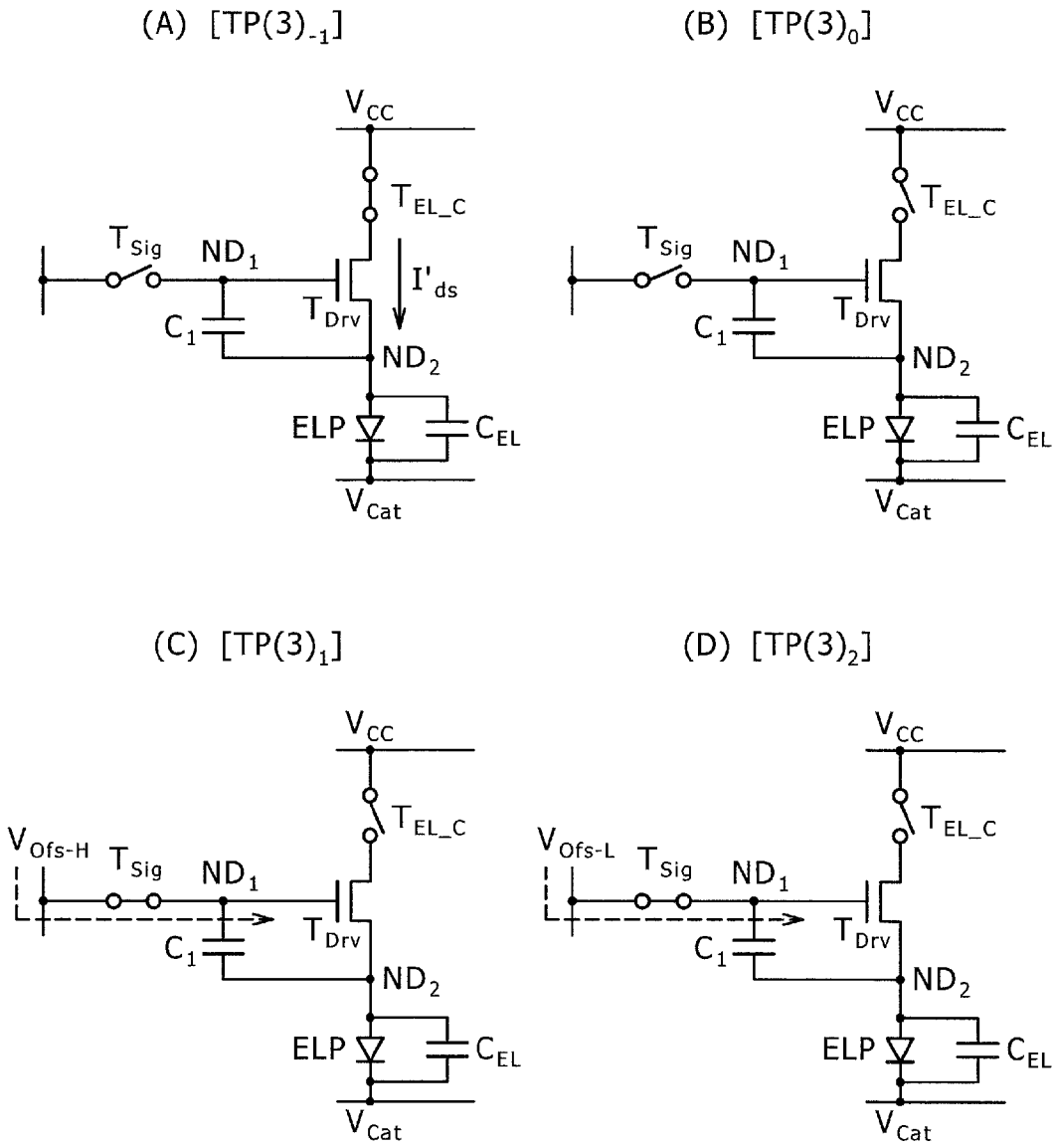

FIG. 16 [3Tr/1C DRIVING CIRCUIT]
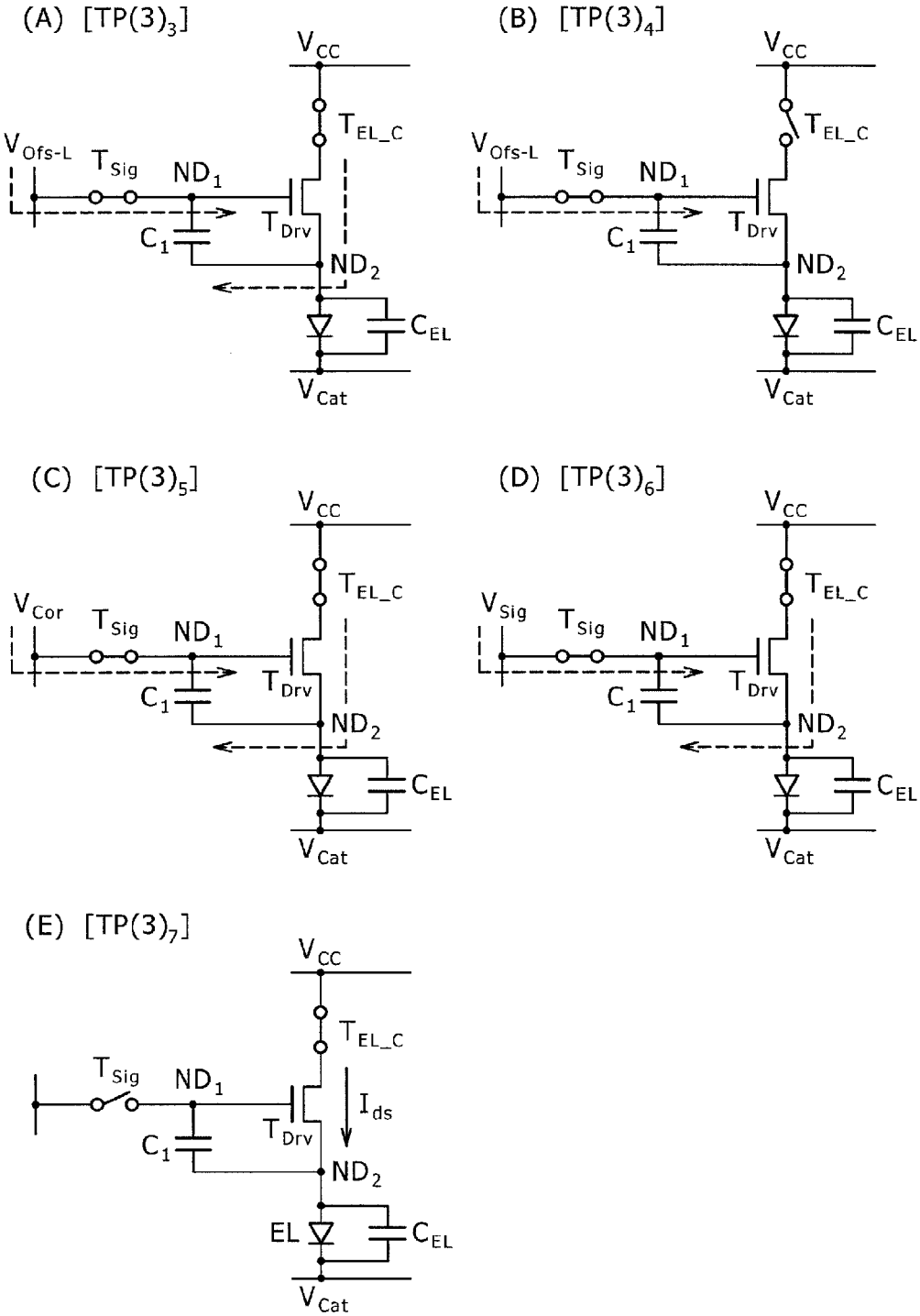

FIG. 17 [2Tr/1C DRIVING CIRCUIT]
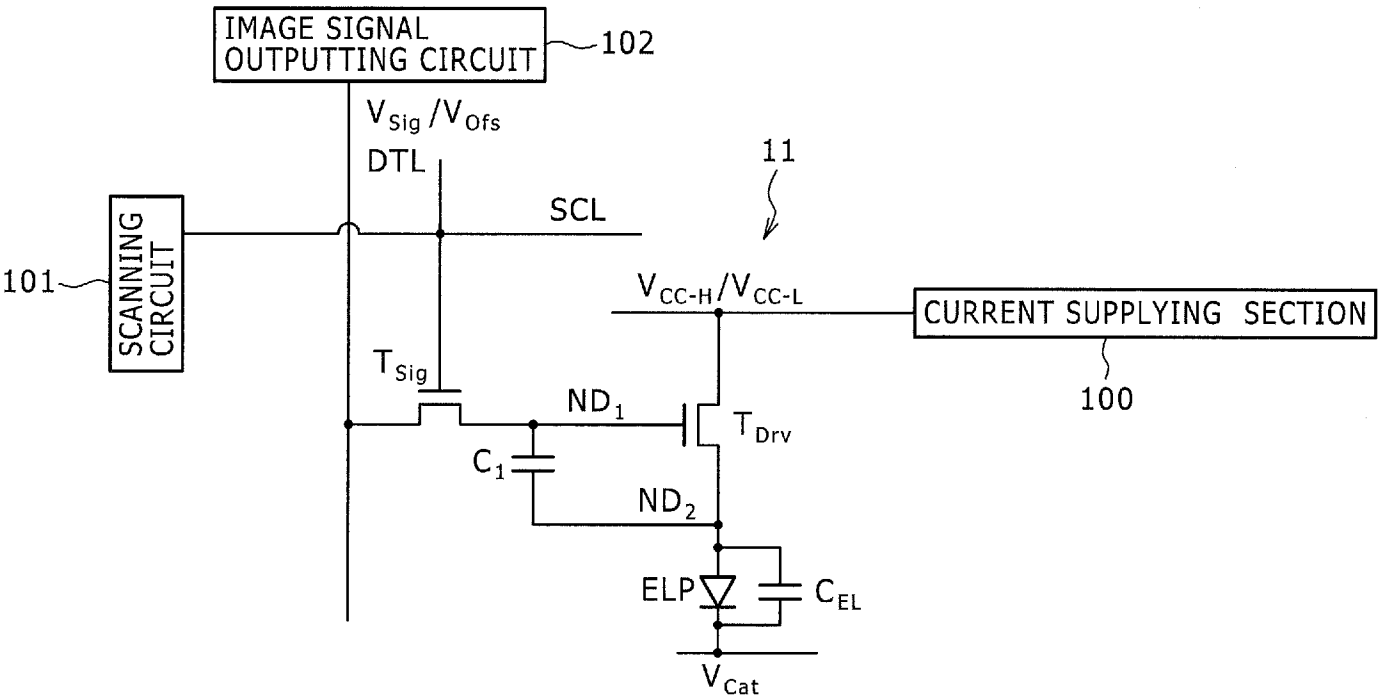

FIG. 18 [DISPLAY APPARATUS OF 2Tr/1C DRIVING CIRCUIT CONFIGURATION]
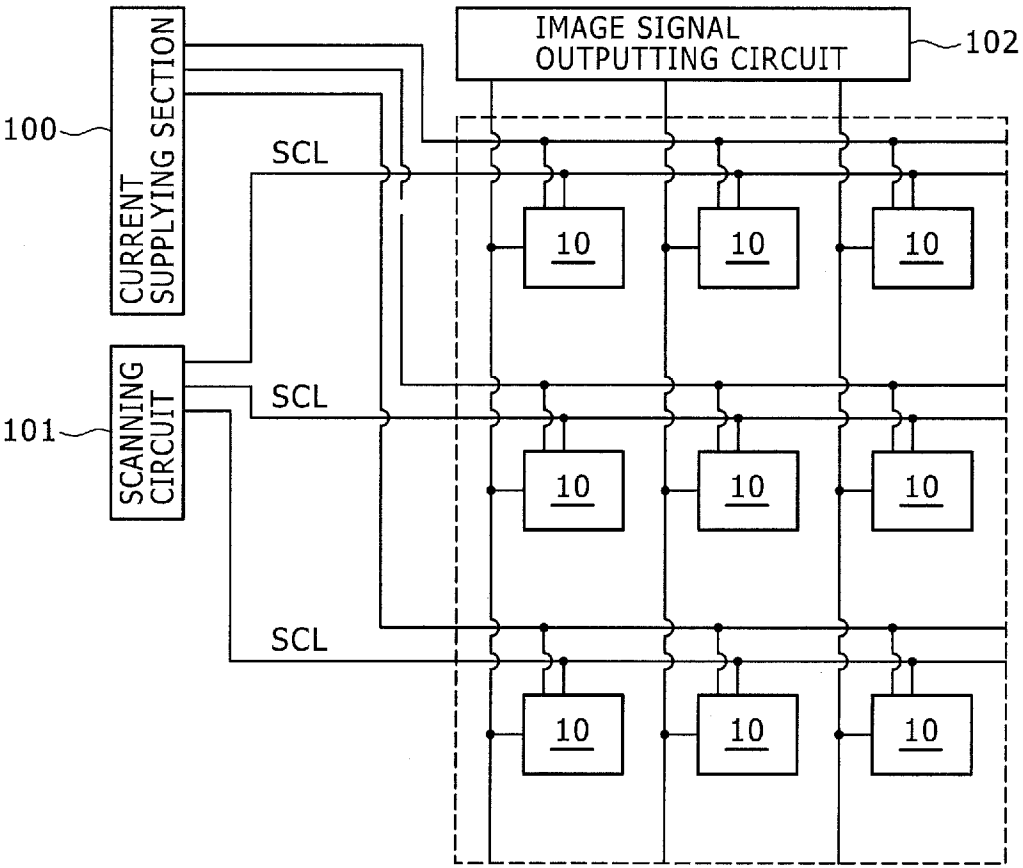

FIG. 19 [2Tr/1C DRIVING CIRCUIT]
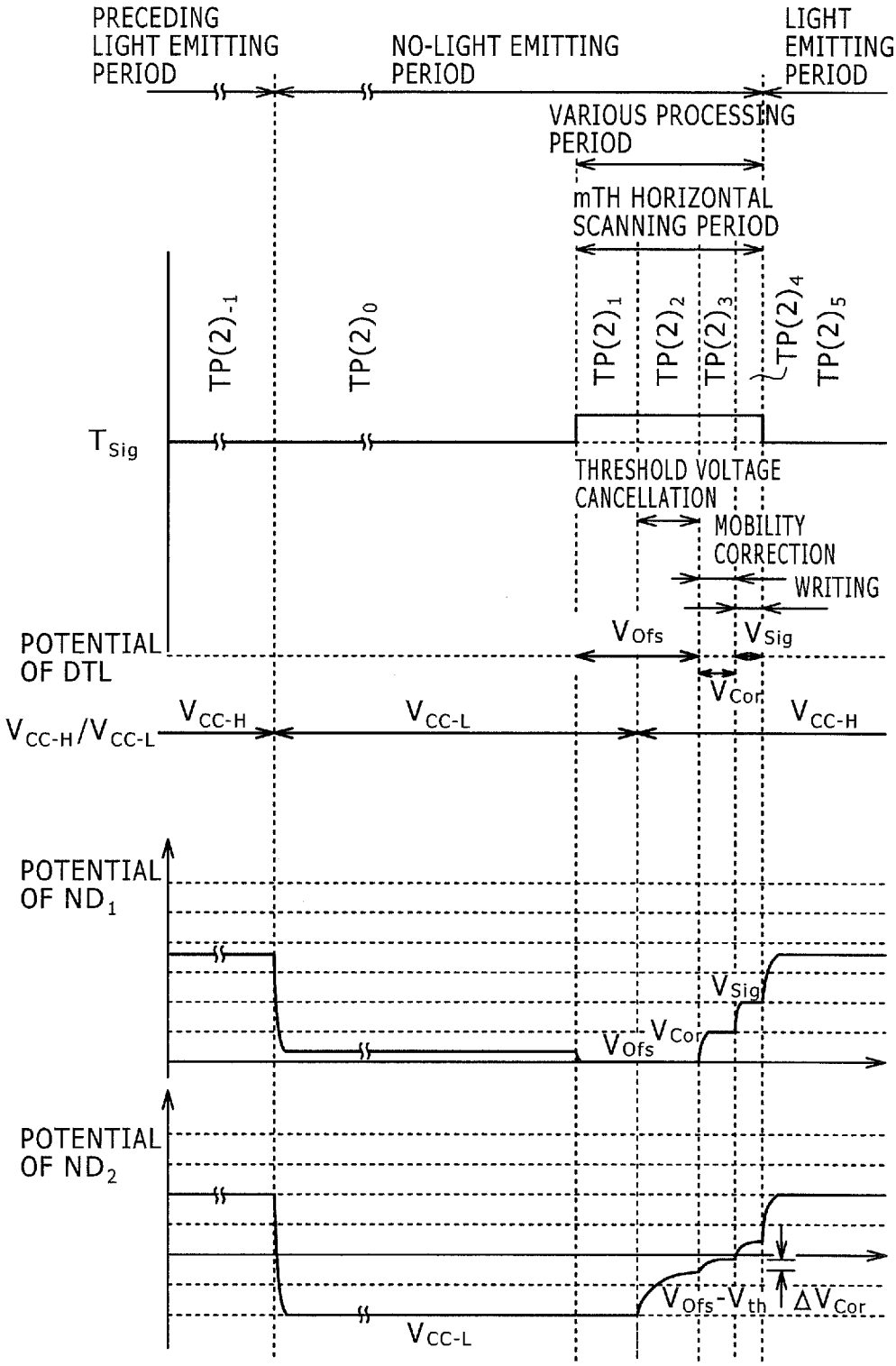

FIG. 20 [2Tr/1C DRIVING CIRCUIT]
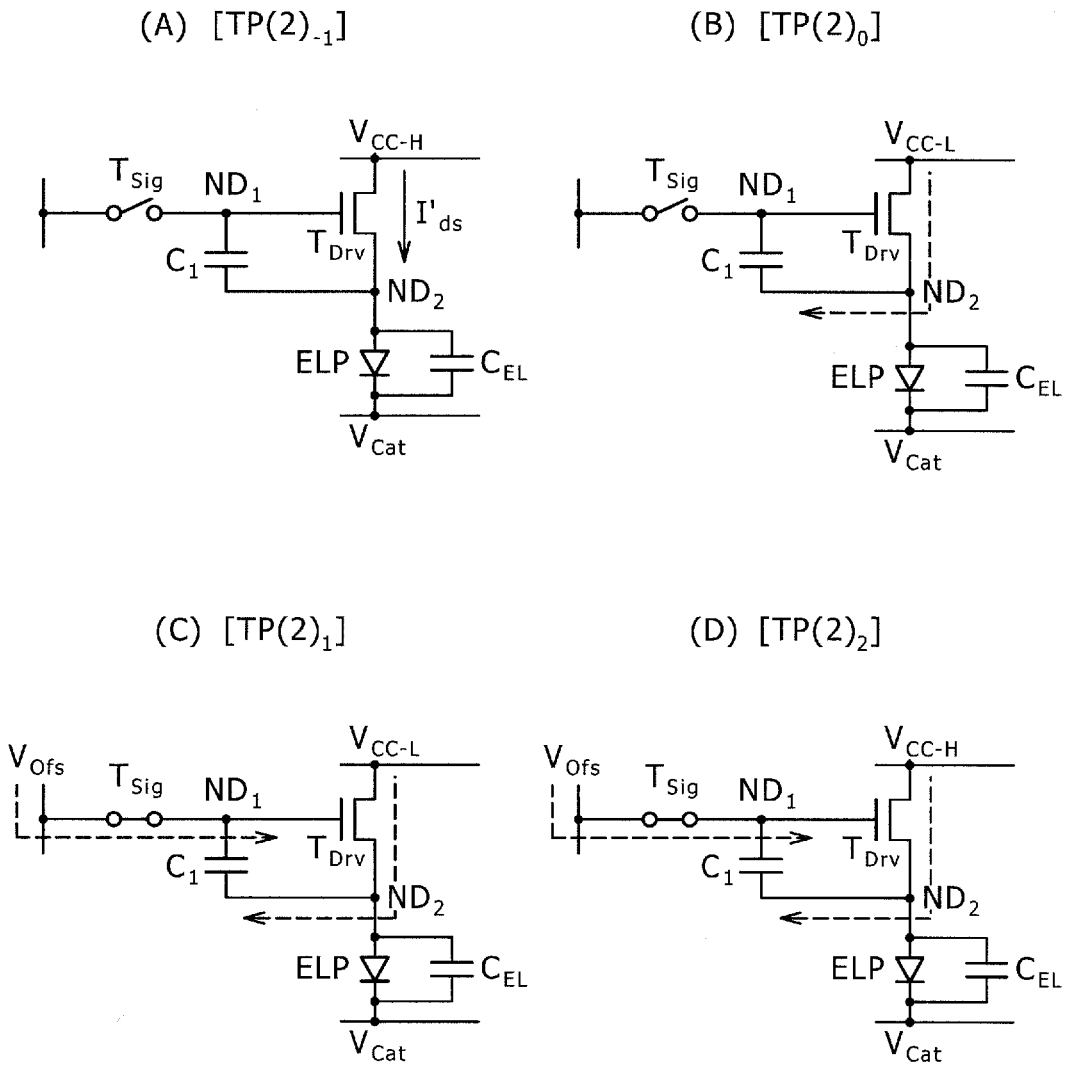

FIG.21 [2Tr/1C DRIVING CIRCUIT]
(A) [TP(2)$_3$]
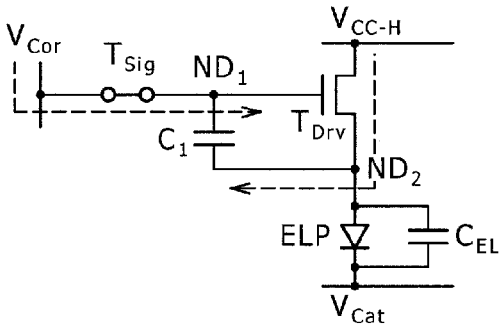
(B) [TP(2)$_4$]
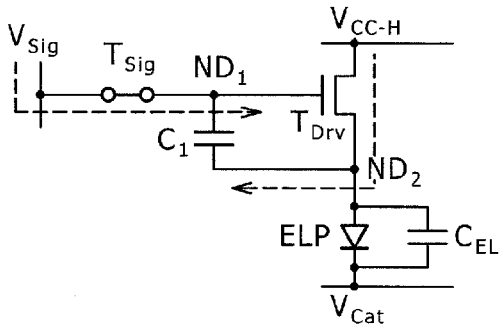
(C) [TP(2)$_5$]
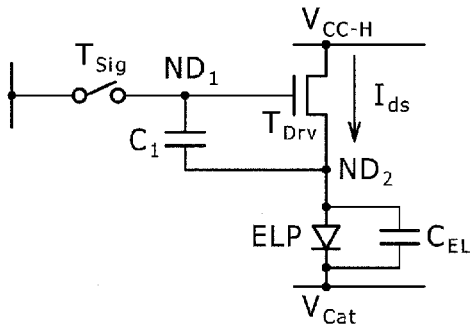

[5Tr/1C DRIVING CIRCUIT]

DRIVING METHOD FOR ORGANIC ELECTROLUMINESCENCE LIGHT EMITTING SECTION

CROSS REFERENCE TO RELATED APPLICATIONS

This is a Continuation Application of U.S. patent application Ser. No. 13/287,805, filed Nov. 2, 2011, which is a Continuation Application of U.S. patent application Ser. No. 12/450,266, filed Sep. 18, 2009, which is based on a National Stage Application of PCT/JP08/055,045, filed Mar. 19, 2008, which in turn claims priority from Japanese Application No. 2007-098465, filed on Apr. 4, 2007, the entire contents of which are incorporated herein by reference.

TECHNICAL FIELD

This invention relates to a driving method for an organic electroluminescence light emitting section.

BACKGROUND ART

In an organic electroluminescence display apparatus (hereinafter referred to simply as organic EL display apparatus) which uses an organic electroluminescence element (hereinafter referred to simply as organic EL element) as a light emitting element, the luminance of the organic EL element is controlled with the value of current flowing through the organic EL element. And similarly as in a liquid crystal display apparatus, also in the organic EL display apparatus, a simple matrix type and an active matrix type are known as driving methods. Although the active matrix type has such a drawback that it is complicated in structure in comparison with the simple matrix type, it has such various advantages as an advantage that an image can be displayed with high luminance.

As a circuit for driving an organic electroluminescence light emitting section (hereinafter referred to simply as light emitting section) which forms an organic EL element, a driving circuit (called 5Tr/1C driving circuit) composed of five transistors and one capacitor is commonly known, for example, from Japanese Patent Laid-Open No. 2006-215213. This conventional 5Tr/1C driving circuit includes, as shown in FIG. 1, five transistors of, as shown in FIG. 1, an image signal writing transistor $T_{Sig}$, a driving transistor $T_{Drv}$, a light emission controlling transistor $T_{EL_C}$, a first node initializing transistor $T_{ND1}$ and a second node initializing transistor $T_{ND2}$ and further includes one capacitor section $C_1$. Here, the other one of the source/drain regions of the driving transistor $T_{Drv}$ forms a second node $ND_2$ and the gate electrode of the driving transistor $T_{Drv}$ forms a first node $ND_1$.

It is to be noted that the transistors and the capacitor are hereinafter described in detail.

Further, as shown in a timing chart of FIG. 24, within a [period TP $(\mathbf{5})_1$], a pre-process for carrying out a threshold voltage cancellation process is executed. In particular, when the first node initializing transistor $T_{ND1}$ and the second node initializing transistor $T_{ND2}$ are placed into an on state, the potential of the first node $ND_1$ becomes $V_{Ofs}$ (for example, 0 volts). Meanwhile, the potential of the second node $ND_2$ becomes $V_{SS}$ (for example, −10 volts). As a result, the potential difference between the gate electrode and the other one (for the convenience of description, hereinafter referred to as source region) of the source/drain electrodes of the driving transistor $T_{Drv}$ becomes higher than $V_{th}$ and the driving transistor $T_{Drv}$ is placed into an on state.

Then, within a [period TP $(\mathbf{5})_2$], a threshold voltage cancellation process is carried out. In particular, while the on state of the first node initializing transistor $T_{ND1}$ is maintained, the light emission controlling transistor $T_{EL_C}$ is placed into an on state. As a result, the potential of the second node $ND_2$ changes toward a potential difference of the threshold voltage $V_{th}$ of the driving transistor $T_{Drv}$ from the potential of the first node $ND_1$. In other words, the potential of the second node $ND_2$ which is in a floating state rises. Then, when the potential difference between the gate electrode and the source electrode of the driving transistor $T_{Drv}$ reaches $V_{th}$, the driving transistor $T_{Drv}$ is placed into an off state. In this state, the potential of the second node is substantially $(V_{Ofs}-V_{th})$. Thereafter, within a [period TP $(\mathbf{5})_3$], while the on state of the first node initializing transistor $T_{ND1}$ is maintained, the light emission controlling transistor $T_{EL_C}$ is placed into an off state. Then, within a [period TP $(\mathbf{5})_4$], the first node initializing transistor $T_{ND1}$ is placed into an off state.

Then, within a [period TP $(\mathbf{5})_5$'], a kind of writing process into the driving transistor $T_{Drv}$ is executed. In particular, while the off state of the first node initializing transistor $T_{ND1}$, second node initializing transistor $T_{ND2}$ and light emission controlling transistor $T_{EL_C}$ is maintained, the potential of a data line DTL is set to a voltage corresponding to an image signal [image signal (driving signal, luminance signal) $V_{Sig}$ for controlling the luminance of the light emitting section ELP] and then a scanning line SCL is set to the high level to place the image signal writing transistor $T_{Sig}$ into an on state. As a result, the potential of the first node $ND_1$ rides to $V_{Sig}$. Charge based on the variation of the potential of the first node $ND_1$ is distributed to the capacitor section $C_1$, the parasitic capacitance $C_{EL}$ of the light emitting section ELP and the parasitic capacitance between the gate electrode and the source electrode of the driving transistor $T_{Drv}$. Accordingly, if the potential of the first node $ND_1$ varies, then also the potential of the second node $ND_2$ varies. However, as the capacitance value of the parasitic capacitance $C_{EL}$ of the light emitting section ELP has an increasing value, the variation of the potential of the second node $ND_2$ decreases. Generally, the capacitance of the parasitic capacitance $C_{EL}$ of the light emitting section ELP is higher than the capacitance value of the capacitor section $C_1$ and the value of the parasitic capacitance of the driving transistor $T_{Drv}$. Therefore, if it is assumed that the potential of the second node $ND_2$ little varies, then the potential difference $V_{gs}$ between the gate electrode and the other one of the source/drain regions of the driving transistor $T_{Drv}$ is given by the expression (A) given below. It is to be noted that an enlarged timing chart within a [period TP $(\mathbf{5})_5$'] and a [period TP $(\mathbf{5})_6$'] is shown in (A) of FIG. 25.

$$V_{gs} \approx V_{Sig}-(V_{Ofs}-V_{th}) \quad \text{(A)}$$

Thereafter, within the [period TP $(\mathbf{5})_6$'], correction (mobility correction process) of the potential of the source region (second node $ND_2$) of the driving transistor $T_{Drv}$ based on the magnitude of the mobility μ of the driving transistor $T_{Drv}$ is carried out. In particular, while the on state of the driving transistor $T_{Drv}$ is maintained, the light emission controlling transistor $T_{EL_C}$ is placed into an on state, and then when predetermined time ($t_{Cor}$) elapses, the image signal writing transistor $T_{Sig}$ is placed into an off state to place the first node $ND_1$ (gate electrode of the driving transistor $T_{Drv}$) into a floating state. As a result, where the value of the mobility μ of the driving transistor $T_{Drv}$ is high, the rise amount ΔV of the potential (potential correction value) in the source region of the driving transistor $T_{Drv}$ is great, but where the value of the mobility μ of the driving transistor $T_{Drv}$ is low, the rise amount ΔV of the potential (potential correction value) in the source region of the driving transistor $T_{Drv}$ is small. Here, the potential difference $V_{gs}$ between the gate electrode and the source electrode of the driving transistor $T_{Drv}$ is transformed from the expression (A) into the expression (B) given below. It is to be noted that the predetermined time for executing the mobility correction process (total time ($t_{Cor}$) of the [period TP $(\mathbf{5})_6$']) may be determined in advance as a design value upon designing of the organic EL display apparatus.

$$V_{gs} \approx V_{Sig} - (V_{Ofs} - V_{th}) - \Delta V \quad \text{(B)}$$

By the foregoing operation, the threshold voltage cancellation process, writing process and mobility correction process are completed. Within a later [period TP $(\mathbf{5})_7$], the image signal writing transistor $T_{Sig}$ is placed into an off state and the first node $ND_1$, that is, the gate electrode of the driving transistor $T_{Drv}$, is placed into a floating state while the light emission controlling transistor $T_{EL_C}$ maintains the on state and one (for the convenience of description, hereinafter referred to as drain region) of the source/drain regions of the light emission controlling transistor $T_{EL_C}$ is in a state wherein it is connected to a current supplying section (voltage $V_{CC}$, for example, 20 volts) for controlling the light emission of the light emitting section ELP. Accordingly, as a result of the foregoing, the potential of the second node $ND_2$ rises, and a phenomenon similar to that which occurs with a so-called bootstrap circuit occurs with the gate electrode of the driving transistor $T_{Drv}$ and also the potential of the first node $ND_1$ rises. As a result, the potential difference $V_{gs}$ between the gate electrode and the source electrode of the driving transistor $T_{Drv}$ maintains the value of the expression (B). Meanwhile, since the current flowing through the light emitting section ELP is drain current $I_{ds}$ which flows from one (for the convenience of description, hereinafter referred to as drain region) of the source/drain regions to the source region of the driving transistor $T_{Drv}$, it can be represented by the expression (C). It is to be noted that the coefficient k is hereinafter described.

$$\begin{aligned} I_{ds} &= k \cdot \mu \cdot (V_{gs} - V_{th})^2 \\ &= k \cdot \mu \cdot (V_{Sig} - V_{Ofs} - \Delta V)^2 \end{aligned} \quad \text{(C)}$$

Also driving and so forth of the 5Tr/1C driving circuit whose outline is described above are hereinafter described in detail.

Incidentally, in the mobility correction process, the voltage of the source region of the driving transistor $T_{Drv}$ relies upon the image signal (driving signal, luminance signal) $V_{Sig}$ as apparent also from the expression (B) and is not fixed. And, since, in order to raise the luminance of the organic EL element, high current flows through the driving transistor $T_{Drv}$, the rising speed of the rise amount ΔV of the potential in the source region of the driving transistor $T_{Drv}$ is accelerated.

In other words, since the predetermined time for executing the mobility correction process (total time ($t_{Cor}$) of the [period TP $(\mathbf{5})_6$']) is a fixed design value, where "white display" is to be carried out on the organic EL display apparatus, that is, where the organic EL element displays high luminance, the rise amount ΔV (potential correction value) of the potential in the source region of the driving transistor $T_{Drv}$ exhibits a quick rise as indicated by a solid line $\Delta V_1$ in (B) of FIG. 25. On the other hand, where "black display" is to be carried out, that is, where the organic EL element displays low luminance, the rise amount ΔV (potential correction value) of the potential in the source region of the driving transistor $T_{Drv}$ exhibits a slow rise as indicated by a solid line $\Delta V_2$ in (B) of FIG. 25. In particular, where the value of ΔV required where "white display" is carried out is represented by $\Delta V_H$, the rise amount ΔV reaches $\Delta V_H$ in time ($t_{H\text{-}Cor}$) shorter than $t_{Cor}$. On the other hand, where the value of ΔV required where "black display" is carried out is represented by $\Delta V_L$, $\Delta V_L$ is not reached if time ($t_{L\text{-}Cor}$) longer than $t_{Cor}$ does not elapse. Accordingly, where "white display" is carried out, the rise amount ΔV becomes excessively great, but where "black display" is carried out, the rise amount ΔV becomes excessively small. As a result, such a problem that the display quality of the organic EL display apparatus is deteriorated occurs.

Accordingly, the object of the present invention resides in provision of a driving method for an organic electroluminescence light emitting period of an organic electroluminescence display apparatus which makes it possible to achieve optimization of a mobility correction process of a transistor which composes a driving circuit in response to an image to be displayed.

DISCLOSURE OF INVENTION

In order to achieve the object described above, according to the present invention, there is provided a driving method for an organic electroluminescence light emitting section which uses a driving circuit including (A) a driving transistor having source/drain regions, a channel formation region and a gate electrode, (B) an image signal writing transistor including source/drain regions, a channel formation region and a gate electrode, and (C) a capacitor section including a pair of electrodes, the driving transistor (A-1) being connected at one of the source/drain regions thereof to a current supplying section, (A-2) being connected at the other one of the source/drain regions thereof to the organic electroluminescence light emitting section and also to one of the electrodes of the capacitor section so as to form a second node, and (A-3) being connected at the gate electrode thereof to the other one of the source/drain regions of the image signal writing transistor and the other one of the electrodes of the capacitor section so as to form a first node, the image signal writing transistor (B-1) being connected at one of the source/drain regions thereof to a data line, and (B-2) being connected at the gate electrode thereof to a scanning line.

And, the driving method includes the steps of:

(a) carrying out a pre-process of applying a first node initialization voltage to the first node and applying a second node initialization voltage to the second node so that the potential difference between the first and second nodes exceeds a threshold voltage of the driving transistor and the potential difference between a cathode electrode of the organic electroluminescence light emitting section and the second node does not exceed a threshold voltage of the organic electroluminescence light emitting section;

(b) carrying out a threshold voltage cancellation process of varying the potential of the second node toward a potential of the difference of the threshold voltage of the driving transistor from the potential of the first node in a state wherein the potential of the first node is maintained;

(c) carrying out a writing process of applying an image signal from the data line to the first node through the image signal writing transistor which has been placed into an on state with a signal from the scanning line; and (d) placing the image signal writing transistor into an off state with a signal from the scanning line to place the first node into a floating state thereby to allow current corresponding to the value of the potential difference between the first and second nodes to be supplied from the current supplying section to the organic electroluminescence light emitting section through the driving transistor to drive the organic electroluminescence light emitting section.

The driving method further includes the step of carrying out, between the steps (b) and (c), a mobility correction process of applying a correction voltage to the first node from the data line through the image signal writing transistor which has been placed into an on state with the signal from the scanning line and applying a voltage higher than the potential of the second node at the step (b) from the current supplying section to the one of the source/drain regions of the driving transistor to raise the potential of the second node in response to a characteristic of the driving transistor;

the value of the correction voltage being a value which relies upon the image signal applied from the data line to the first node at the step (c) and is lower than the image signal.

It is to be noted that, in order to vary, at the step (b) described above, the potential of the second node toward the potential of the difference of the threshold voltage of the driving transistor from the potential of the first node in the state wherein the potential of the first node is maintained, a voltage exceeding the voltage of the sum of the potential of the second node at the step (a) and the threshold voltage of the driving transistor may be applied from the current supplying section to the one of the source/drain regions of the driving transistor.

In the driving method for an organic electroluminescence light emitting section (hereinafter referred to simply as driving method of the present invention), the following parameters are used:

value of the image signal: $V_{Sig}$ value of the correction voltage: $V_{Cor}$ minimum value of the image signal: $V_{Sig\text{-}Min}$ maximum value of the image signal: $V_{Sig\text{-}Max}$ In this instance, the driving method may have such a form that $V_{Cor}$ is represented by a quadratic function of $V_{Sig}$ [this can be represented, where $a_2$, $a_1$ and $a_0$ (where $a_2<0$) are coefficients, as $V_{Cor}=a_2\cdot V_{Sig}^2+a_1\cdot V_{Sig}+a_0$ wherein the coefficient of a quadratic term is a negative value.

Or, the driving method may have such a form that, where $\alpha_1$ and $\beta_2$ are constants higher than 0 and $\beta_1$ is a constant, $$V_{Cor}=\alpha_1\times V_{Sig}+\beta_1 \text{ [where } V_{Sig\text{-}Min}\leq V_{Sig}\leq V_{Sig\text{-}0}]$$

$$V_{Cor}=\beta_2 \text{ [where } V_{Sig\text{-}0}<V_{Sig}\leq V_{Sig\text{-}Max}]$$

are satisfied. It is to be noted, however, that $$\alpha_1\times V_{Sig\text{-}0}+\beta_1=\beta_2$$

Or else, the driving method may have such a form that, where $\alpha_1$ is a constant higher than 0 and $\beta_1$ is a constant, $$V_{Cor}=\alpha_1\times V_{Sig}+\beta_1 \text{ [where } V_{Sig\text{-}Min}\leq V_{Sig}\leq V_{Sig\text{-}Max}]$$

is satisfied.

Or else, the driving method may have such a form that, where $\alpha_1$ and $\beta_1$ are constants higher than 0, $$V_{Cor}=-\alpha_1\times V_{Sig}+\beta_1 \text{ [where } V_{Sig\text{-}Min}\leq V_{Sig}\leq V_{Sig\text{-}Max}]$$

is satisfied.

Or else, the driving method may have such a form that, where $\alpha_1$, $\alpha_2$ and $\beta_1$ are constants higher than 0 and $\beta_2$ is a constant, $$V_{Cor}=-\alpha_1\times V_{Sig}+\beta_1 \text{ [where } V_{Sig\text{-}Min}\leq V_{Sig}\leq V_{Sig\text{-}0}]$$

$$V_{Cor}=\alpha_2\times V_{Sig}+\beta_2 \text{ [where } V_{Sig\text{-}0}<V_{Sig}\leq V_{Sig\text{-}Max}]$$

are satisfied.

It is to be noted, however, that $$-\alpha_1\times V_{Sig\text{-}0}+\beta_1=\alpha_1\times V_{Sig\text{-}0}+\beta_1$$

It is to be noted that whether one of the forms should be adopted or a form other than the forms should be adopted may be determined based on time (mobility correction processing time) $t_{Cor}$ for the mobility correction process and time (writing processing time) $t_{Sig}$ for the writing process. Further, the control of the correction voltage is not limited but can be carried out based on a combination of passive elements such as resistors or capacitors and discrete parts provided in an image signal outputting circuit hereinafter described, or can be carried out by storing a table, which defines a relationship between the image signal and the correction voltage using the image signal as a parameter, in the image signal outputting circuit.

Although details of the driving circuit are hereinafter described, the driving circuit can be formed from a driving circuit composed of five transistors and one capacitor section (5Tr/1C driving circuit), a driving circuit composed of four transistors and one capacitor section (4Tr/1C driving circuit), a driving circuit composed of three transistors and one capacitor section (3Tr/1C driving circuit) or a driving circuit composed of two transistors and one capacitor section (2Tr/1C driving circuit).

In an organic electroluminescence display apparatus (organic EL display apparatus) according to the driving method of the present invention, the configuration and the structure of the current supplying section, the scanning circuit connected to the scanning line, the image signal outputting circuit to which the data line is connected, the scanning line, the data line and the organic electroluminescence light emitting section (hereinafter referred to sometimes merely as light emission section) may be a well-known configuration and structure. In particular, the light emitting section can be formed, for example, from an anode electrode, a hole transport layer, a light emitting layer, an electron transport layer, a cathode electrode and so forth.

In the organic EL display apparatus for color display in the driving method of the present invention, one pixel is formed from a plurality of subpixels. Particularly, however, one pixel may have a form that it is formed from three subpixels of a red light emitting subpixel, a green light emitting subpixel and a blue light emitting subpixel. Or one pixel may be formed from a set of subpixels including one or a plurality of different sub pixels in addition to the three different subpixels (for example, a set including an additional subpixel for emitting white light for enhancing the luminance, another set including additional subpixels for emitting light of complementary colors for expanding the color reproduction range, a further set including an additional subpixel for emitting light of yellow for expanding the color reproduction range or a still further set including additional subpixels for emitting light of yellow and cyan for expanding the color reproduction range).

Although a thin film transistor (TFT) of the n channel type can be used for the transistors for forming the driving circuit, according to circumstances, it is possible to use, for example, a thin film transistor of the p channel type for a light emission controlling transistor hereinafter described or use a thin film transistor of the p channel type for the image signal writing transistor. Also it is possible to form the driving circuit from a field effect transistor (for example, a MOS transistor) formed on a silicon semiconductor substrate. The capacitor section can be formed from one electrode, the other electrode, and a dielectric layer (insulating layer) sandwiched between the electrodes. The transistors and the capacitor section which form the driving circuit are formed in a certain plane (for example, formed on a substrate), and the light emitting section is formed above the transistors and the capacitor section which form the driving circuit with an interlayer insulating layer interposed therebetween. Meanwhile, the other one of the source/drain regions of the driving transistor is connected to the anode electrode provided on the light emitting section, for example, through a contact hole.

The organic EL display apparatus to which the driving method of the present invention is applied includes (a) a scanning circuit, (b) an image signal outputting circuit, (c) totaling N×M organic electroluminescence elements arrayed in a two-dimensional matrix including N organic electroluminescence elements arrayed in a first direction and M organic electroluminescence elements arrayed in a second direction different from the first direction, (d) M scanning lines connected to a scanning circuit and extending in the first direction, (e) N data lines connected to an image signal outputting circuit and extending in the second direction, and (f) a current supplying section. Each of the organic electroluminescence elements (referred to simply as organic EL element) includes a driving circuit including a driving transistor, an image signal writing transistor and a capacitor section, and an organic electroluminescence light emitting section (light emitting section).

As described hereinabove, in the prior art, the image signal $V_{Sig}$ is applied, in the mobility correction process, to the gate electrode of the driving transistor $T_{Drv}$. Accordingly, since, in order to raise the luminance of the organic EL element, high current flows to the driving transistor $T_{Drv}$, in the mobility correction process, the rising speed of the rise amount $\Delta V_{Cor}$ of the potential (potential correction value) in the source region of the driving transistor $T_{Drv}$ increases. Then, since the mobility correction processing time $t_{Cor}$ is fixed, even if organic EL elements have the same mobility, the rise amount $\Delta V_{Cor}$ (potential correction value) is great with the organic EL element which displays high luminance. Therefore, from the expression (C) given hereinabove, in the organic EL element which should display high luminance, the current flowing to the light emitting section is reduced, and after all, the luminance of the light emitting section becomes lower than desired luminance. On the other hand, the rise amount $\Delta V_{Cor}$ (potential correction value) is small conversely with the organic EL display element which should display low luminance. Therefore, from the expression (C) given hereinabove, the current to flow to the light emitting section increases in the organic EL element which should display low luminance, and after all, the luminance of the light emitting section becomes higher than desired luminance.

In contrast, in the present invention, the variable correction voltage which has a value which relies upon the image signal $V_{Sig}$ and is lower than the image signal $V_{Sig}$ is applied to the gate electrode of the driving transistor $T_{Drv}$. Accordingly, the influence of the magnitude of the image signal $V_{Sig}$ upon the mobility correction process (influence on the rise amount $\Delta V_{Cor}$) can be reduced, and the luminance of the light emitting section can be set to the desired luminance or the luminance of the light emitting section can be varied further closer to the desired luminance. As a result, enhancement of the display quality of the organic EL display apparatus can be achieved.

BRIEF DESCRIPTION OF DRAWINGS

FIG. 5 (A) to (D) are views schematically showing on/off states and so forth of the transistors which compose the driving circuit of the embodiment 1 basically formed from the 5-transistor/1-capacitor section.

FIG. 6 (A) to (E) are views schematically showing on/off states and so forth of the transistors which compose the driving circuit of the embodiment 1 basically formed from the 5-transistor/1-capacitor section following (D) of FIG. 5.

FIG. 7 is an equivalent circuit diagram of a driving circuit of an embodiment 2 basically formed from a 4-transistor/1-capacitor section.

FIG. 8 is a conceptual view of the driving circuit of the embodiment 2 basically formed from the 4-transistor/1-capacitor section.

FIG. 9 is a view schematically showing a timing chart of driving of the driving circuit of the embodiment 2 basically formed from the 4-transistor/1-capacitor section.

FIG. 10 (A) to (D) are views schematically showing on/off states and so forth of the transistors which compose the driving circuit of the embodiment 2 basically formed from the 4-transistor/1-capacitor section.

FIG. 11 (A) to (D) are views schematically showing on/off states and so forth of the transistors which compose the driving circuit of the embodiment 2 basically formed from the 4-transistor/1-capacitor section following (D) of FIG. 10.

FIG. 12 is an equivalent circuit diagram of a driving circuit of an embodiment 3 basically formed from a 3-transistor/1-capacitor section.

FIG. 13 is a conceptual view of the driving circuit of the embodiment 3 basically formed from the 3-transistor/1-capacitor section.

FIG. 14 is a view schematically showing a timing chart of driving of the driving circuit of the embodiment 3 basically formed from the 3-transistor/1-capacitor section.

FIG. 15 (A) to (D) are views schematically showing on/off states and so forth of the transistors which compose the driving circuit of the embodiment 3 basically formed from the 3-transistor/1-capacitor section.

FIG. 16 (A) to (E) are views schematically showing on/off states and so forth of the transistors which compose the driving circuit of the embodiment 3 basically formed from the 3-transistor/1-capacitor section following (D) of FIG. 15.

FIG. 17 is an equivalent circuit diagram of a driving circuit of an embodiment 4 basically formed from a 2-transistor/1-capacitor section.

FIG. 18 is a conceptual view of the driving circuit of the embodiment 4 basically formed from the 2-transistor/1-capacitor section.

FIG. 19 is a view schematically showing a timing chart of driving of the driving circuit of the embodiment 4 basically formed from the 2-transistor/1-capacitor section.

FIG. 20 (A) to (D) are views schematically showing on/off states and so forth of the transistors which compose the driving circuit of the embodiment 4 basically formed from the 2-transistor/1-capacitor section.

FIG. 21 (A) to (C) are views schematically showing on/off states and so forth of the transistors which compose the driving circuit of the embodiment 4 basically formed from the 2-transistor/1-capacitor section following (D) of FIG. 20.

BEST MODE FOR CARRYING OUT THE INVENTION

In the following, the present invention is described based on embodiments with reference to the drawings. However, prior to the description, an outline of an organic EL display apparatus which is used in the embodiment is described.

Figure 1:
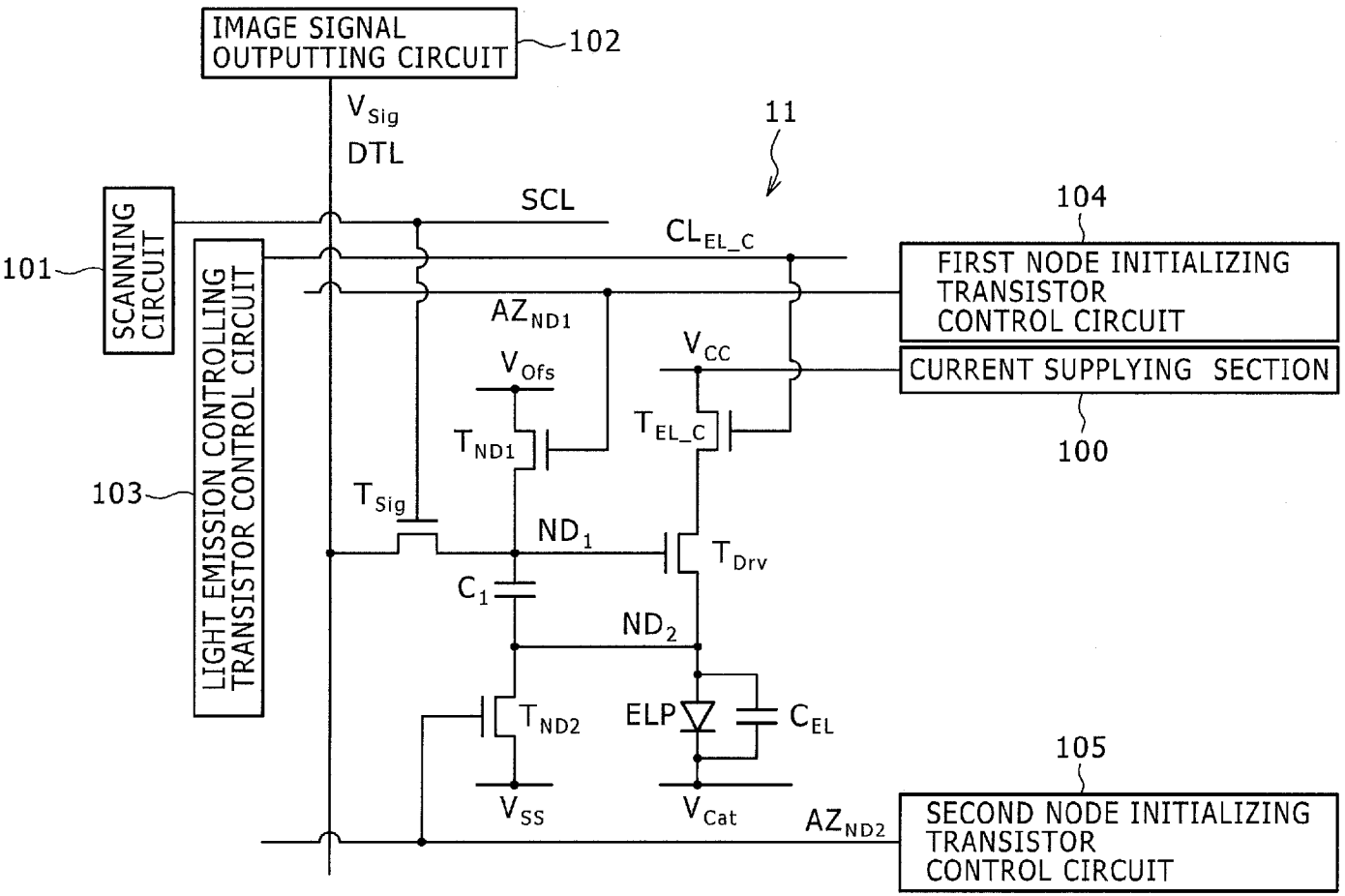
FIG. 1 is an equivalent circuit diagram of a driving circuit of an embodiment 1 basically formed from a 5-transistor/1-capacitor section.
Figure 2:
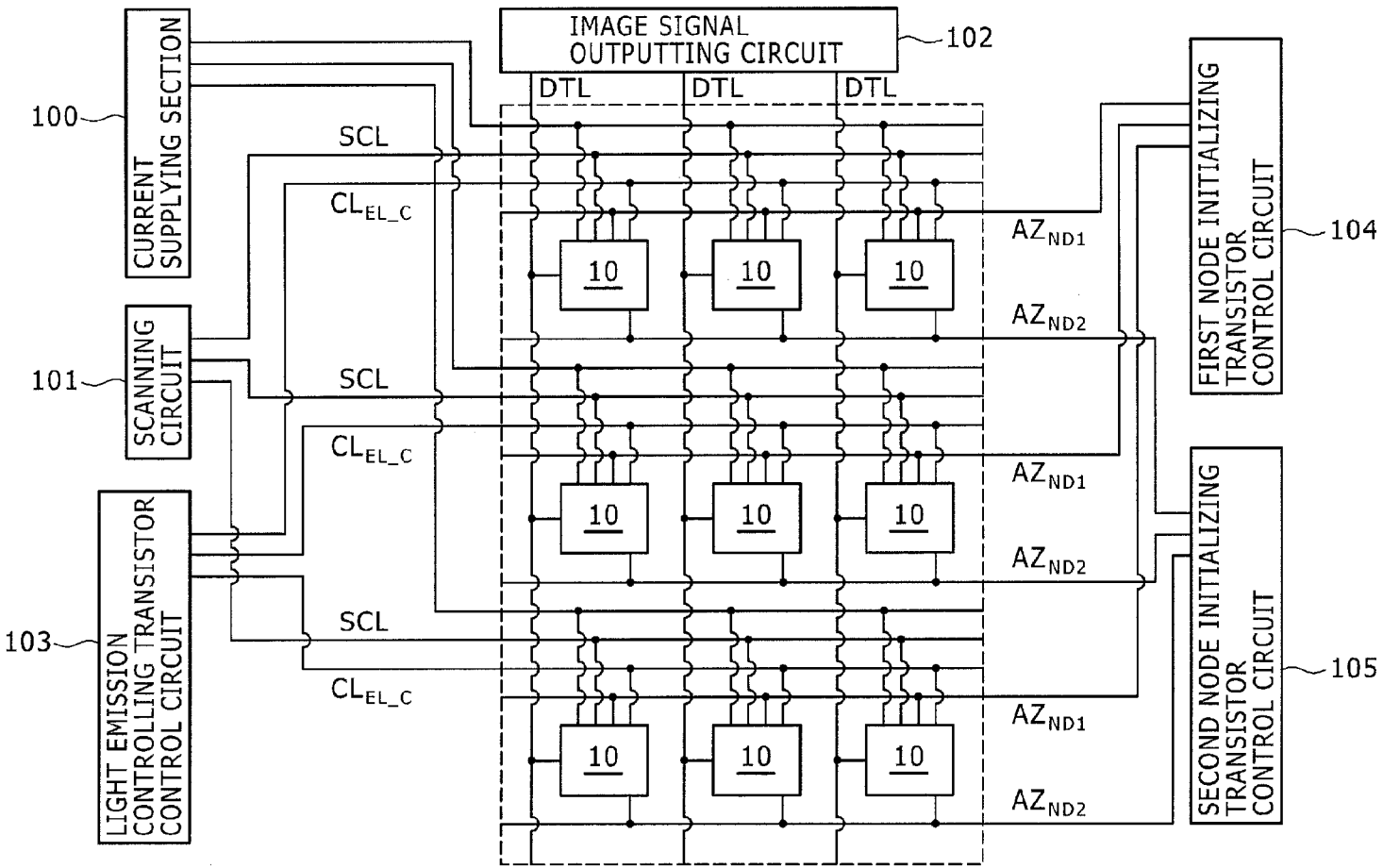
FIG. 2 is a conceptual view of the driving circuit of the embodiment 1 basically formed from the 5-transistor/1-capacitor section.

An organic EL display apparatus suitable for use with the embodiments is an organic EL display apparatus which includes a plurality of pixels. And, one pixel is composed of a plurality of sub pixels (in the embodiments, three sub pixels including a red light emitting sub pixel, a green light emitting sub pixel and a blue light emitting sub pixel), and each of the sub pixels is composed of an organic electroluminescence element (organic EL element) 10 having a structure wherein a driving circuit 11 and an organic electroluminescence light emitting element (light emitting section ELP) connected to the driving circuit 11 are laminated. Equivalent circuit diagrams of the organic EL display apparatus in embodiments 1, 2, 3 and 4 are shown in FIGS. 1, 7, 12 and 17, respectively. Conceptual views of the organic EL display apparatus in embodiments 1, 2, 3 and 4 are shown in FIGS. 2, 8, 13 and 18, respectively. It is to be noted that FIGS. 1 and 2 show a driving circuit basically formed from a 5-transistor/1-capacitor section; FIGS. 7 and 8 show a driving circuit basically formed from a 4-transistor/1-capacitor section; FIGS. 12 and 13 show a driving circuit basically formed from a 3-transistor/1-capacitor section; and FIGS. 17 and 18 show a driving circuit basically formed from a 2-transistor/1-capacitor section.

Here, the organic EL display apparatus in each embodiment includes:

(a) a scanning circuit 101;

(b) an image signal outputting circuit 102;

(c) totaling N×M organic EL elements 10 arrayed in a two-dimensional matrix wherein N organic EL elements are arrayed in a first direction and M organic EL elements 10 are arrayed in a second direction different from the first direction (in particular, in a direction perpendicular to the first direction);

(d) M scanning lines SCL connected to the scanning circuit 101 and extending in the first direction;

(e) N data lines DTL connected to the image signal outputting circuit 102 and extending in the second direction; and (f) a current supplying section 100.

It is to be noted that, while, in FIGS. 2, 8, 13 and 18, 3×3 organic EL elements 10 are shown, this is a mere illustration to the end.

The light emitting section ELP has a well-known configuration and structure including, for example, an anode electrode, a hole transport layer, a light emitting layer, an electron transport layer, a cathode layer and so forth. Further the scanning circuit 101 is provided at one end of the scanning lines SCL. The configuration and structure of the scanning circuit 101, image signal outputting circuit 102, scanning lines SCL, data lines DTL and current supplying section 100 may be any well-known configuration and structure.

Where minimum components of the driving circuit are listed, the driving circuit is composed at least of a driving transistor $T_{Drv}$, an image signal writing transistor $T_{Sig}$ and a capacitor section $C_1$ having a pair of electrodes. The driving transistor $T_{Drv}$ is formed from an n-channel TFT having source/drain regions, a channel formation region and a gate electrode. Also the image signal writing transistor $T_{Sig}$ is formed from an n-channel TFT having source/drain regions, a channel formation region and a gate electrode.

Here, in the driving transistor $T_{Drv}$, (A-1) one (hereinafter referred to as drain region) of the source/drain regions is connected to the current supplying section 100;

(A-2) the other one (hereinafter referred as source region) of the source/drain regions is connected to the anode electrode provided on the light emitting section ELP and connected to one of the electrodes of the capacitor section $C_1$ and forms a second node $ND_2$; and (A-3) the gate electrode is connected to the other one of the source/drain regions of the driving transistor $T_{Drv}$ and connected to the other electrode of the capacitor section $C_1$ and forms a first node $ND_1$.

Further, the image signal writing transistor $T_{Sig}$, (B-1) is connected at the one of the source/drain regions thereof to a data line DTL, and (B-2) is connected at the gate electrode thereof to a scanning line SCL.

Figure 22:
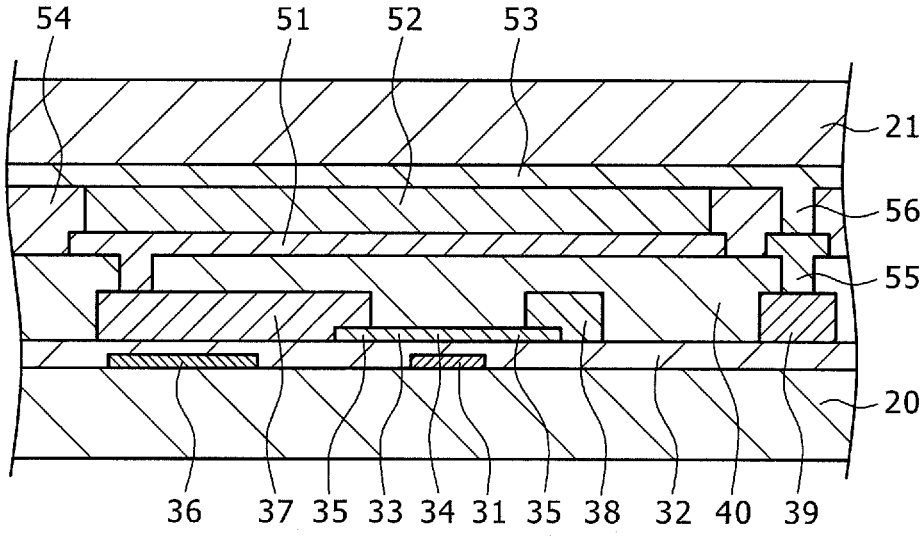
FIG. 22 is a schematic partial sectional view of part of an organic electroluminescence element.

More particularly, as shown in a schematic partial sectional view of part in FIG. 22, the transistors $T_{Sig}$ and $T_{Drv}$ and the capacitor section $C_1$ which compose the driving circuit are connected to a substrate, and the light emitting section ELP is formed above the transistors $T_{Sig}$ and $T_{Drv}$ and the capacitor section $C_1$, which compose the driving circuit, for example, with an interlayer insulating layer 40 interposed therebetween. Further, the driving transistor $T_{Drv}$ is connected at the other one of the source/drain regions thereof to the anode electrode provided for the light emitting section ELP through a contact hole. It is to be noted that, in FIG. 22, only the driving transistor $T_{Drv}$ is shown. The image signal writing transistor $T_{Sig}$ and the other transistors are hidden and cannot be observed.

More particularly, the driving transistor $T_{Drv}$ is formed from a gate electrode 31, a gate insulating layer 32, source/drain regions 35 provided in a semiconductor layer 33, and a channel formation region 34 which corresponds to a portion of the semiconductor layer 33 between the source/drain regions 35. Meanwhile, the capacitor section $C_1$ is formed from the other electrode 36, a dielectric layer formed from an extension of the gate insulating layer 32 and the one electrode 37 (which corresponds to the second node $ND_2$). The gate electrode 31, part of the gate insulating layer 32 and the electrode 36 which composes the capacitor section $C_1$ are formed on a substrate 20. The driving transistor $T_{Drv}$ is connected at the one of the source/drain regions 35 to a wiring line 38 and at the other one of the source/drain regions 35 to the one electrode 37 (which corresponds to the second node $ND_2$). The driving transistor $T_{Drv}$, capacitor section $C_1$ and so forth are covered with the interlayer insulating layer 40, and the light emitting section ELP formed from an anode electrode 51, the hole transport layer, the light emitting layer, the electron transport layer and a cathode electrode 53 is provided on the interlayer insulating layer 40. It is to be noted that, in the drawings, the hole transport layer, light emitting layer and electron transport layer are represented by one layer 52. A second interlayer insulating layer 54 is provided at a portion of the interlayer insulating layer 40 at which the light emitting section ELP is not provided, and a transparent substrate 21 is disposed on the second interlayer insulating layer 54 and the cathode electrode 53 such that light emitted from the light emitting layer passes through the substrate 21 and goes out to the outside. It is to be noted that the one electrode 37 (second node $ND_2$) and the anode electrode 51 are connected to each other through a contact hole formed in the interlayer insulating layer 40. Further, the cathode electrode 53 is connected to a wiring line 39 provided on the extension of the gate insulating layer 32 through contact holes 56 and 55 formed in the interlayer insulating layer 40.

The organic EL display apparatus is formed from pixels arrayed in an (N/3)×M two-dimensional matrix. And, the organic EL elements 10 which form the pixels are line-sequentially driven, and the display frame rate is FR (times/second). In particular, the organic EL elements which form the N/3 pixels (N sub pixels) arrayed in the mth row (where m=1, 2, 3, . . . , M) are driven simultaneously. In other words, in the organic EL elements 10 which form one row, the light emission/no-light emission timings are controlled in a unit of a row to which the organic EL elements 10 belong. It is to be noted that the process of writing an image signal into the pixels which form one row may be a process of writing an image signal simultaneously into all of the pixels (the process is hereinafter referred to sometimes merely as simultaneous writing process) or may be a process of writing an image signal successively for each of the pixels (the process is hereinafter referred to sometimes merely as successive writing process). Which one of the writing processes should be used may be selected suitably in response to the configuration of the driving circuit.

Here, driving and operation relating to an organic EL element 10 which forms one sub pixel in the pixel which is positioned in the mth row and the nth column (where n=1, 2, 3, . . . , N) is described in principle, and such a subpixel or an organic EL element 10 is hereinafter referred to as (n, m)th sub pixel or (n, m)th organic EL element 10. And, before a horizontal scanning period of the organic EL elements 10 arrayed in the mth row (mth horizontal scanning period) ends, various processes (threshold voltage cancellation process, writing process and mobility correction process hereinafter described) are carried out. It is to be noted that, although the writing process and the mobility correction process are carried out within the mth horizontal scanning period, according to circumstances, they are sometimes carried out over the (m−m")th horizontal scanning period to the mth horizontal scanning period. On the other hand, depending upon the type of the driving circuit, the threshold voltage cancellation process and an associated pre-process can be carried out prior to the mth horizontal scanning period.

Then, after all of the various processes described above end, the light emitting sections which compose the organic EL elements 10 arrayed in the mth row are driven to emit light. It is to be noted that the light emitting sections may be driven to emit light immediately after all of the processes described above end, or the light emitting sections may be driven to emit light after a predetermined period (for example, a predetermined horizontal scanning period for a predetermined number of rows). The predetermined period mentioned can be set suitably depending upon the specifications of the organic EL display apparatus, the configuration of the driving circuit and so forth. It is to be noted that, for the convenience of description, it is assumed in the following description that the light emitting section is driven to emit light immediately after the various processes end. And, emission of light of the light emitting sections which form the organic EL elements 10 arrayed in the mth row is continued till a point of time immediately before starting of a horizontal scanning period of the organic EL elements 10 arrayed in the (m+m')th row. Here, "m'" depends upon the design specifications of the organic EL display apparatus. In particular, emission of light of the light emitting section which composes the organic EL elements 10 arrayed in the mth row of a certain display frame is continued till the (m+m'−1)th horizontal scanning period. Meanwhile, the light emitting section which composes the organic EL elements 10 arrayed in the mth row maintains a no-light emitting state after the start of the (m+m')th horizontal scanning period until the writing process and the mobility correction process are completed within the mth horizontal scanning period in a next display frame. By the provision of the period of the no-light emission state described hereinabove (the period is hereinafter referred to sometimes simply as no-light emitting period), after-image blurring caused by active matrix driving is reduced, and the dynamic picture quality can be made more superior. However, the light emission/no-light emission states of each sub pixel (organic EL element 10) are not limited to the states described above. Further, the time length of the horizontal scanning period is time length shorter than (1/FR)×(1/M). Where the value of (m+m') exceeds M, the exceeding portion of the horizontal scanning period is processed in a next display frame.

The term "one of the source/drain regions" in regard to two source/drain regions which one transistor has is sometimes used to signify one of the source/drain regions on the side connected to a power supply section. Meanwhile, that a transistor is in an on state signifies a state wherein a channel is formed between the source/drain regions. It does not matter whether or not current flows from one of the source/drain regions to the other one of the source/drain regions of the transistor. On the other hand, that the source/drain regions of a certain transistor are connected to the source/drain regions of another transistor includes a form wherein the source/drain regions of the certain transistor and the source/drain regions of the other transistor occupy the same region. Further, the source/drain regions not only can be formed from a conductive material such as polycrystalline silicon or amorphous silicon containing impurities but also can be formed from a layer formed from a metal, an alloy, conductive particles, a laminate structure of them, or an organic material (conductive high molecules). Further, in timing charts used in the following description, the length (time length) of the axis of abscissa indicating various periods is a schematic one, and a ratio in time length between periods is not indicated.

In the following, a driving method for the light emitting section ELP which uses a 5Tr/1C driving circuit, a 4Tr/1C driving circuit, a 3Tr/1C driving circuit and a 2Tr/1C driving circuit is described based on embodiments.

Embodiment 1

The embodiment 1 relates to a driving method for an organic electroluminescence light emitting section of the present invention. In the embodiment 1, the driving circuit is formed from a 5Tr/1C driving circuit.

Figure 3:
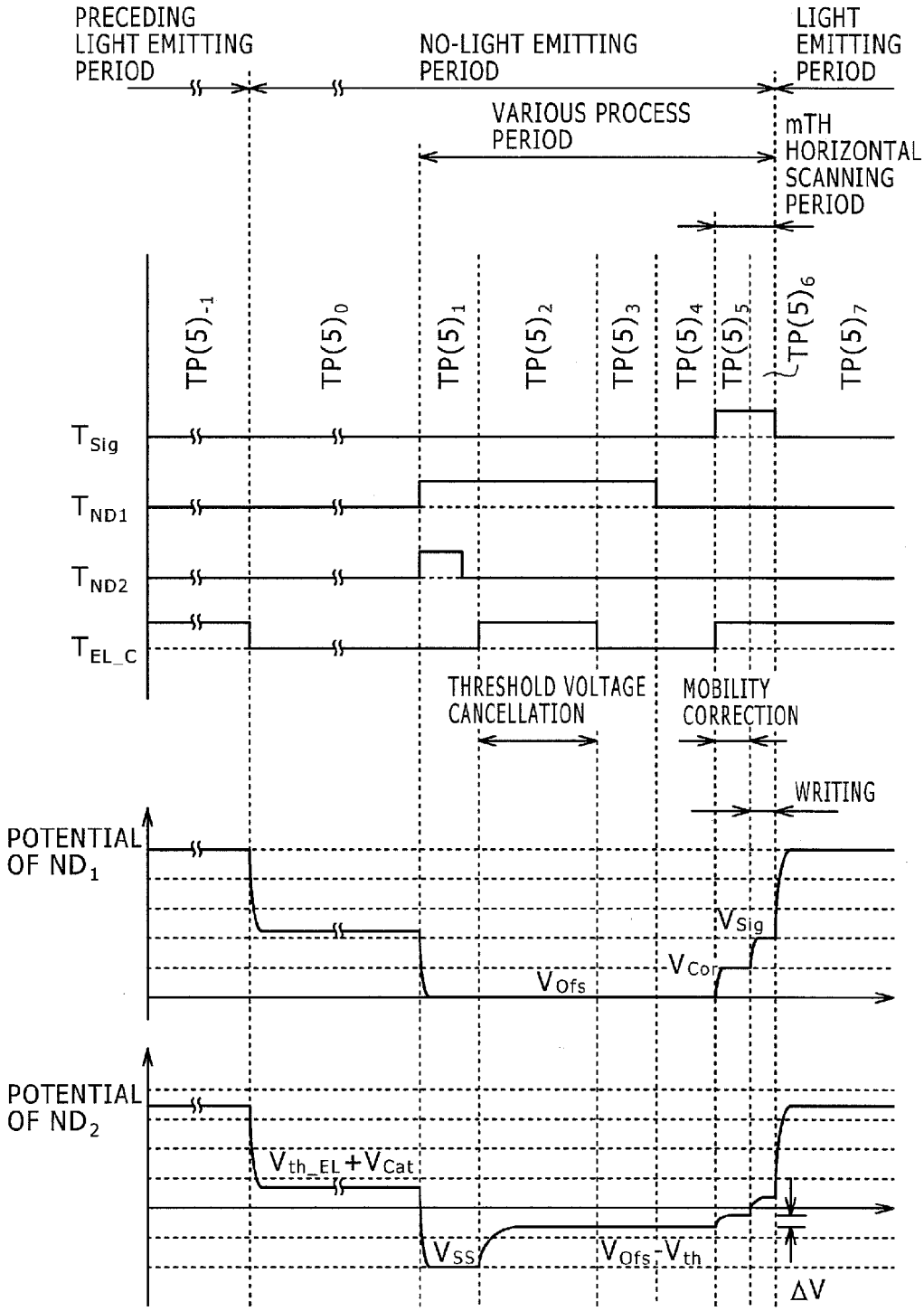
FIG. 3 is a view schematically showing a timing chart of driving of the driving circuit of the embodiment 1 basically formed from the 5-transistor/1-capacitor section.

An equivalent circuit diagram of the 5Tr/1C driving circuit is shown in FIG. 1; a conceptual view is shown in FIG. 2; a timing chart of driving is schematically shown in FIG. 3; and on/off states and so forth of the transistors are schematically shown in (A) to (D) of FIG. 5 and (A) to (E) of FIG. 6. Further, an example of a figure wherein part of the timing chart of driving shown in FIG. 3 ([period TP $(\mathbf{5})_5$] and [period TP $(\mathbf{5})_6$]) is enlarged is shown in (A) and (B) of FIG. 4.

This 5Tr/1C driving circuit includes five transistors including a image signal writing transistor $T_{Sig}$, a driving transistor $T_{Drv}$, a light emission controlling transistor $T_{EL_C}$, a first node initializing transistor $T_{ND1}$ and a second node initializing transistor $T_{ND2}$ and further includes one capacitor section $C_1$.

[Light Emission Controlling Transistor $T_{EL_C}$]

The light emission controlling transistor $T_{EL_C}$ is connected at one of the source/drain regions thereof to the current supplying section 100 (voltage $V_{CC}$) and at the other one of the source/drain regions thereof to one of the source/drain regions of the driving transistor $T_{Drv}$. Meanwhile, on/off operation of the light emission controlling transistor $T_{EL_C}$ is controlled by a light emission controlling transistor control line $CL_{EL_C}$ connected to the gate electrode of the light emission controlling transistor $T_{EL_C}$. It is to be noted that the current supplying section 100 is provided in order to supply current to the light emitting section ELP of the organic EL element 10 to control light emission of the light emitting section ELP. Further, the light emission controlling transistor control line $CL_{EL_C}$ is connected to a light emission controlling transistor control circuit 103.

[Driving Transistor $T_{Drv}$]

The driving transistor $T_{Drv}$ is connected at the one of the source/drain regions thereof to the other one of the source/drain regions of the light emission controlling transistor $T_{EL_C}$ as described hereinabove. In particular, the driving transistor $T_{Drv}$ is connected at the one of the source/drain regions thereof to the current supplying section 100 through the light emission controlling transistor $T_{EL_C}$. Meanwhile, the driving transistor $T_{Drv}$ is connected at the other of the source/drain regions thereof to

[1] the anode electrode of the light emitting section ELP,

[2] the other one of the source/drain regions of the second node initializing transistor $T_{ND2}$, and

[3] one of the electrodes of the capacitor section $C_1$ and forms the second node $ND_2$. Further, the driving transistor $T_{Drv}$ is connected at the gate thereof to [1] the other one of the source/drain regions of the image signal writing transistor $T_{Sig}$, [2] the other one of the source/drain regions of the first node initializing transistor $T_{ND1}$, and

[3] the other electrode of the capacitor section $C_1$ and forms the first node $ND_1$.

Here, in the light emitting state of the organic EL element 10, the driving transistor $T_{Drv}$ is driven to supply drain current $I_{ds}$ in accordance with the expression (1) given below. In the light emitting state of the organic EL element 10, the one of the source/drain regions of the driving transistor $T_{Drv}$ acts as a drain region and the other one of the source/drain regions acts as a source region. For the convenience of description, in the following description, the one of the source/drain regions of the driving transistor $T_{Drv}$ is sometimes referred to simply as drain region, and the other of the source/drain regions is sometimes referred to merely as source region. It is to be noted that μ: effective mobility L: channel length W: channel width $V_{gs}$: potential difference between the gate electrode and the source region $V_{th}$: threshold voltage $C_{ox}$: (relative electric constant of the gate insulating layer)×(dielectric constant of vacuum)/(thickness of the gate insulating layer)

$$k=(1/2)\cdot(W/L)\cdot C_{ox}$$

$$I_{ds}=k\cdot\mu\cdot(V_{gs}-V_{th})^2 \quad (1)$$

Since this drain current $I_{ds}$ flows to the light emitting section ELP of the organic EL element 10, the light emitting section ELP of the organic EL element 10 emits light. Further, the light emitting state (luminance) of the light emitting section ELP of the organic EL element 10 is controlled by the magnitude of the value of the drain current $I_{ds}$.

[Image Signal Writing Transistor $T_{Sig}$]

The image signal writing transistor $T_{Sig}$ is connected at the other one of the source/drain regions thereof to the gate electrode of the driving transistor $T_{Drv}$ as described above. Meanwhile, the image signal writing transistor $T_{Sig}$ is connected at the one of the source/drain regions thereof to a data line DTL. And, an image signal (driving signal, luminance signal) $V_{Sig}$ for controlling the luminance of the light emitting section ELP, and a variable correction voltage $V_{Cor}$, is connected to the one of the source/drain regions of the image signal writing transistor $T_{Sig}$ through a data line DTL from the image signal outputting circuit 102. It is to be noted that various signals and voltages (a signal for precharge driving, various reference potentials and so forth) other than $V_{Sig}$ and the correction voltage $V_{Cor}$ may be supplied to the one of the source/drain regions through the data line DTL. Further, the on/off operation of the image signal $V_{Sig}$ is controlled through the scanning line SCL connected to the gate electrode of the image signal writing transistor $T_{Sig}$.

[First Node Initializing Transistor $T_{ND1}$]

The first node initializing transistor $T_{ND1}$ is connected at the other one of the source/drain regions thereof to the gate electrode of the driving transistor $T_{Drv}$ as described above. Meanwhile, a voltage $V_{Ofs}$ for initializing the potential of the first node $ND_1$ (that is, the potential of the gate electrode of the driving transistor $T_{Drv}$) is supplied to the one of the source/drain regions of the first node initializing transistor $T_{ND1}$. Further, the on/off operation of the first node initializing transistor $T_{ND1}$ is controlled through a first node initializing transistor control line $AZ_{ND1}$ connected to the gate electrode of the first node initializing transistor $T_{ND1}$. The first node initializing transistor control line $AZ_{ND1}$ is connected to a first node initializing transistor control circuit 104.

[Second Node Initializing Transistor $T_{ND2}$]

The second node initializing transistor $T_{ND2}$ is connected at the other one of the source/drain regions thereof to the source electrode of the driving transistor $T_{Drv}$ as described above. Meanwhile, a voltage $V_{SS}$ for initializing the potential of the second node $ND_2$ (that is, the potential of the source region of the driving transistor $T_{Drv}$) is supplied to the one of the source/drain regions of the second node initializing transistor $T_{ND2}$. Further, the on/off operation of the second node initializing transistor $T_{ND2}$ is controlled through a second node initializing transistor control line $AZ_{ND2}$ connected to the gate electrode of the second node initializing transistor $T_{ND2}$. The second node initializing transistor control line $AZ_{ND2}$ is connected to a second node initializing transistor control circuit 105.

[Light Emitting Section ELP]

The light emitting section ELP is connected at the anode electrode thereof to the source region of the driving transistor $T_{Drv}$ as described above. Meanwhile, a voltage $V_{Cat}$ is applied to the cathode electrode of the light emitting section ELP. The parasitic capacitance of the light emitting section ELP is represented by reference character $C_{EL}$. Further, the threshold voltage required for emission of light of the light emitting section ELP is represented by $V_{th-EL}$. In particular, if a voltage higher than $V_{th-EL}$ is applied between the anode electrode and the cathode electrode of the light emitting section ELP, then the light emitting section ELP emits light.

In the following description, the values of voltages or potentials are such as given below. However, they are values for description to the upmost and are not limited to the specific values.

$V_{Sig}$: image signal for controlling the luminance of the light emitting section ELP . . . 0 volts to 14 volts Maximum value $V_{Sig-Max}$ of the image signal=14 volts Minimum value $V_{Sig-Max}$ of the image signal=0 volts $V_{CC}$: voltage of the current supplying section for controlling emission of light of the light emitting section ELP . . . 20 volts $V_{Ofs}$: voltage for initializing the potential of the gate voltage of the driving transistor $T_{Drv}$ (potential of the first node $ND_1$).

. . . 0 volts $V_{SS}$: voltage for initializing the potential of the source region of the driving transistor $T_{Drv}$ (potential of the second node $ND_2$)

. . . −10 volts $V_{th}$: threshold voltage of the driving transistor $T_{Drv}$

. . . 3 volts $V_{Cat}$: voltage applied to the cathode electrode of the light emitting section ELP . . . 0 volts $V_{th-EL}$: threshold voltage of the light emitting section ELP . . . 3 volts In the following, operation of the 5Tr/1C driving circuit is described. It is to be noted that, while it is described that the light emitting state starts immediately after the various processes (threshold voltage cancellation process, writing process and mobility correction process) are completed as described above, the starting of the light emitting state is not limited to this. This similarly applies also to description of the embodiments 2 to 4 (4Tr/1C driving circuit, 3Tr/1C driving circuit and 2Tr/1C driving circuit) hereinafter described.

[Period TP $(\mathbf{5})_{-1}$] (Refer to (A) of FIG. 5)

This [Period TP $(\mathbf{5})_{-1}$] relates to operation, for example, for a preceding display frame and is a period within which the (n, m)th organic EL element 10 remains in a light emitting state after completion of the various processes in the preceding operation cycle. In particular, drain current $I'_{ds}$ based on the expression (5) hereinafter given flows to the light emitting section ELP of the organic EL element 10 which forms the (n, m)th sub pixel, and the luminance of the organic EL element 10 which forms the (n, m)th sub pixel has a value corresponding to such drain current I'ds. Here, the image signal writing transistor $T_{Sig}$, first node initializing transistor $T_{ND1}$ and second node initializing transistor $T_{ND2}$ are in an off state, and the light emission controlling transistor $T_{EL_C}$ and the driving transistor $T_{Drv}$ are in an on state. The light emitting state of the (n, m)th organic EL element is continued till a point of time immediately before a horizontal scanning period of the organic EL elements 10 arrayed in the (m+m')th row.

The [period TP $(\mathbf{5})_0$] to [period TP $(\mathbf{5})_4$] illustrated in FIG. 3 are an operation period after the light emitting state after completion of the various processes in the preceding operation cycle ends till a point of time immediately before a next writing process is carried out. In particular, the [period TP $(\mathbf{5})_0$] to [period TP $(\mathbf{5})_4$] are a period of a certain time length from a start timing of the (m+m')th horizontal scanning period in a preceding display frame till an end timing of the (m−1)th horizontal scanning period in the current display frame. It is to be noted that the [period TP $(\mathbf{5})_1$] to the [period TP $(\mathbf{5})_4$] can be configured so as to be included in the mth horizontal scanning period in the current display frame.

And within the [period TP $(\mathbf{5})_0$] to the [period TP $(\mathbf{5})_4$], the (n, m)th organic EL element 10 is in a no-light emitting state. In particular, within the [period TP $(\mathbf{5})_0$] to [period TP $(\mathbf{5})_1$] and the [period TP $(\mathbf{5})_3$] to [period TP $(\mathbf{5})_4$], the light emission controlling transistor $T_{EL_C}$ is in an off state, and therefore, the organic EL element 10 does not emit light. It is to be noted that, within the [period TP $(\mathbf{5})_2$], the light emission controlling transistor $T_{EL_C}$ becomes an on state. However, within this period, the threshold voltage cancellation process hereinafter described is carried out. While detailed description is given in the description of the threshold voltage cancellation process, if it is presupposed that the expression (2) hereinafter given is satisfied, then the organic EL element 10 does not emit light.

In the following, the periods from the [period TP $(\mathbf{5})_0$] to [period TP $(\mathbf{5})_4$] are described first. It is to be noted that the start timing of the [period TP $(\mathbf{5})_1$] and the length of each of the periods of the [period TP $(\mathbf{5})_1$] to [period TP $(\mathbf{5})_4$] may be set suitably in accordance with the design of the organic EL display apparatus.

[Period TP $(\mathbf{5})_0$]

As described hereinabove, within this [period TP $(\mathbf{5})_0$], the (n, m)th organic EL element 10 is in a no-light emitting state. The image signal writing transistor $T_{Si}$, first node initializing transistor $T_{ND1}$ and second node initializing transistor $T_{ND2}$ are in an off state. Further, at a point of time of transition from the [period TP $(\mathbf{5})_{-1}$] to the [period TP $(\mathbf{5})_0$], the light emission controlling transistor $T_{EL_C}$ is placed into an off state. Therefore, the potential of the second node $ND_2$ (source region of the driving transistor $T_{Drv}$ or anode electrode of the light emitting section ELP) drops to $(V_{th-EL}-V_{Cor})$, and the light emitting section ELP enters a no-light emitting state. Further, also the potential of the first node $ND_1$ in the floating state (gate electrode of the driving transistor $T_{Drv}$) drops in such a manner as to follow up the potential drop of the second node $ND_2$.

[Period TP $(\mathbf{5})_1$] (Refer to (B) and (C) of FIG. 5)

Within this [Period TP $(\mathbf{5})_1$], a pre-process for carrying out the threshold voltage cancellation process hereinafter described is carried out. In particular, a first node initialization voltage is applied to the first node $ND_1$ such that the potential difference between the first node $ND_1$ and the second node $ND_2$ exceeds the threshold voltage $V_{th}$ of the driving transistor $T_{Drv}$ and the potential difference between the cathode electrode of the light emitting section ELP and the second node does not exceed the threshold voltage $V_{th-EL}$ of the light emitting section ELP, and besides a second node initialization voltage is applied to the second node $ND_2$. In particular, upon starting of the [period TP $(\mathbf{5})_1$], the first node initializing transistor control line $AZ_{ND1}$ and the second node initializing transistor control line $AZ_{ND2}$ are set to the high level based on operation of the first node initializing transistor control circuit 104 and the second node initializing transistor control circuit 105 to place the first node initializing transistor $T_{ND1}$ and the second node initializing transistor $T_{ND2}$ into an on state. As a result, the potential of the first node $ND_1$ becomes $V_{Ofs}$ (for example, 0 volts). Meanwhile, the potential of the second node $ND_2$ becomes $V_{SS}$(for example, −10 volts). Then, before completion of the [period TP $(\mathbf{5})_1$], the second node initializing transistor control line $AZ_{ND2}$ is set to the low level based on operation of the second node initializing transistor control circuit 105 to place the second node initializing transistor $T_{ND2}$ into an off state. It is to be noted that the first node initializing transistor $T_{ND1}$ and the second node initializing transistor $T_{ND2}$ may be placed into an on state at the same time, or the first node initializing transistor $T_{ND1}$ may be placed into an on state first.

By the process described above, the potential difference between the gate electrode and the source region of the driving transistor $T_{Drv}$ becomes higher than $V_{th}$, and the driving transistor $T_{Drv}$ is placed into an on state.

[Period TP $(5)_2$] (Refer to (D) of FIG. 5)

Then, in a state wherein the potential of the first node $ND_1$ is maintained, more particularly by applying a voltage exceeding the sum potential of the threshold voltage $V_{th}$ of the driving transistor $T_{Drv}$ and the potential of the second node $ND_2$ within the [period TP $(5)_1$] to the one of the source/drain regions (drain region) of the driving transistor $T_{Drv}$ from the current supplying section 100, a threshold voltage cancellation process of varying the potential difference between the first node $ND_1$ and the second node $ND_2$ toward the threshold voltage $V_{th}$ of the driving transistor $T_{Drv}$ (in particular, of raising the potential of the second node $ND_2$) is carried out. More particularly, while the on state of the first node initializing transistor $T_{ND1}$ is maintained, the light emission controlling transistor control line $CL_{EL_C}$ is set to the high level based on the operation of the light emission controlling transistor control circuit 103 to place the light emission controlling transistor $T_{EL_C}$ into an on state. As a result, although the potential of the first node $ND_1$ does not vary ($V_{Ofs}$=0 volts is maintained), the potential of the second node $ND_2$ varies toward the difference potential of the threshold voltage $V_{th}$ of the driving transistor $T_{Drv}$ from the potential of the first node $ND_1$. In particular, the potential of the second node $ND_2$ in the floating state rises. Then, when the potential difference between the gate electrode and the source region of the driving transistor $T_{Drv}$ reaches $V_{th}$, the driving transistor $T_{Drv}$ is placed into an off state. More particularly, the potential of the second node $ND_2$ in the floating state approaches ($V_{Ofs}-V_{th}$=−3 volts>$V_{SS}$) and finally becomes ($V_{Ofs}-V_{th}$). Here, if the expression (2) given below is assured, or in other words, if the potential is selected and determined so as to satisfy the expression (2), then the light emitting section ELP does not emit light at all. It is to be noted that, qualitatively, the degree by which the potential difference between the first node $ND_1$ and the second node $ND_2$ (in other words, the potential difference between the gate electrode and the source region of the driving transistor $T_{Drv}$) approaches the threshold voltage $V_{th}$ of the driving transistor $T_{Drv}$ in the threshold voltage cancellation process depends upon the time for the threshold voltage cancellation process. Accordingly, for example, if the time for the threshold voltage cancellation process is assured sufficiently long, then the potential difference between the first node $ND_1$ and the second node $ND_2$ reaches the threshold voltage $V_{th}$ and the driving transistor $T_{Drv}$ is placed into an off state. On the other hand, for example, if the time for the threshold voltage cancellation process is set short, then the potential difference between the first node $ND_1$ and the second node $ND_2$ is greater than the threshold voltage $V_{th}$ of the driving transistor $T_{Drv}$, and the driving transistor $T_{Drv}$ does not sometimes enter an off state. In other words, as a result of the threshold voltage cancellation process, it is not necessarily required that the driving transistor $T_{Drv}$ enters an off state.

$$(V_{Ofs}-V_{th})<(V_{th\text{-}EL}+V_{Cat}) \quad (2)$$

Within this [period TP $(5)_2$], the potential of the second node $ND_2$ finally becomes, for example, ($V_{Ofs}-V_{th}$) In particular, the potential of the second node $ND_2$ relies only upon the threshold voltage $V_{th}$ of the driving transistor $T_{Drv}$ and the voltage $V_{Ofs}$ for initializing the gate electrode of the driving transistor $T_{Drv}$. In other words, the potential of the second node $ND_2$ does not rely upon the threshold voltage $V_{th\text{-}EL}$ of the light emitting section ELP.

[Period TP $(5)_3$] (Refer to (A) of FIG. 6)

Thereafter, while the on state of the first node initializing transistor $T_{ND1}$ is maintained, the light emission controlling transistor control line $CL_{EL_C}$ is placed to the low level state based on the operation of the light emission controlling transistor control circuit 103 to place the light emission controlling transistor $T_{EL_C}$ into an off state. As a result, the potential of the first node $ND_1$ does not vary ($V_{Ofs}$=0 volts is maintained), and the potential of the second node $ND_2$ in the floating state does not vary either but ($V_{Ofs}-V_{th}$=−3 volts) is maintained.

[Period TP $(5)_4$] (Refer to (B) of FIG. 6)

Then, the first node initializing transistor control line $AZ_{ND1}$ is set to the low level based on operation of the first node initializing transistor control circuit 104 to place the first node initializing transistor $T_{ND1}$ into an off state. The potential of the first node $ND_1$ and the second node $ND_2$ does not vary (actually, potential differences can possibly be caused by an electrostatic coupling of the parasitic capacitance or the like, but usually they can be ignored).

Now, the periods from the [period TP $(5)_5$] to the [period TP $(5)_7$] are described. It is to be noted that, as hereinafter described, within the [period TP $(5)_5$], a mobility correction process is carried out, and within the [period TP $(5)_6$], a writing process is carried out. As described above, the processes mentioned may be carried out within the mth horizontal scanning period. However, as occasion demands, the processes may be carried out over a plurality of horizontal scanning periods. This similarly applies also to the embodiments 2 to 4 hereinafter described. However, in the embodiment 1, it is assumed for the convenience of description that the start timing of the [period TP $(5)_5$] and the end timing of the [period TP $(5)_6$] coincide with the start timing and the end timing of the mth horizontal scanning period, respectively.

Generally, where the driving transistor $T_{Drv}$ is formed from a polycrystalline silicon thin film transistor or the like, it cannot be avoided that a dispersion appears in the mobility μ between transistors. Accordingly, even if the image signal $V_{Sig}$ of an equal value is applied to the gate electrodes of a plurality of driving transistors $T_{Drv}$ having a difference in the mobility μ therebetween, a difference appears between the drain current $I_{ds}$ flowing to the driving transistor $T_{Drv}$ having a higher mobility μ and the drain current $I_{ds}$ flowing to the driving transistor $T_{Drv}$ having a lower mobility μ. If such a difference appears, then the uniformity of the screen image of the organic EL display apparatus is damaged.

[Period TP $(5)_6$] (Refer to (C) of FIG. 6)

Accordingly, correction (mobility correction process) of the potential of the source region (second node $ND_2$) of the driving transistor $T_{Drv}$ based on the magnitude of the mobility μ of the driving transistor $T_{Drv}$ is carried out thereafter. In particular, the variable correction voltage $V_{Cor}$ is applied from the data line DTL to the first node $ND_1$ through the image signal writing transistor $T_{Sig}$ which has been placed into an on state by the signal from the scanning line SCL and a voltage higher than the potential of the second node $ND_2$ within the [period TP $(5)_2$] is applied from the current supplying section 100 to the one of the source/drain regions (drain region) of the driving transistor $T_{Drv}$ to carry out a mobility correction process of raising the potential of the second node $ND_2$ in response to the characteristic of the driving transistor $T_{Drv}$.

In particular, while the off state of the first node initializing transistor $T_{ND1}$, second node initializing transistor $T_{ND2}$ and light emission controlling transistor $T_{EL_C}$ is maintained, the potential of the data line DTL is set to the correction voltage $V_{Cor}$ based on operation of the image signal outputting circuit 102. Then, the scanning line SCL is set to the high level based on operation of the scanning circuit 101 to place the image signal writing transistor $T_{Sig}$ into an on state. Simultaneously, the light emission controlling transistor control line $CL_{EL_C}$ is place into a high level state based on operation of the light emission controlling transistor control circuit 103 to place the light emission controlling transistor $T_{EL_C}$ into an on state. As a result, the potential of the first node $ND_1$ (potential of the gate electrode of the driving transistor $T_{Drv}$) rises to the correction voltage $V_{Cor}$ while the potential of the one of the source/drain regions (drain region) of the driving transistor $T_{Drv}$ rises toward $V_{CC}$.

Here, the value of the correction voltage $V_{Cor}$ depends upon the image signal $V_{Sig}$ applied to the first node $ND_1$ from the data line DTL within the next [period TP $(\mathbf{5})_6$] and is lower than the image signal $V_{Sig}$. It is to be noted that the relationship between the correction voltage $V_{Cor}$ and the image signal $V_{Sig}$ is hereinafter described.

As a result of the foregoing, if the value of the mobility μ of the driving transistor $T_{Drv}$ is high, then the rise amount $\Delta V_{Cor}$ (potential correction value) of the potential at the source region of the driving transistor $T_{Drv}$ is great, but where the value of the mobility μ is low, the rise amount $\Delta V_{Cor}$ (potential correction value) of the potential at the source region of the driving transistor $T_{Drv}$ is small. Further, where the luminance of the organic EL element is to be raised, the value of the image signal $V_{Sig}$ is set high and high current flows to the driving transistor $T_{Drv}$, but where the luminance is to be lowered, the value of the image signal $V_{Sig}$ is set low and low current flows to the driving transistor $T_{Drv}$. Here, if a case wherein the value of the mobility μ of the driving transistor $T_{Drv}$ is equal in the organic EL elements is considered, the value of the correction voltage $V_{Cor}$ in the mobility correction process depends upon the image signal $V_{Sig}$ and is lower than the image signal $V_{Sig}$. Accordingly, even if the mobility correction processing time $t_{Cor}$ is fixed, the rise amount $\Delta V_{Cor}$ (potential correction amount) of the potential in the source region of the driving transistor $T_{Drv}$ in the organic EL display elements can be suppressed from being displaced from a desired value. Here, the potential difference between the first node $ND_1$ and the second node $ND_2$, that is, the potential difference $V_{gs}$ between the gate electrode and the source region of the driving transistor $T_{Drv}$, can be represented by the following expression (3).

$$V_g = V_{Cor}$$

$$V_s \approx V_{Ofs} - V_{th} + \Delta V_{Cor}$$

$$V_{gs} \approx V_{Cor} - [(V_{Ofs} - V_{th}) + \Delta V_{Cor}] \quad (3)$$

It is to be noted that the predetermined time for executing the mobility correction process (total time ($t_{Cor}$) within the [period TP $(\mathbf{5})_5$]) should be determined in advance as a design value upon designing of the organic EL display apparatus. Further, the total time $t_{Cor}$ within the [period TP $(\mathbf{5})_5$] is determined such that the potential $(V_{Ofs} - V_{th} + \Delta V_{Cor})$ in the source region of the driving transistor $T_{Drv}$ at this time may satisfy the expression (2') given below is satisfied. And, by this, the light emitting section ELP does not emit light within the [period TP $(\mathbf{5})_5$]. Further, also correction of the dispersion of the coefficient k $(\equiv(1/2)\cdot(W/L)\cdot C_{ox})$ is carried out simultaneously by the mobility correction process.

$$(V_{Ofs} - V_{th} + \Delta V_{Cor}) < (V_{th\text{-}EL} + V_{Cat}) \quad (2')$$

[Period TP $(\mathbf{5})_6$] (Refer to (D) of FIG. 6)

Thereafter, a writing process of applying an image signal $V_{Sig}$ [image signal $V_{Sig}$ (driving signal, luminance signal) for controlling the luminance of the light emitting section ELP] from the data line DTL to the first node $ND_1$ through the image signal writing transistor $T_{Sig}$ which has been placed into an on state with a signal from the scanning line SCL is carried out. In particular, while the off state of the first node initializing transistor $T_{ND1}$ and the second node initializing transistor $T_{ND2}$ is maintained and the on state of the image signal writing transistor $T_{Sig}$ and the light emission controlling transistor $T_{EL_C}$ is maintained, the potential of the data line DTL is set to the image signal $V_{Sig}$ for controlling the luminance of the light emitting section ELP from the correction voltage $V_{Cor}$ based on operation of the image signal outputting circuit 102. As a result, the potential of the first node $ND_1$ rises to $V_{Sig}$. Also the potential of the second node $ND_2$ rises following up the rise of the potential of the first node $ND_1$. The rise amount of the potential of the second node $ND_2$ from $\Delta V_{Cor}$ is represented by $\Delta V_{Sig}$. As a result of the foregoing, the potential difference between the first node $ND_1$ and the second node $ND_2$, that is, the potential difference $V_{gs}$ between the gate electrode and the source electrode of the driving transistor $T_{Drv}$, is transformed from the expression (3) into the expression (4) given below. The time for the writing process (writing processing time) is $T_{Sig}$.

$$V_g = V_{Sig}$$

$$V_s \approx V_{Ofs} - V_{th} + \Delta V_{Cor} + \Delta V_{Sig}$$

$$V_{gs} \approx V_{Sig} - [V_{Ofs} - V_{th} + \Delta V_{Cor} + \Delta V_{Sig}) \quad (4)$$

In particular, $V_{gs}$ obtained by the writing process into the driving transistor $T_{Drv}$ relies only upon the image signal $V_{Sig}$ for controlling the luminance of the light emitting section ELP, the threshold voltage $V_{th}$ of the driving transistor $T_{Drv}$, the voltage $V_{Ofs}$ for initializing the gate electrode of the driving transistor $T_{Drv}$ and the correction voltage $V_{Cor}$. Here, $\Delta V_{Cor}$ and $\Delta V_{Sig}$ rely only upon $V_{Sig}$, $V_{th}$, $V_{Ofs}$ and $V_{Cor}$. This similarly applies also to the embodiments 2 to 4 hereinafter described. Further, they are independent of the threshold voltage $V_{th\text{-}EL}$ of the light emitting section ELP.

[Period TP $(\mathbf{5})_7$] (Refer to (E) of FIG. 6)

Since the threshold voltage cancellation process, writing process and mobility correction process are completed by the operations described above, the image signal writing transistor $T_{Sig}$ is placed into an off state with a signal from the scanning line SCL to place the first node $ND_1$ into a floating state thereby to supply current corresponding to the value of the potential difference between the first node $ND_1$ and the second node $ND_2$ from the current supplying section 100 to the light emitting section ELP through the driving transistor $T_{Drv}$ to drive the light emitting section ELP. In other words, the light emitting section ELP is caused to emit light.

In particular, after the predetermined time ($t_{Sig}$) elapses, the scanning line SCL is placed into a low level state based on operation of the scanning circuit 101 to place the image signal writing transistor $T_{Sig}$ into an off state thereby to place the first node $ND_1$ (gate electrode of the driving transistor $T_{Drv}$) into a floating state. Meanwhile, the light emission controlling transistor $T_{EL_C}$ maintains the on state, and the drain region of the light emission controlling transistor $T_{EL_C}$ is in a state wherein it is connected to the current supplying section 100 (voltage $V_{CC}$, for example, 20 volts) for controlling the emission of light of the light emitting section ELP. Accordingly, as a result of the foregoing, the potential of the second node $ND_2$ rises. Here, since the gate electrode of the driving transistor $T_{Drv}$ is in a floating state as described hereinabove and besides the capacitor section $C_1$ exists, a phenomenon similar to that which occurs with a so-called bootstrap circuit occurs with the gate electrode of the driving transistor $T_{Drv}$, and also the potential of the first node $ND_1$ rises. As a result, the potential difference $V_{gs}$ between the gate electrode and the source region of the driving transistor $T_{Drv}$ maintains the value of the expression (4). Further, since the potential of the second node $ND_2$ rises and exceeds ($V_{th\text{-}EL}+V_{Cat}$), the light emitting section ELP starts emission of light. At this time, since the current flowing to the light emitting section ELP is drain current $I_{ds}$ flowing from the drain region to the source region of the driving transistor $T_{Drv}$, it can be represented by the expression (1). Here, from the expressions (1) and (4), the expression (1) can be transformed in such a manner as given by the following expression (5).

$$I_{ds}=k\cdot\mu\cdot(V_{Sig}-V_{Ofs}-\Delta V_{Cor}-\Delta V_{Sig})^2 \quad (5)$$

Accordingly, the current $I_{ds}$ flowing through the light emitting section ELP increases in proportion to the square of a value obtained by subtracting, for example, where $V_{Ofs}$ is set to 0 volts, the value of the potential correction value $\Delta V_{Cor}$ at the second node $ND_2$ (source region of the driving transistor $T_{Drv}$) originating from the mobility μ of the driving transistor $T_{Drv}$ and $\Delta V_{Sig}$ which relies upon the value of the image signal $V_{Sig}$ from the value of the image signal $V_{Sig}$ for controlling the luminance of the light emitting section ELP. In other words, the drain current $I_{ds}$ flowing through the light emitting section ELP does not rely upon any of the threshold voltage $V_{th\text{-}EL}$ of the light emitting section ELP and the threshold voltage $V_{th}$ of the driving transistor $T_{Drv}$. In other words, the light emission amount (luminance) of the light emitting section ELP is not influenced by any of the threshold voltage $V_{th\text{-}EL}$ of the light emitting section ELP and the threshold voltage $V_{th}$ of the driving transistor $T_{Drv}$. And, the luminance of the (n, m)th organic EL element 10 has a value corresponding to the drain current $I_{ds}$.

Besides, as the mobility μ of the driving transistor $T_{Drv}$ increases, the potential correction value $\Delta V_{Cor}$ increases, and therefore, the value of $V_{gs}$ on the left side of the expression (4) decreases. Accordingly, in the expression (5), even if the value of the mobility μ is high, the value of $(V_{Sig}-V_{Ofs}-\Delta V_{Cor}-\Delta V_{Sig})^2$ is low, and as a result, the drain current $I_{ds}$ can be corrected. In particular, even where the driving transistors $T_{Drv}$ have different values of the mobility μ, if the values of the image signal $V_{Sig}$ are equal to each other, then the values of drain current $I_{ds}$ are substantially equal to each other. As a result, the drain current $I_{ds}$ which flows through the light emitting sections ELP and controls the luminance of the light emitting sections ELP is uniformed. In particular, a dispersion of the luminance of the light emitting section arising from a dispersion of the mobility μ (further from a dispersion of k) can be corrected.

Further, in the mobility correction process, the correction voltage $V_{Cor}$ which depends upon the image signal $V_{Sig}$ and is lower than the image signal $V_{Sig}$ is applied to the gate electrode of the driving transistor $T_{Drv}$. Accordingly, the influence of the luminance of the image signal $V_{Sig}$ on the mobility correction process can be reduced, and the luminance of the light emitting section can be controlled to a desired luminance. As a result, improvement of the display quality of the organic EL display apparatus can be achieved.

Figure 4:
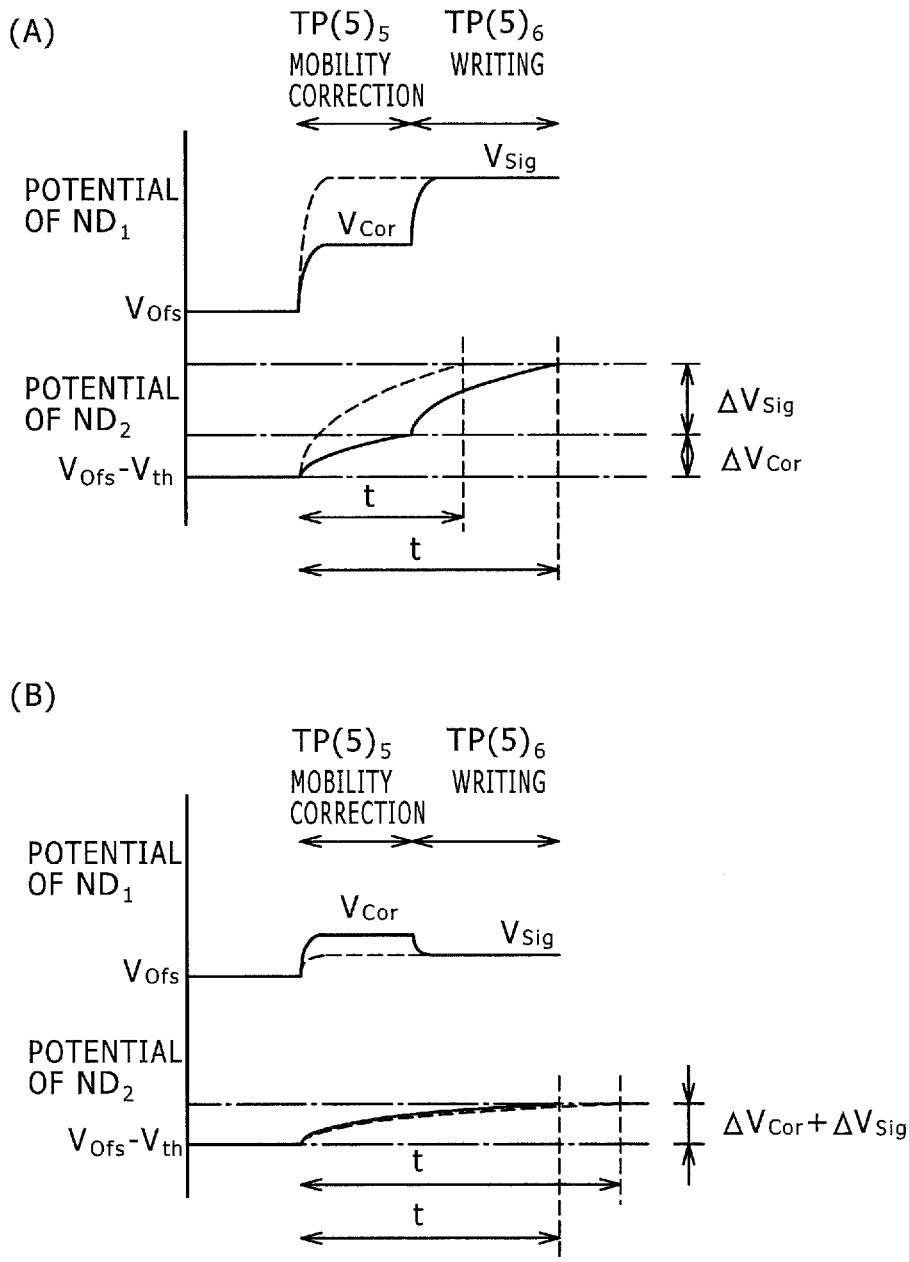
FIGS. 4 (A) and (B) are views wherein part of the timing chart of driving shown in FIG. 3 (portions of a [period TP $(\mathbf{5})_5$] and a [period TP $(\mathbf{5})_6$] is enlarged.

An example of a view where part of the timing chart of driving shown in FIG. 3 (portions represented as [period TP $(\mathbf{5})_5$] and [period TP $(\mathbf{5})_6$]) is shown in (A) and (B) of FIG. 4. Here, in the example shown in (A) and (B) of FIG. 4, potential variation of the first node $ND_1$ and the second node $ND_2$ within the [period TP $(\mathbf{5})_5$] and the [period TP $(\mathbf{5})_6$] are indicated by solid lines. Further, potential variations of the first node $ND_1$ and the second node $ND_2$ within the [period TP $(\mathbf{5})_5'$] when the prior art is applied are indicated by broken lines. Further, while the time until the value of $(\Delta V_{Cor}+\Delta V_{Sig})$ becomes a desired value is represented by t, in the example shown in (A) of FIG. 4, the value of t when the prior art is applied is shorter than the value of t in the embodiment 1. Meanwhile, in the example shown in (B) of FIG. 4, the value of t when the prior art is applied is longer than the value of t in the embodiment 1.

The light emitting state of the light emitting section ELP continues till the (m+m'−1)th horizontal scanning period. This point of time corresponds to the end of the [period TP $(\mathbf{5})_{-1}$].

By the foregoing, the light emitting operation of the organic EL element 10 [(n, m)th subpixel (organic EL element 10)] is completed.

In the following, a relationship between the correction voltage $V_{Cor}$ and the image signal $V_{Sig}$ is described.

It is assumed now that the optimum mobility correction time for gradations of white, gray and black (more accurately, including gray nearer to black) is 3, 5 and 7 microseconds. Meanwhile, the mobility correction processing time $t_{Cor}$ is assumed to be 4 microseconds, and the writing processing time $t_{Sig}$ is assumed to be 3 microseconds. And, in such time settings, an optimum correction voltage $V_{Cor}$ is examined for each gradation.

First, where the organic EL display element displays a gradation of the black for which the image signal $V_{Sig}$ is, for example, lower than 3 volts (more accurately, a gradation including gray nearer to the black. This similarly applies also to the following description), the optimum mobility correction time of the gradation of the black (for example, image signal $V_{Sig}$=3 volts) is 7 microseconds. On the other hand, since $t_{Cor}+t_{Sig}$=7 microseconds, where the gradation of the black is displayed by the organic EL element, the correction voltage $V_{Cor}$ of a very high value need not be applied. The relationship between the correction voltage $V_{Cor}$ and the image signal $V_{Sig}$ is, according to various tests, for example, such as given below.

| Image signal $V_{Sig}$ | Correction voltage $V_{Cor}$ |
|---|---|
| 0 (V) | 0 (V) |
| 3 (V) | 3 (V) |

Then, when the gradation of gray (image signal $V_{Sig}$ is, for example, 6 to 8 volts or less) is displayed by the organic EL element, the optimum mobility correction time of the gradation of the gray (for example, image signal $V_{Sig}$=8 volts) is 5 microseconds. However, since the mobility correction processing time $t_{Cor}$ is 4 microseconds, the optimum mobility correction time of the gradation of the gray (for example, image signal $V_{Sig}$=8 volts) exceeds the mobility correction processing time $t_{Cor}$. Accordingly, it is necessary to set the value of the correction voltage $V_{Cor}$ so that the optimum mobility correction time may not exceed the mobility correction processing time $t_{Cor}$. The relationship between the correction voltage $V_{Cor}$ and the image signal $V_{Sig}$ is, as a result of various tests, for example, such as given below.

| Image signal $V_{Sig}$ | Correction voltage $V_{Cor}$ |
|---|---|
| 6 (V) | 4 (V) |
| 8 (V) | 6.7 (V) |

Then, for example, when the gradation of the white (the image signal $V_{Sig}$ is, for example, lower than 14 volts) is displayed by the organic EL element, the optimum mobility correction time of the gradation of the white (for example, image signal $V_{Sig}$=14 volts) is 3 microseconds. And, since the mobility correction processing time $t_{Cor}$ is 4 microseconds, the optimum mobility correction time of the gradation of the white (for example, image signal $V_{Sig}$=14 volts) is within the range of the mobility correction processing time $t_{Cor}$. Accordingly, where the gradation of the white is displayed by the organic EL element, the correction voltage $V_{Cor}$ of a very high value need not be applied. The relationship between the correction voltage $V_{Cor}$ and the image signal $V_{Sig}$ is, as a result of various tests, for example, such as given below.

| Image signal $V_{Sig}$ | Correction voltage $V_{Cor}$ |
|---|---|
| 10 (V) | 0 (V) |
| 12 (V) | 0 (V) |
| 14 (V) | 0 (V) |

As a result of the foregoing, and further, from a test wherein a finer relationship between the correction voltage $V_{Cor}$ and the image signal $V_{Sig}$ was examined, if an optimum correction voltage $V_{Cor}$ is considered for each gradation in the timing settings described hereinabove, then the correction voltage $V_{Cor}$ was represented by a quadratic function of $V_{Sig}$ wherein the coefficient of a quadratic term is a negative value. In particular, where $a_2$, $a_1$ and $a_0$ are coefficients (however, where $a_2<0$), the correction voltage $V_{Cor}$ was able to be represented as $V_{Cor}=a_2 \cdot V_{Sig}^2+a_1 \cdot V_{Sig}+a_0$.

If the relationship between the correction voltage $V_{Cor}$ and the image signal $V_{Sig}$ is set based on a quadratic function in this manner, then by assembling a logic circuit conforming to the function in the organic EL display apparatus, the optimum correction voltage $V_{Cor}$ can be determined finely for each image signal $V_{Sig}$ and outputted to the driving circuit 11.

Alternately, it is assumed that the optimum mobility correction time for gradations of white, gray and black (more accurately, including gray nearer to black) is 3, 5 and 7 microseconds. On the other hand, different from the foregoing, the mobility correction processing time $t_{Cor}$ is set to 5.5 microseconds, and the image signal writing transistor $T_{Sig}$ is set to 1.5 microseconds. And, in such time settings, an optimum correction voltage $V_{Cor}$ is considered for each gradation.

First, where the organic EL display element displays a gradation of the black (the image signal $V_{Sig}$ is, for example, lower than 3 volts, the optimum mobility correction time of the gradation of the black (for example, image signal $V_{Sig}$=3 volts) is 7 microseconds. On the other hand, since $t_{Cor}+t_{Sig}$=7 microseconds, where the gradation of the black is displayed by the organic EL element, the correction voltage $V_{Cor}$ of a very high value need not be applied. The relationship between the correction voltage $V_{Cor}$ and the image signal $V_{Sig}$ is, according to various tests, for example, such as given below.

| Image signal $V_{Sig}$ | Correction voltage $V_{Cor}$ |
|---|---|
| 0 (V) | 0 (V) |
| 3 (V) | 3 (V) |

Then, when the gradation of gray (image signal $V_{Sig}$ is, for example, 6 to 8 volts or less) is displayed by the organic EL element, the optimum mobility correction time of the gradation of the gray (for example, image signal $V_{Sig}$=8 volts) is 5 microseconds. However, since the mobility correction processing time $t_{Cor}$ is 1.5 microseconds, the optimum mobility correction time of the gradation of the gray (for example, image signal $V_{Sig}$=6 to 8 volts) exceeds the mobility correction processing time $t_{Cor}$. Accordingly, it is necessary to set the value of the correction voltage $V_{Cor}$ so that the optimum mobility correction time may not exceed the mobility correction processing time $t_{Cor}$. The relationship between the correction voltage $V_{Cor}$ and the image signal $V_{Sig}$ is, as a result of various tests, for example, such as given below.

| Image signal $V_{Sig}$ | Correction voltage $V_{Cor}$ |
|---|---|
| 6 (V) | 6.5 (V) |
| 8 (V) | 6.5 (V) |

Then, for example, when the gradation of the white (the image signal $V_{Sig}$ is, for example, lower than 14 volts) is displayed by the organic EL element, the optimum mobility correction time of the gradation of the white (for example, image signal $V_{Sig}$=14 volts) is 3 microseconds. And, since the mobility correction processing time $t_{Cor}$ is 1.5 microseconds, the optimum mobility correction time of the gradation of the white (for example, image signal $V_{Sig}$=14 volts) exceeds the mobility correction processing time $t_{Cor}$. Accordingly, it is necessary to set the correction voltage $V_{Cor}$ so as not to exceed the mobility correction processing time $t_{Cor}$. The relationship between the correction voltage $V_{Cor}$ and the image signal $V_{Sig}$ is, as a result of various tests, for example, such as given below.

| Image signal $V_{Sig}$ | Correction voltage $V_{Cor}$ |
|---|---|
| 10 (V) | 6.5 (V) |
| 12 (V) | 6.5 (V) |
| 14 (V) | 8.5 (V) |

As a result of the foregoing, and further, from a test wherein a finer relationship between the correction voltage $V_{Cor}$ and the image signal $V_{Sig}$ was examined, if an optimum correction voltage $V_{Cor}$ is considered for each gradation in the timing settings described hereinabove, then where $\alpha_1$ and $\beta_2$ are constants higher than 0 and $\beta_1$ is a constant, $$V_{Cor}=\alpha_1 \times V_{Sig}+\beta 1 \text{ [where } V_{Sig\text{-}Min} \leq V_{Sig} \leq V_{Sig\text{-}0}]$$

$$V_{Cor}=\beta_2 \text{ [where } V_{Sig\text{-}0} < V_{Sig} \leq V_{Sig\text{-}Max}]$$

are satisfied. Here, $\alpha_1 \times V_{Sig\text{-}0}+\beta_1=\beta_2$.

If the relationship between the correction voltage $V_{Cor}$ and the image signal $V_{Sig}$ is set based on a linear function in this manner, then by assembling a logic circuit conforming to the function in the organic EL display apparatus, the optimum correction voltage $V_{Cor}$ can be determined finely for each image signal $V_{Sig}$ and outputted to the driving circuit 11.

As described above, it may be determined based on the mobility correction processing time $t_{Cor}$ and the writing processing time $t_{Sig}$ what relationship (for example, function) should be adopted as a relationship between the correction voltage $V_{Cor}$ and the image signal $V_{Sig}$. For example, where the mobility correction processing time $t_{Cor}$ is longer than the writing processing time $t_{Sig}$, although it depends upon the values of $t_{Cor}$ and $t_{Sig}$, where $\alpha_1$ is a constant higher than 0 and $\beta_1$ is a constant, a monotonously increasing linear function which satisfies $$V_{Cor}=\alpha_1\times V_{Sig}+\beta_1 \text{ [where } V_{Sig\text{-}Min}\leq V_{Sig}\leq V_{Sig\text{-}Max}]$$

may be used for the relationship described above. For example, where the mobility correction processing time $t_{Cor}$ is shorter than the writing processing time $t_{Sig}$, although it depends upon the values of $t_{Cor}$ and $t_{Sig}$, where $\alpha_1$ and $\beta_1$ are constants higher than 0, a monotonously decreasing linear functions which satisfies $$V_{Cor}=-\alpha_1\times V_{Sig}+\beta_1 \text{ [where } V_{Sig\text{-}Min}\leq V_{Sig}\leq V_{Sig\text{-}Max}]$$

may be used for the relationship described above. Further, although it depends upon the values of $t_{Cor}$ and $t_{Sig}$, where $\alpha_1$, $\alpha_2$ and $\beta_1$ are constants higher than 0 and $\beta_2$ is a constant, $$V_{Cor}=-\alpha_1\times V_{Sig}+\beta_1 \text{ [where } V_{Sig\text{-}Min}\leq V_{Sig}\leq V_{Sig\text{-}0}]$$

$$V_{Cor}=\alpha_2\times V_{Sig}+\beta_2 \text{ [where } V_{Sig\text{-}0}\leq V_{Sig}\leq V_{Sig\text{-}Max}]$$

are satisfied. Here, $-\alpha_1\times V_{Sig\text{-}0}+\beta_1=\alpha_2\times V_{Sig\text{-}0}+\beta_2$.

Although it depends upon the relationship between the correction voltage $V_{Cor}$ and the image signal $V_{Sig}$, a table which defines the relationship between the image signal $V_{Sig}$ and the correction voltage $V_{Cor}$ using the image signal $V_{Sig}$ as a parameter may be stored in the image signal outputting circuit 102 such that a correction voltage $V_{Cor}$ is determined based on the image signal $V_{Sig}$ to be outputted from the image signal outputting circuit 102 and is then outputted from the image signal outputting circuit 102.

Alternatively, control of the correction voltage $V_{Cor}$ can be carried out based on a combination of passive elements such as resistors and capacitors, discrete parts and so forth provided in the image signal outputting circuit 102. In particular, where the relationship between the correction voltage $V_{Cor}$ and the image signal $V_{Sig}$ are set as a monotonously increasing linear function, the image signal outputting circuit 102 includes, for example, a digital-analog converter DAC, resistors $RT_1$ and $RT_2$ and switches $SW_A$ and $SW_B$ as shown in (A) of FIG. 23. Then, an image signal $V_{Sig}$ is outputted from the digital-analog converter DAC. Within the [period TP $(\mathbf{5})_5$], the switch $SW_B$ is placed into an off state and the switch $SW_A$ is placed into an on state. As a result, the value of the potential at a node $ND_A$, that is, the correction voltage $V_{Cor}$, becomes such as given by an expression given below based on the resistance value ($rt_1$) of the resistor $RT_1$ and the resistance value ($rt_2$) of the resistor $RT_2$, and the correction voltage $V_{Cor}$ is outputted to the data line DTL.

$$V_{Cor}=V_{Sig}\times rt_2/(rt_1+rt_2)$$

Thereafter, within the [period TP $(\mathbf{5})_6$], the switch $SW_B$ is placed into an on state and the switch $SW_A$ is placed into an off state. As a result, an image signal $V_{Sig}$ is outputted to the data line DTL. By varying the resistance value ($rt_1$) of the resistor $RT_1$ and the resistance value ($rt_2$) of the resistor $RT_2$ as described above, that is, by a simple resistance dividing method, the relationship between the correction voltage $V_{Cor}$ and the image signal $V_{Sig}$ can be varied readily.

Figure 23:
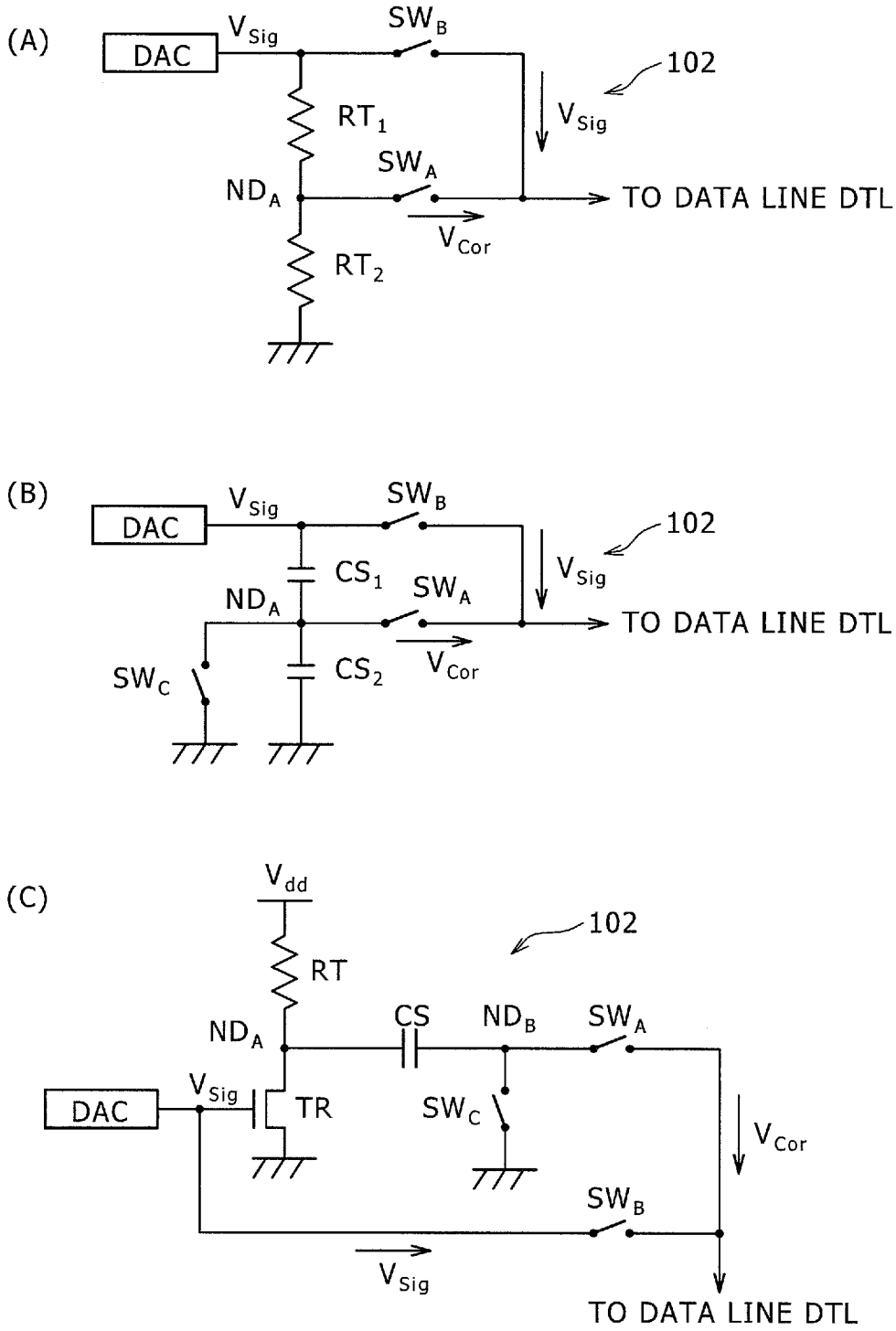
FIGS. 23 (A), (B) and (C) are equivalent circuit diagrams suitable to carry out control of a correction voltage in the embodiments.
Figure 24:
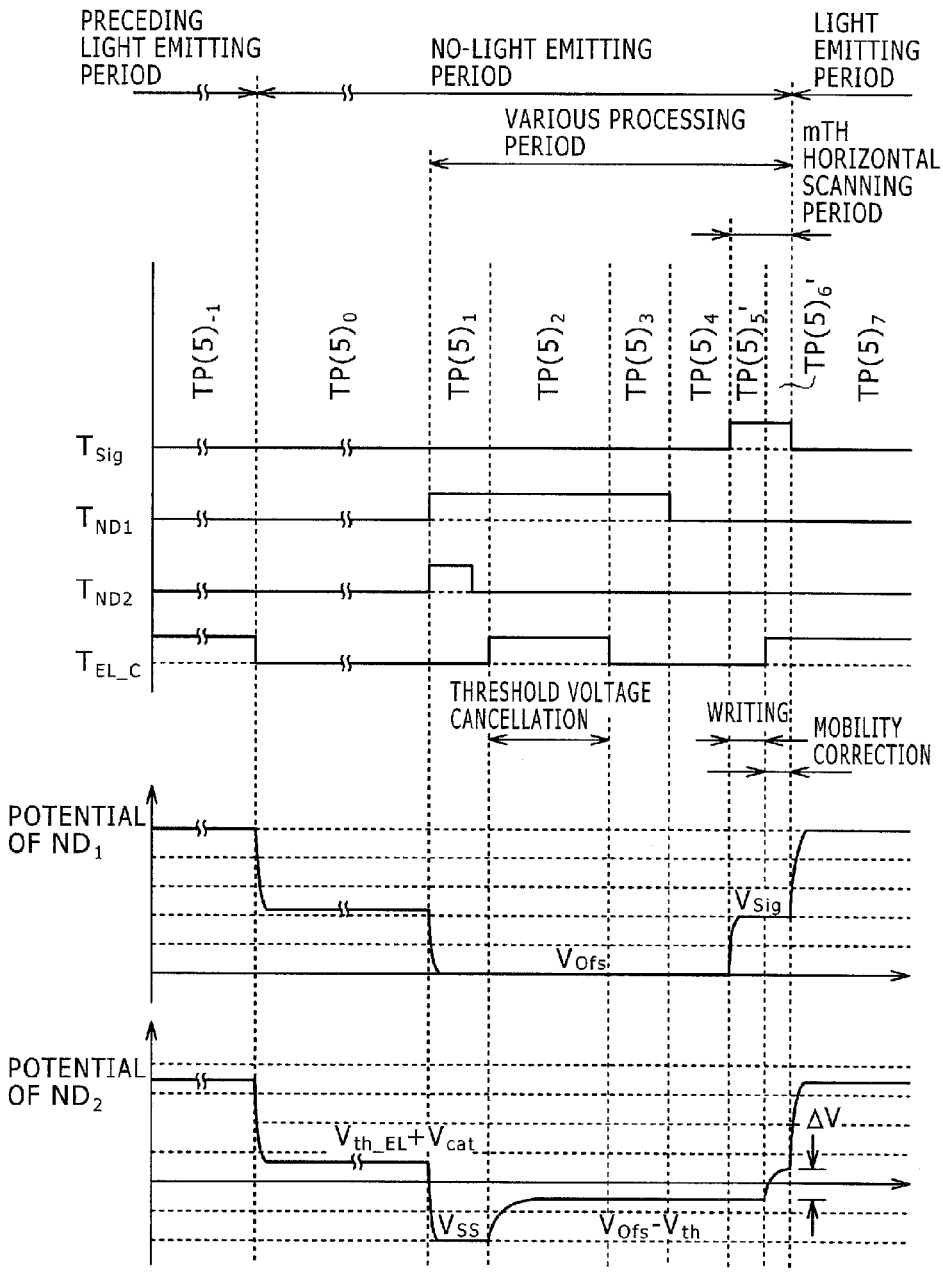
FIG. 24 is an equivalent circuit diagram of a conventional driving circuit basically formed from a 5-transistor/1-capacitor section.
Figure 25:
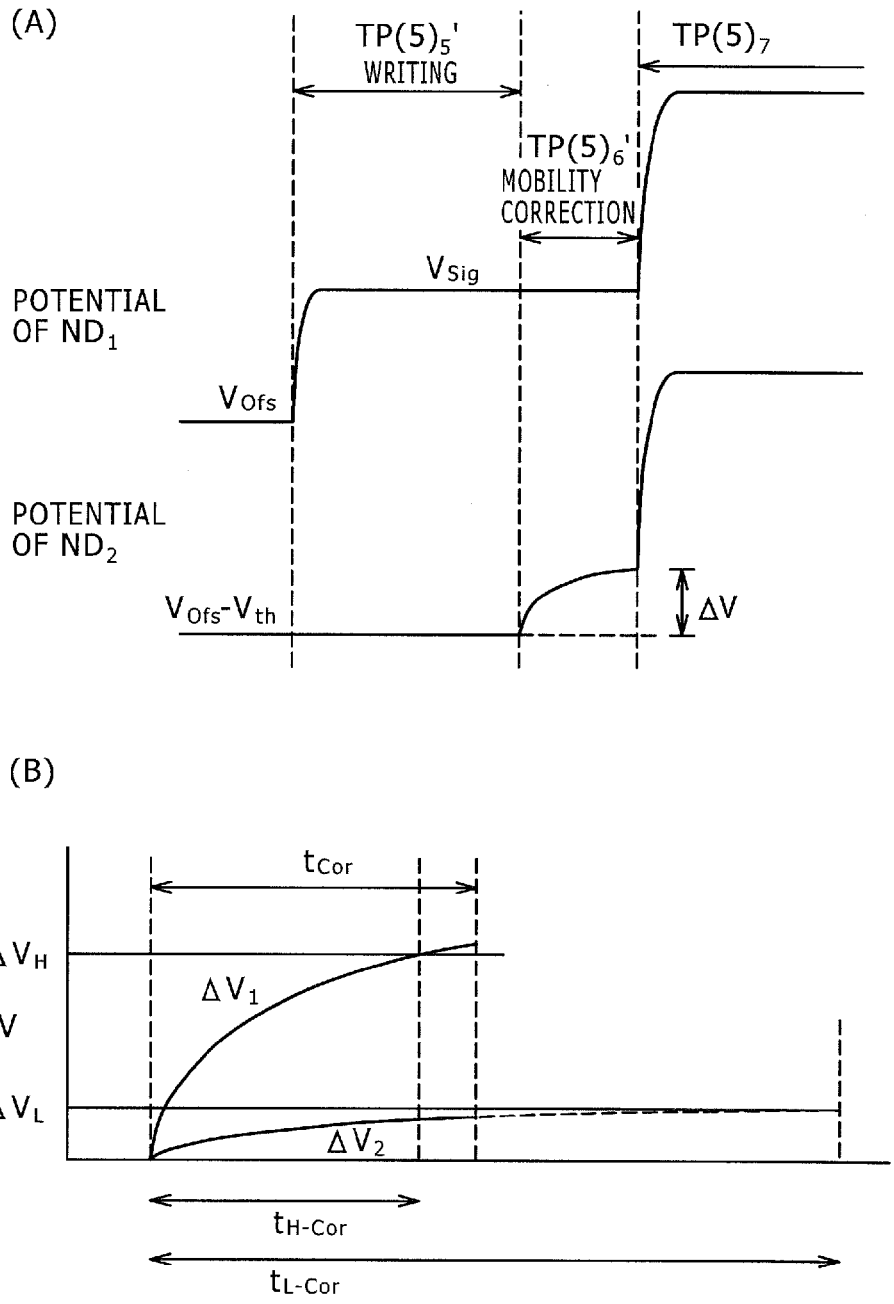
FIGS. 25 (A) and (B) is a timing chart wherein a [period TP $(\mathbf{5})_5$'] and a [period TP $(\mathbf{5})_6$'] in the equivalent circuit diagram of the conventional driving circuit basically formed from the 5-transistor/1-capacitor section shown in FIG. 24 are enlarged.

Alternatively, where the relationship between the correction voltage $V_{Cor}$ and the image signal $V_{Sig}$ is set to a monotonously increasing linear function, the image signal outputting circuit 102 is formed, for example, from a digital-analog converter DAC, capacitors $CS_1$ and $CS_2$ and switches $SW_A$, $SW_B$ and $SW_C$ as shown in (B) of FIG. 23. Then, an image signal $V_{Sig}$ is outputted from the digital-analog converter DAC. Within the [period TP $(\mathbf{5})_5$], the switches $SW_B$ and $SW_C$ are placed into an off state and the switch $SW_A$ is placed into an on state. As a result, the value of the potential at the node $ND_A$, that is, the correction voltage $V_{Cor}$, becomes such as given by the expression given below by coupling of the capacitors $CS_1$ (capacitance $cs_1$) and $CS_2$ (capacitance $cs_2$), and a correction voltage $V_{Cor}$ is outputted to the data line DTL.

$$V_{Cor}=V_{Sig}\times cs_1/(cs_1+cs_2)$$

Thereafter, within the [period TP $(\mathbf{5})_6$], the switches $SW_B$ and $SW_C$ are placed into an on state and the switch $SW_A$ is placed into an off state. As a result, an image signal $V_{Sig}$ is outputted to the data line DTL. By varying the capacitance $cs_1$ of the capacitor $CS_1$ and the capacitance $cs_2$ of the capacitor $CS_2$ as described above, that is, by a simple resistance dividing method, the relationship between the correction voltage $V_{Cor}$ and the image signal $V_{Sig}$ can be varied readily.

Alternatively, where the relationship between the correction voltage $V_{Cor}$ and the image signal $V_{Sig}$ is set to a monotonously decreasing linear function, the image signal outputting circuit 102 is formed, for example, from a digital-analog converter DAC, a transistor TR, a resistor RT, a capacitor CS and switches $SW_A$, $SW_B$ and $SW_C$ as shown in (C) of FIG. 23. Then, an image signal $V_{Sig}$ is outputted from the digital-analog converter DAC. Within the [period TP $(\mathbf{5})_5$], the switch $SW_A$ is placed into an on state and the switches $SW_B$ and $SW_C$ are placed into an on state.

Here, where the value of the image signal $V_{Sig}$ is high, that is, where the organic EL element displays the gradation of the white, the voltage drop by the transistor TR is small and the potential $V_A$ at the node $ND_A$ is high. Further, the value of the potential at the node $ND_B$, that is, the correction voltage $V_{Cor}$, becomes $V_{Cor}=V_{dd}-V_A$ by coupling of the capacitor CS. As described above, where the value of the image signal $V_{Sig}$ is high, since the potential $V_A$ at the node $ND_A$ is high, the value of the correction voltage $V_{Cor}$ is low after all. Then, this correction voltage $V_{Cor}$ is outputted to the data line DTL.

Meanwhile, where the value of the image signal $V_{Sig}$ is low, that is, where the organic EL element displays the gradation of the black, the voltage drop by the transistor TR is great and the potential $V_A$ at the node $ND_A$ is low. Further, the value of the potential at the node $ND_B$, that is, the correction voltage $V_{Cor}$, becomes $V_{Cor}=V_{dd}-V_A$ by coupling of the capacitor CS. As described above, where the value of the image signal $V_{Sig}$ is low, since the potential $V_A$ at the node $ND_A$ is low, the value of the correction voltage $V_{Cor}$ is high after all. Then, this correction voltage $V_{Cor}$ is outputted to the data line DTL.

Thereafter, within the [period TP $(\mathbf{5})_6$], the switches $SW_B$ and $SW_C$ are placed into an on state and the switch $SW_A$ is placed into an off state. As a result, an image signal $V_{Sig}$ is outputted to the data line DTL. By varying the resistance value of the transistor TR in the on state, the resistance value of the resistor RT and the capacitance of the capacitor CS as described above, the relationship between the correction voltage $V_{Cor}$ and the image signal $V_{Sig}$ can be varied readily.

The foregoing argument and circuit configuration can be applied also to the embodiments 2 to 4 described below.

Embodiment 2

The embodiment 2 is a modification to the embodiment 1. In the embodiment 2, the driving circuit is formed from a 4Tr/1C driving circuit. An equivalent circuit diagram of the 4Tr/1C driving circuit is shown in FIG. 7; a conceptual view is shown in FIG. 8; a timing chart of driving is schematically shown in FIG. 9; and on/off states and so forth of the transistors are schematically shown in (A) to (D) of FIG. 10 and (A) to (D) of FIG. 11.

In this 4Tr/1C driving circuit, the first node initializing transistor $T_{ND1}$ is omitted from the 5Tr/1C driving circuit described hereinabove. In particular, the present 4Tr/1C driving circuit is composed of four transistors of an image signal writing transistor $T_{Sig}$, a driving transistor $T_{Drv}$, a light emission controlling transistor $T_{EL_C}$ and a second node initializing transistor $T_{ND2}$ and further includes one capacitor section $C_1$.

[Light Emission Controlling Transistor $T_{EL_C}$]

The configuration of the light emission controlling transistor $T_{EL_C}$ is same as that of the light emission controlling transistor $T_{EL_C}$ described hereinabove in connection with the 5Tr/1C driving circuit, and therefore, detailed description thereof is omitted.

[Driving Transistor $T_{Drv}$]

The configuration of the driving transistor $T_{Drv}$ is same as that of the driving transistor $T_{Drv}$ described hereinabove in connection with the 5Tr/1C driving circuit, and therefore, detailed description thereof is omitted.

[Second Node Initializing Transistor $T_{ND2}$]

The configuration of the second node initializing transistor $T_{ND2}$ is same as that of the second node initializing transistor $T_{ND2}$ described hereinabove in connection with the 5Tr/1C driving circuit, and therefore, detailed description thereof is omitted.

[Image Signal Writing Transistor $T_{Sig}$]

The configuration of the image signal writing transistor $T_{Sig}$ is same as that of image signal writing transistor $T_{Sig}$ described hereinabove in connection with the 5Tr/1C driving circuit, and therefore, detailed description thereof is omitted. It is to be noted, however, that, although the image signal writing transistor $T_{Sig}$ is connected at the one of the source/drain regions thereof to a data line DTL, not only the image signal $V_{Sig}$ and the correction voltage $V_{Cor}$ for controlling the luminance of the light emitting section ELP but also a voltage $V_{Ofs}$ for initializing the gate electrode of the driving transistor $T_{Drv}$ are supplied from the image signal outputting circuit 102. In this regard, the operation of the image signal writing transistor $T_{Sig}$ is different from that of the image signal writing transistor $T_{Sig}$ described hereinabove in connection with the 5Tr/1C driving circuit. It is to be noted that, from the image signal outputting circuit 102, a signal or voltage (for example, a signal for precharge driving) other than $V_{Sig}$, $V_{Cor}$ and $V_{Ofs}$ may be supplied to the one of the source/drain regions of the image signal writing transistor $T_{Sig}$.

[Light Emitting Section ELP]

The configuration of the light emitting section ELP is same as that of the light emitting section ELP described hereinabove in connection with the 5Tr/1C driving circuit, and therefore, detailed description thereof is omitted.

In the following, operation of the 4Tr/1C driving circuit is described.

[Period TP $(\mathbf{4})_{-1}$] (Refer to (A) of FIG. 10)

Operation within this [period TP $(\mathbf{4})_{-1}$] is operation, for example, in a preceding display frame and is same as that within the [period TP $(\mathbf{5})_{-1}$] described hereinabove in connection with the 5Tr/1C driving circuit.

The [period TP $(\mathbf{4})_0$] to the [period TP $(\mathbf{4})_4$] shown in FIG. 9 are a period corresponding to the [period TP $(\mathbf{5})_0$] to the [period TP $(\mathbf{5})_4$] shown in FIG. 3 and is an operation period till a point of time immediately before a next writing process is carried out. Moreover, similarly as in the 5Tr/1C driving circuit, within the [period TP $(\mathbf{4})_0$] to the [period TP $(\mathbf{4})_4$], the (n, m)th organic EL element 10 is in a no-light emitting state. However, the operation of the 4Tr/1C driving circuit is different from the operation of the 5Tr/1C driving circuit in that not only the [period TP $(\mathbf{4})_5$] to the [period TP $(\mathbf{4})_6$] but also the [period TP $(\mathbf{4})_2$] to the [period TP $(\mathbf{4})_4$] are included in the mth horizontal scanning period. It is to be noted that, for the convenience of description, it is described that the start timing of the [period TP $(\mathbf{4})_2$] and the end timing the [period TP $(\mathbf{4})_6$] coincide with the start timing and the end timing of the mth horizontal scanning period, respectively.

In the following, the [period TP $(\mathbf{4})_0$] to the [period TP $(\mathbf{4})_4$] are described individually. It is to be noted that, similarly as in the description of the 5Tr/1C driving circuit, the start timing of the [period TP $(\mathbf{4})_1$] and the length of each of the periods of the [period TP $(\mathbf{4})_1$] to [period TP $(\mathbf{4})_4$] may be set suitably in accordance with the design of the organic EL display apparatus.

[Period TP $(\mathbf{4})_0$]

Operation within this [period TP $(\mathbf{4})_0$] is operation, for example, in a current display frame from a preceding display frame and is substantially same operation as that within the [period TP $(\mathbf{5})_0$] described hereinabove in connection with the 5Tr/1C driving circuit.

[Period TP $(\mathbf{4})_1$] (Refer to (B) of FIG. 10)

This [period TP $(\mathbf{4})_1$] corresponds to the [period TP $(\mathbf{5})_1$] described hereinabove in connection with the 5Tr/1C driving circuit. Within this [period TP $(\mathbf{4})_1$], a pre-process for carrying out a threshold voltage cancellation process hereinafter described is carried out. Upon starting of the [period TP $(\mathbf{4})_1$], the second node initializing transistor control line $AZ_{ND2}$ is placed into a high level state based on operation of the second node initializing transistor control circuit 105 to place the second node initializing transistor $T_{ND2}$ into an on state. As a result, the potential of the second node $ND_2$ becomes $V_{SS}$(for example, −10 volts). Also the potential of the first node $ND_1$ (gate electrode of the driving transistor $T_{Drv}$) in a floating state drops in such a manner as to follow up the potential drop of the second node $ND_2$. It is to be noted that the potential of the first node $ND_1$ within the [period TP $(\mathbf{4})_1$] depends upon the potential of the first node $ND_1$ (which depends upon the value of $V_{Sig}$ in the preceding frame) within the [period TP $(\mathbf{4})_{-1}$] and therefore does not assume a fixed value.

[Period TP $(\mathbf{4})_2$] (Refer to (C) of FIG. 10)

Thereafter, the potential of the data line DTL is set to $V_{Ofs}$ based on operation of the image signal outputting circuit 102 and the scanning line SCL is placed into a high level state based on operation of the scanning circuit 101 to place the image signal writing transistor $T_{Sig}$ into an on state. As a result, the potential of the first node $ND_1$ becomes $V_{Ofs}$ (for example, 0 volts). The potential of the second node $ND_2$ maintains $V_{SS}$(for example, −10 volts). Thereafter, the second node initializing transistor control line $AZ_{ND2}$ is placed into a low level state based on operation of the second node initializing transistor control circuit 105 to place the second node initializing transistor $T_{ND2}$ into an off state.

It is to be noted that the image signal writing transistor $T_{Sig}$ may be placed into an on state simultaneously with the starting of the [period TP $(\mathbf{4})_1$] or midway of the [period TP $(\mathbf{4})_1$].

By the processes described above, the potential difference between the gate electrode and the source region of the driving transistor $T_{Drv}$ becomes greater than $V_{th}$ and the driving transistor $T_{Drv}$ is placed into an on state.

[Period TP $(\mathbf{4})_3$] (Refer to (D) of FIG. 10)

Then, a threshold voltage cancellation process is carried out. In particular, while the on state of the image signal writing transistor $T_{Sig}$ is maintained, the light emission controlling transistor control line $CL_{EL_C}$ is placed into a high level state based on operation of the light emission controlling transistor control circuit 103 to place the light emission controlling transistor $T_{EL_C}$ into an on state. As a result, although the potential of the first node $ND_1$ does not vary ($V_{Ofs}$=0 volts are maintained), the potential of the second node $ND_2$ varies toward a potential difference of the threshold voltage $V_{th}$ of the driving transistor $T_{Drv}$ from the potential of the first node $ND_1$. In other words, the potential of the second node $ND_2$ in a floating state rises. Then, if the potential difference between the gate electrode and the source region of the driving transistor $T_{Drv}$ reaches $V_{th}$, then the driving transistor $T_{Drv}$ is placed into an off state. In particular, the potential of the second node $ND_2$ in the floating state varies toward ($V_{Ofs}-V_{th}=-3$ volts) and finally becomes ($V_{Ofs}-V_{th}$). Here, if the expression (2) given hereinabove is assured, or in other words, if the potential is selected and determined so as to satisfy the expression (2), then the light emitting section ELP does not emit light at all.

Within this [period TP $(4)_3$], the potential of the second node $ND_2$ finally becomes, for example, ($V_{Ofs}-V_{th}$) In particular, the potential of the second node $ND_2$ depends only upon the threshold voltage $V_{th}$ of the driving transistor $T_{Drv}$ and the voltage $V_{Ofs}$ for initializing the gate electrode of the driving transistor $T_{Drv}$. Moreover, the potential of the second node $ND_2$ is independent of the threshold voltage $V_{th-EL}$ of the light emitting section ELP.

[Period TP $(4)_4$] (Refer to (A) of FIG. 11)

Thereafter, while the on state of the image signal writing transistor $T_{Sig}$ is maintained, the light emission controlling transistor control line $CL_{EL_C}$ is placed into a low level state based on operation of the light emission controlling transistor control circuit 103 to place the light emission controlling transistor $T_{EL_C}$ into an off state. As a result, the potential of the first node $ND_1$ does not vary ($V_{Ofs}=0$ volts are maintained) and also the potential of the second node $ND_2$ in the floating state does not substantially vary (while actually potential variations may possibly be caused by electrostatic coupling of the parasitic capacitance and so forth, normally they can be ignored) but maintains ($V_{Ofs}-V_{th}=-3$ volts).

Now, periods from the [period TP $(4)_5$] to the [period TP $(4)_7$] are described. Operation in the periods is substantially same operation as that in the [period TP $(5)_5$] to the [period TP $(5)_7$] described hereinabove in connection with the 5Tr/1C driving circuit.

[Period TP $(4)_5$] (Refer to (B) of FIG. 11)

Then, correction (mobility correction process) of the potential of the source region of the driving transistor $T_{Drv}$ (second node $ND_2$) based on the magnitude of the mobility μ of the driving transistor $T_{Drv}$ is carried out. In particular, operation same as that in the [period TP $(5)_5$] described hereinabove in connection with the 5Tr/1C driving circuit may be carried out. In particular, while the off state of the second node initializing transistor $T_{ND2}$ and the light emission controlling transistor $T_{EL_C}$ is maintained, the potential of the data line DTL is changed over from $V_{Ofs}$ to the correction voltage $V_{Cor}$ based on operation of the image signal outputting circuit 102 to place the image signal writing transistor $T_{Sig}$ and the light emission controlling transistor $T_{EL_C}$ into an on state. As a result, the potential of the first node $ND_1$ rises to the correction voltage $V_{Cor}$ and the potential of the second node $ND_2$ rises to $\Delta V_{Cor}$. It is to be noted that the predetermined time for executing the mobility correction process (total time ($t_{Cor}$) within the [period TP $(4)_5$] may be determined as a design value in advance upon designing of the organic EL display apparatus.

By this, similarly as in the description of the 5Tr/1C driving circuit, the value described in connection with the expression (3) can be obtained as the potential difference between the first node $ND_1$ and the second node $ND_2$, that is, as the potential difference $V_{gs}$ between the gate electrode and the source region of the driving transistor $T_{Drv}$.

[Period TP $(4)_6$] (Refer to (C) of FIG. 11)

Thereafter, a writing process for the driving transistor $T_{Drv}$ is executed. In particular, the potential of the data line DTL is changed over from $V_{Cors}$ to the image signal $V_{Sig}$ for controlling the luminance of the light emitting section ELP based on operation of the image signal outputting circuit 102. As a result, the potential of the first node $ND_1$ rises to $V_{Sig}$ and the potential of the second node $ND_2$ rises almost to ($V_{Ofs}-V_{th}+\Delta V_{Cor}+\Delta V_{Sig}$). Consequently, similarly as in the description given hereinabove in connection with the 5Tr/1C driving circuit, the value described hereinabove in connection with the expression (4) can be obtained as the potential difference between the first node $ND_1$ and the second node $ND_2$, that is, as the potential difference $V_{gs}$ between the gate electrode and the source region of the driving transistor $T_{Drv}$.

In particular, also in the 4Tr/1C driving circuit, $V_{gs}$ obtained in the writing process into the driving transistor $T_{Drv}$ relies only upon the image signal $V_{Sig}$ for controlling the luminance of the light emitting section ELP, the threshold voltage $V_{th}$ of the driving transistor $T_{Drv}$, the voltage $V_{Ofs}$ for initializing the gate electrode of the driving transistor $T_{Drv}$ and the correction voltage $V_{Cor}$. Moreover, $V_{gs}$ is independent of the threshold voltage $V_{th-EL}$ of the light emitting section ELP.

[Period TP $(4)_7$] (Refer to (D) of FIG. 11)

By the foregoing operation, the threshold voltage cancellation process, writing process and mobility correction process are completed. Then, a process same as that in the [period TP $(5)_7$] described hereinabove in connection with the 5Tr/1C driving circuit is carried out, and the potential of the second node $ND_2$ rises and exceeds ($V_{th-EL}+V_{Cat}$). Therefore, the light emitting section ELP starts emission of light. At this time, since the current flowing through the light emitting section ELP can be obtained using the expression (5) given hereinabove, the drain current $I_{ds}$ flowing through the light emitting section ELP does not rely upon any of the threshold voltage $V_{th-EL}$ of the light emitting section ELP and the threshold voltage $V_{th}$ of the driving transistor $T_{Drv}$. In other words, the light emission amount (luminance) of the light emitting section ELP is not influenced by any of the threshold voltage $V_{th-EL}$ of the light emitting section ELP and the threshold voltage $V_{th}$ of the driving transistor $T_{Drv}$. In addition, occurrence of a dispersion in drain current $I_{ds}$ arising from a dispersion in mobility μ of the driving transistor $T_{Drv}$ can be suppressed.

Then, the light emitting state of the light emitting section ELP continues till the (m+m'−1)th horizontal scanning period. This point of time corresponds to the end of the [period TP $(4)_{_1}$].

By the operation described above, the light emitting operation of the organic EL element 10 [(n, m)th sub pixel (organic EL element 10)] is completed.

Embodiment 3

The embodiment 3 is a modification to the embodiment 1. In the embodiment 3, the driving circuit is formed from a 3Tr/1C driving circuit. An equivalent circuit diagram of the 3Tr/1C driving circuit is shown in FIG. 12, a conceptual view is shown in FIG. 13, a timing chart of driving is schematically shown in FIG. 14, and on/off states and so forth of the transistors are shown in (A) to (D) of FIG. 15 and (A) to (E) of FIG. 16.

In this 3Tr/1C driving circuit, two transistors of the first node initializing transistor $T_{ND1}$ and the second node initializing transistor $T_{ND2}$ are omitted from the 5Tr/1C driving circuit described hereinabove. In particular, the present 3Tr/

1C driving circuit is composed of three transistors of an image signal writing transistor $T_{Sig}$, a light emission controlling transistor $T_{EL_C}$ and a driving transistor $T_{Drv}$ and further includes one capacitor section $C_1$.

[Light Emission Controlling Transistor $T_{EL_C}$]

The configuration of the light emission controlling transistor $T_{EL_C}$ is same as that of the light emission controlling transistor $T_{EL_C}$ described hereinabove in connection with the 5Tr/1C driving circuit, and therefore, detailed description thereof is omitted.

[Driving Transistor $T_{Drv}$]

The configuration of the driving transistor $T_{Drv}$ is same as that of the driving transistor $T_{Drv}$ described hereinabove in connection with the 5Tr/1C driving circuit, and therefore, detailed description thereof is omitted.

[Image Signal Writing Transistor $T_{Sig}$]

The configuration of the image signal writing transistor $T_{Sig}$ is same as that of image signal writing transistor $T_{Sig}$ described hereinabove in connection with the 5Tr/1C driving circuit, and therefore, detailed description thereof is omitted. It is to be noted, however, that, although the image signal writing transistor $T_{Sig}$ is connected at the one of the source/drain regions thereof to a data line DTL, not only the image signal $V_{Sig}$ and the correction voltage $V_{Cor}$ for controlling the luminance of the light emitting section ELP but also the voltage $V_{Ofs\text{-}H}$ and the voltage $V_{Ofs\text{-}L}$ for initializing the gate electrode of the driving transistor $T_{Drv}$ are supplied from the image signal outputting circuit 102. In this regard, the operation of the image signal writing transistor $T_{Sig}$ is different from that of the image signal writing transistor $T_{Sig}$ described hereinabove in connection with the 5Tr/1C driving circuit. It is to be noted that, from the image signal outputting circuit 102, a signal or voltage (for example, a signal for precharge driving) other than $V_{Sig}$, the correction voltage $V_{Cor}$ and $V_{Ofs\text{-}H}$/$V_{Ofs\text{-}L}$ may be supplied to the one of the source/drain regions of the image signal writing transistor $T_{Sig}$. Although the value of the voltage $V_{Ofs\text{-}H}$ and the voltage $V_{Ofs\text{-}L}$ is not limited, for example, $V_{Ofs\text{-}H}$=approximately 30 volts and $V_{Ofs\text{-}L}$=approximately 0 volts can be given as an example.

[Relationship Between Values of $C_{EL}$ and $C_1$]

As hereinafter described, in the 3Tr/1C driving circuit, it is necessary to vary the potential of the second node $ND_2$ utilizing the data line DTL. The foregoing description of the 5Tr/1C driving circuit and the 4Tr/1C driving circuit is given assuming that the capacitance value $c_{EL}$ of the parasitic capacitance $C_{EL}$ of the light emitting section ELP has a sufficiently high value in comparison with the capacitance value of the capacitor section $C_1$ and the value $c_{gs}$ of the parasitic capacitance between the gate electrode and the source electrode of the driving transistor $T_{Drv}$ and without taking the variation of the potential of the source region of the driving transistor $T_{Drv}$ (second node $ND_2$) based on the variation amount of the potential of the gate electrode of the driving transistor $T_{Drv}$ into consideration (this similarly applies also to a 2Tr/1C driving circuit hereinafter described). On the other hand, in the 3Tr/1C driving circuit, the value capacitor section $C_1$ is set to a value higher than those of the other driving circuits upon designing (for example, the value $c_1$ is set to approximately ¼ to ⅓ of the value $c_{EL}$). Accordingly, the degree of the potential variation of the second node $ND_2$ which is caused by a potential variation of the first node $ND_1$ is higher than that of the other driving circuits. Therefore, the description of the 3Tr/1C driving circuit is given taking the potential variation of the second node $ND_2$ caused by the potential variation of the first node $ND_1$ into consideration. It is to be noted that also the timing chart of driving shown in the drawings is given taking the potential variation of the second node $ND_2$ caused by the potential variation of the first node $ND_1$ into consideration.

[Light Emitting Section ELP]

The configuration of the light emitting section ELP is same as that of the light emitting section ELP described hereinabove in connection with the 5Tr/1C driving circuit, and therefore, detailed description thereof is omitted.

In the following, operation of the 3Tr/1C driving circuit is described.

[Period TP $(\mathbf{3})_{-1}$] (Refer to (A) of FIG. 15)

Operation within this [period TP $(\mathbf{3})_{-1}$] is operation of, for example, in a preceding display frame and is substantially same as that within the [period TP $(\mathbf{5})_{-1}$] described hereinabove in connection with the 5Tr/1C driving circuit.

The [period TP $(\mathbf{3})_0$] to the [period TP $(\mathbf{3})_4$] shown in FIG. 14 are a period corresponding to the [period TP $(\mathbf{5})_0$] to the [period TP $(\mathbf{5})_4$] shown in FIG. 3 and is an operation period till a point of time immediately before a next writing process is carried out. Similarly as in the 5Tr/1C driving circuit, within the [period TP $(\mathbf{3})_0$] to the [period TP $(\mathbf{3})_4$], the (n, m)th organic EL element 10 is in a no-light emitting state. However, the operation of the 3Tr/1C driving circuit is different from the operation of the 5Tr/1C driving circuit in that not only the [period TP $(\mathbf{3})_5$] to the [period TP $(\mathbf{3})_6$] but also the [period TP $(\mathbf{3})_1$] to the [period TP $(\mathbf{3})_4$] are included in the mth horizontal scanning period. It is to be noted that, for the convenience of description, it is described that the start timing of the [period TP $(\mathbf{3})_1$] and the end timing the [period TP $(\mathbf{3})_6$] coincide with the start timing and the end timing of the mth horizontal scanning period, respectively.

In the following, each of the [period TP $(\mathbf{3})_0$] to the [period TP $(\mathbf{3})_4$] is described. It is to be noted that, similarly as in the description of the 5Tr/1C driving circuit, the length of each of the periods of the [period TP $(\mathbf{3})_1$] to [period TP $(\mathbf{3})_4$] may be set suitably in accordance with the design of the organic EL display apparatus.

[Period TP $(\mathbf{3})_0$] (Refer to (B) of FIG. 15)

Operation within this [period TP $(\mathbf{3})_0$] is operation, for example, in a current display frame from a preceding display frame and is substantially same operation as that within the [period TP $(\mathbf{5})_0$] described hereinabove in connection with the 5Tr/1C driving circuit.

[Period TP $(\mathbf{3})_1$] (Refer to (C) of FIG. 15)

Then, the mth horizontal scanning period in a current display frame is started. Upon starting of the [period TP $(\mathbf{3})_1$], the potential of the data line DTL is set to the voltage $V_{Ofs\text{-}H}$ for initializing the gate electrode of the driving transistor $T_{Drv}$ based on operation of the image signal outputting circuit 102 and then the scanning line SCL is placed into a high level state based on operation of the scanning circuit 101 to place the image signal writing transistor $T_{Sig}$ into an on state. As a result, the potential of the first node $ND_1$ becomes $V_{Ofs\text{-}H}$. Since the value $c_1$ of the capacitor section $C_1$ is set to a value higher than that of the other driving circuits upon designing as described above, the potential of the source region (potential of the second node $ND_2$) rises. Then, since the potential difference across the light emitting section ELP exceeds the threshold voltage $V_{th\text{-}EL}$, the light emitting section ELP is placed into a conducting state. However, the potential of the source region of the driving transistor $T_{Drv}$ drops immediately to ($V_{th\text{-}EL}$+$V_{Cor}$). It is to be noted that, while the light emitting section ELP can emit light in the course of the potential drop, such light emission occurs in an instant and does not make a problem in practical use. Meanwhile, the gate electrode of the driving transistor $T_{Drv}$ maintains the voltage $V_{Ofs\text{-}H}$.

[Period TP $(3)_2$] (Refer to (D) of FIG. 15)

Thereafter, the potential of the data line DTL is changed over from the voltage $V_{Ofs-L}$ for initializing the gate electrode of the driving transistor $T_{Drv}$ to the voltage $V_{Ofs-L}$ based on operation of the image signal outputting circuit 102, whereupon the potential of the first node $ND_1$ changes to $V_{Ofs-L}$. Then, as the potential of the first node $ND_1$ drops, also the potential of the second node $ND_2$ drops. In particular, charge based on the variation amount $(V_{Ofs-L}-V_{Ofs-H})$ of the potential of the gate electrode of the driving transistor $T_{Drv}$ is distributed to the capacitor section $C_1$, the parasitic capacitance $C_{EL}$ of the light emitting section ELP and the parasitic capacitance between the gate electrode and the source electrode of the driving transistor $T_{Drv}$. However, as a prerequisite of operation within the [period TP $(3)_3$] hereinafter described, it is necessary for the potential of the second node $ND_2$ to be lower than $V_{Ofs-L}-V_{th}$ at the end timing of the [period TP $(3)_2$]. The value of $V_{Ofs-H}$ and so forth are set so as to satisfy this condition. In particular, by the processes described above, the potential difference between the gate electrode and the source region of the driving transistor $T_{Drv}$ becomes higher than $V_{th}$, and the driving transistor $T_{Drv}$ is placed into an on state.

[Period TP $(3)_3$] (Refer to (A) of FIG. 16)

Then, a threshold voltage cancellation process is carried out. In particular, while the on state of the image signal writing transistor $T_{Sig}$ is maintained, the light emission controlling transistor control line $CL_{EL_C}$ is placed into a high level state based on operation of the light emission controlling transistor control circuit 103 to place the light emission controlling transistor $T_{EL_C}$ into an on state. As a result, although the potential of the first node $ND_1$ does not vary ($V_{Ofs-L}$=0 volts are maintained), the potential of the second node $ND_2$ varies from the potential of the first node $ND_1$ toward a potential of the difference of the threshold voltage $V_{th}$ of the driving transistor $T_{Drv}$ from the potential of the first node $ND_1$. In other words, the potential of the second node $ND_2$ in the floating state rises. Then, if the potential difference between the gate electrode and the source region of the driving transistor $T_{Drv}$ reaches $V_{th}$, then the driving transistor $T_{Drv}$ is placed into an off state. In particular, the potential of the second node $ND_2$ in the floating state varies toward ($V_{Ofs-L}-V_{th}$=−3 volts) and finally becomes $(V_{Ofs-L}-V_{th})$. Here, if the expression (2) given hereinabove is assured, or in other words, if the potential is selected and determined so as to satisfy the expression (2), then the light emitting section ELP does not emit light at all.

Within this [period TP $(3)_3$], the potential of the second node $ND_2$ finally becomes, for example, $(V_{Ofs-L}-V_{th})$ In particular, the potential of the second node $ND_2$ depends only upon the threshold voltage $V_{th}$ of the driving transistor $T_{Drv}$ and the voltage $V_{Ofs-L}$ for initializing the gate electrode of the driving transistor $T_{Drv}$. Further, the potential of the second node $ND_2$ is independent of the threshold voltage $V_{th-EL}$ of the light emitting section ELP.

[Period TP $(3)_4$] (Refer to (B) of FIG. 16)

Thereafter, while the on state of the image signal writing transistor $T_{Sig}$ is maintained, the light emission controlling transistor control line $CL_{EL_C}$ is placed into a low level state based on operation of the light emission controlling transistor control circuit 103 to place the light emission controlling transistor $T_{EL_C}$ into an off state. As a result, the potential of the first node $ND_1$ does not vary ($V_{Ofs-L}$=0 volts are maintained), and also the potential of the second node $ND_2$ in the floating state does not vary and maintains ($V_{Ofs-L}-V_{th}$=−3 volts)

Now, periods from the [period TP $(3)_5$] to the [period TP $(3)_7$] are described. Operation in the periods is substantially same operation as that in the [period TP $(5)_5$] to the [period TP $(5)_7$] described hereinabove in connection with the 5Tr/1C driving circuit.

[Period TP $(3)_5$] (Refer to (C) of FIG. 16)

Then, correction (mobility correction process) of the potential of the source region (second node $ND_2$) of the driving transistor $T_{Drv}$ based on the magnitude of the mobility μ of the driving transistor $T_{Drv}$ is carried out. In particular, operation same as that in the [period TP $(5)_5$] described hereinabove in connection with the 5Tr/1C driving circuit may be carried out. It is to be noted that the predetermined time for executing the mobility correction process (total time $(t_{Cor})$ within the [period TP $(3)_5$] may be determined as a design value in advance upon designing of the organic EL display apparatus.

[Period TP $(3)_6$] (Refer to (D) of FIG. 16)

Thereafter, a writing process for the driving transistor $T_{Drv}$ is executed. In particular, the potential of the data line DTL is changed over from the correction voltage $V_{Cor}$ to the image signal $V_{Sig}$ for controlling the luminance of the light emitting section ELP based on operation of the image signal outputting circuit 102 while the on state of the image signal writing transistor $T_{Sig}$ and the light emission controlling transistor $T_{EL_C}$ is maintained. As a result, the potential of the first node $ND_1$ rises to $V_{Sig}$ and the potential of the second node $ND_2$ rises almost to $(V_{Ofs}-V_{th}+\Delta V_{Cor}+\Delta V_{Sig})$. Consequently, similarly as in the description given hereinabove in connection with the 5Tr/1C driving circuit, the value described hereinabove in connection with the expression (4) can be obtained as the potential difference between the first node $ND_1$ and the second node $ND_2$, that is, as the potential difference $V_{gs}$ between the gate electrode and the source region of the driving transistor $T_{Drv}$.

In particular, also in the 3Tr/1C driving circuit, $V_{gs}$ obtained in the writing process into the driving transistor $T_{Drv}$ relies only upon the image signal $V_{Sig}$ for controlling the luminance of the light emitting section ELP, the threshold voltage $V_{th}$ of the driving transistor $T_{Drv}$, the voltage $V_{Ofs-L}$ for initializing the gate electrode of the driving transistor $T_{Drv}$ and the correction voltage $V_{Cor}$. Moreover, $V_{gs}$ is independent of the threshold voltage $V_{th-EL}$ of the light emitting section ELP.

[Period TP $(3)_7$] (Refer to (E) of FIG. 16)

By the foregoing operation, the threshold voltage cancellation process, writing process and mobility correction process are completed. Then, a process same as that in the [period TP $(5)_7$] described hereinabove in connection with the 5Tr/1C driving circuit is carried out, and the potential of the second node $ND_2$ rises and exceeds $(V_{th-EL}+V_{Cat})$. Therefore, the light emitting section ELP starts emission of light. At this time, since the current flowing through the light emitting section ELP can be obtained using the expression (5) described hereinabove, the drain current $I_{ds}$ flowing through the light emitting section ELP does not rely upon any of the threshold voltage $V_{th-EL}$ of the light emitting section ELP and the threshold voltage $V_{th}$ of the driving transistor $T_{Drv}$. In other words, the light emission amount (luminance) of the light emitting section ELP is not influenced by any of the threshold voltage $V_{th-EL}$ of the light emitting section ELP and the threshold voltage $V_{th}$ of the driving transistor $T_{Drv}$. In addition, occurrence of a dispersion in drain current $I_{ds}$ arising from a dispersion in mobility μ of the driving transistor $T_{Drv}$ can be suppressed.

Then, the light emitting state of the light emitting section ELP continues till the (m+m'−1)th horizontal scanning period. This point of time corresponds to the end of the [period TP $(4)_{-1}$].

By the operation described above, the light emitting operation of the organic EL element 10 [(n, m)th sub pixel (organic EL element 10)] is completed.

Embodiment 4

The embodiment 4 is a modification to the embodiment 1. In the embodiment 4, the driving circuit is formed from a 2Tr/1C driving circuit. An equivalent circuit diagram of the 2Tr/1C driving circuit is shown in FIG. 17, a conceptual view is shown in FIG. 18, a timing chart of driving is schematically shown in FIG. 19, and on/off states and so forth of the transistors are shown in (A) to (C) of FIG. 20 and (A) to (C) of FIG. 21.

In this 2Tr/1C driving circuit, three transistors of the first node initializing transistor $T_{ND1}$, light emission controlling transistor $T_{EL_C}$ and second node initializing transistor $T_{ND2}$ are omitted from the 5Tr/1C driving circuit described hereinabove. In particular, the present 2Tr/1C driving circuit is composed of two transistors of an image signal writing transistor $T_{Sig}$ and a driving transistor $T_{Drv}$ and further includes one capacitor section $C_1$.

[Driving Transistor $T_{Drv}$]

The configuration of the driving transistor $T_{Drv}$ is same as that of the driving transistor $T_{Drv}$ described hereinabove in connection with the 5Tr/1C driving circuit, and therefore, detailed description thereof is omitted. However, the driving transistor $T_{Drv}$ is connected at the drain electrode thereof to the current supplying section 100. It is to be noted that, from the current supplying section 100, a voltage $V_{CC-H}$ for controlling the emission of light of the light emitting section ELP and a voltage $V_{CC-L}$ for controlling the potential of the source region of the driving transistor $T_{Drv}$ are supplied. Here, while $V_{CC-H}$=20 volts $V_{CC-L}$=−10 volts can be listed as values of the voltages $V_{CC-H}$ and $V_{CC-L}$, they are not limited to the specific values.

[Image Signal Writing Transistor $T_{Sig}$]

The configuration of the image signal writing transistor $T_{Sig}$ is same as that of image signal writing transistor $T_{Sig}$ described hereinabove in connection with the 5Tr/1C driving circuit, and therefore, detailed description thereof is omitted.

[Light Emitting Section ELP]

The configuration of the light emitting section ELP is same as that of the light emitting section ELP described hereinabove in connection with the 5Tr/1C driving circuit, and therefore, detailed description thereof is omitted.

In the following, operation of the 2Tr/1C driving circuit is described.

[Period TP $(2)_{-1}$] (Refer to (A) of FIG. 20)

Operation within this [period TP $(2)_{-1}$] is operation of, for example, in a preceding display frame and is substantially same as that within the [period TP $(5)_{-1}$] described hereinabove in connection with the 5Tr/1C driving circuit.

The [period TP $(2)_0$] to the [period TP $(2)_2$] shown in FIG. 19 are a period corresponding to the [period TP $(5)_0$] to the [period TP $(5)_4$] shown in FIG. 3 and is an operation period till a point of time immediately before a next writing process is carried out. In addition, similarly as in the 5Tr/1C driving circuit, within the [period TP $(2)_0$] to the [period TP $(2)_2$], the (n, m)th organic EL element 10 is in a no-light emitting state. However, the operation of the 2Tr/1C driving circuit is different from the operation of the 5Tr/1C driving circuit in that not only the [period TP $(2)_3$] but also the [period TP $(2)_1$] to the [period TP $(2)_2$] are included in the mth horizontal scanning period. It is to be noted that, for the convenience of description, it is described that the start timing of the [period TP $(2)_1$] and the end timing the [period TP $(2)_3$] coincide with the start timing and the end timing of the mth horizontal scanning period, respectively.

In the following, each of periods of the [period TP $(2)_0$] to the [period TP $(2)_2$] is described. It is to be noted that, similarly as in the description of the 5Tr/1C driving circuit, the length of each of the periods of the [period TP $(2)_1$] to [period TP $(2)_3$] may be set suitably in accordance with the design of the organic EL display apparatus.

[Period TP $(2)_0$] (Refer to (B) of FIG. 20)

Operation within this [period TP $(2)_0$] is operation of, for example, in a current display frame from a preceding display frame. In particular, the [period TP $(2)_0$] is a period from the (m+m')th horizontal scanning period in the preceding display frame to the (m−1)th horizontal scanning period in the current display frame. Moreover, within this [period TP $(2)_0$], the (n, m)th organic EL element 10 is in a no-light emitting state. Here, at a point of time of transition from the [period TP $(2)_{-1}$] to the [period TP $(2)_0$], the potential to be supplied from the current supplying section 100 is changed over from $V_{CC-H}$ to the voltage $V_{CC-L}$. As a result, the potential of the second node $ND_2$ (source region of the driving transistor $T_{Drv}$ or anode electrode of the light emitting section ELP) drops to $V_{CC-L}$, and the light emitting section ELP is placed into a no-light emitting state. Further, also the potential of the first node $ND_1$ in the floating state (gate electrode of the driving transistor $T_{Drv}$) drops in such a manner as to follow up the potential drop of the second node $ND_2$.

[Period TP $(2)_1$] (Refer to (C) of FIG. 20)

Then, the mth horizontal scanning period in the current display frame is started. Upon starting of the [period TP $(2)_1$], the scanning line SCL is set to the high level based on operation of the scanning circuit 101 to place the image signal writing transistor $T_{Sig}$ into an on state. As a result, the potential of the first node $ND_1$ becomes $V_{Ofs}$ (for example, 0 volts). The potential of the second node $ND_2$ maintains $V_{CC-L}$ (for example, −10 volts)

By the processes described above, the potential difference between the gate electrode and the source region of the driving transistor $T_{Drv}$ becomes greater than $V_{th}$, and the driving transistor $T_{Drv}$ is placed into an on state.

[Period TP $(2)_2$] (Refer to (D) of FIG. 20)

Subsequently, a threshold voltage cancellation process is carried out. In particular, while the on state of the image signal writing transistor $T_{Sig}$ is maintained, the voltage to be supplied from the current supplying section 100 is changed over from $V_{CC-L}$ to the voltage $V_{CC-H}$. As a result, although the potential of the first node $ND_1$ does not vary ($V_{Ofs}$=0 volts are maintained), the potential of the second node $ND_2$ varies from the potential of the first node $ND_1$ toward a potential of the difference of the threshold voltage $V_{th}$ of the driving transistor $T_{Drv}$ from the potential of the first node $ND_1$. In other words, the potential of the second node $ND_2$ in the floating state rises. Then, if the potential difference between the gate electrode and the source region of the driving transistor $T_{Drv}$ reaches $V_{th}$, then the driving transistor $T_{Drv}$ is placed into an off state. In particular, the potential of the second node $ND_2$ in the floating state varies toward ($V_{Ofs}-V_{th}$=−3 volts) and finally becomes ($V_{Ofs}-V_{th}$). Here, if the expression (2) given hereinabove is assured, or in other words, if the potential is selected and determined so as to satisfy the expression (2), then the light emitting section ELP does not emit light at all.

Within this [period TP $(2)_2$], the potential of the second node $ND_2$ finally becomes, for example, $(V_{Ofs}-V_{th})$. In particular, the potential of the second node $ND_2$ depends only upon the threshold voltage $V_{th}$ of the driving transistor $T_{Drv}$ and the voltage $V_{Ofs}$ for initializing the gate electrode of the driving transistor $T_{Drv}$. Further, the potential of the second node $ND_2$ is independent of the threshold voltage $V_{th-EL}$ of the light emitting section ELP.

[Period TP $(2)_3$] (Refer to (A) of FIG. 21)

Then, correction (mobility correction process) of the potential of the source region (second node $ND_2$) of the driving transistor $T_{Drv}$ based on the magnitude of the mobility μ of the driving transistor $T_{Drv}$ is carried out. In particular, operation same as that in the [period TP $(5)_5$] described hereinabove in connection with the 5Tr/1C driving circuit may be carried out. It is to be noted that the predetermined time for executing the mobility correction process (total time $(t_{Cor})$ within the [period TP $(2)_3$] may be determined as a design value in advance upon designing of the organic EL display apparatus.

Also within this [period TP $(2)_3$], where the value of the mobility μ of the driving transistor $T_{Drv}$ is high, the rise amount $\Delta V_{Cor}$ of the potential in the source region of the driving transistor $T_{Drv}$ is great, but where the value of the mobility μ of the driving transistor $T_{Drv}$ is low, the rise amount $\Delta V_{Cor}$ of the potential in the source region of the driving transistor $T_{Drv}$ is small.

[Period TP $(2)_4$] (Refer to (B) of FIG. 21)

Thereafter, a writing process for the driving transistor $T_{Drv}$ is executed. In particular, the potential of the data line DTL is changed over from the correction voltage $V_{Cor}$ to the image signal $V_{Sig}$ for controlling the luminance of the light emitting section ELP based on operation of the image signal outputting circuit 102 while the on state of the image signal writing transistor $T_{Sig}$ is maintained. As a result, the potential of the first node $ND_1$ rises to $V_{Sig}$ and the potential of the second node $ND_2$ rises almost to $(V_{Ofs}-V_{th}+\Delta V_{Cor}+\Delta V_{Sig})$ Consequently, similarly as in the description given hereinabove in connection with the 5Tr/1C driving circuit, the value described hereinabove in connection with the expression (4) can be obtained as the potential difference between the first node $ND_1$ and the second node $ND_2$, that is, as the potential difference $V_{gs}$ between the gate electrode and the source region of the driving transistor $T_{Drv}$.

In particular, also in the 2Tr/1C driving circuit, $V_{gs}$ obtained in the writing process into the driving transistor $T_{Drv}$ relies only upon the image signal $V_{Sig}$ for controlling the luminance of the light emitting section ELP, the threshold voltage $V_{th}$ of the driving transistor $T_{Drv}$, the voltage $V_{Ofs-L}$ for initializing the gate electrode of the driving transistor $T_{Drv}$ and the correction voltage $V_{Cor}$. In addition, $V_{gs}$ is independent of the threshold voltage $V_{th-EL}$ of the light emitting section ELP.

[Period TP $(2)_5$] (Refer to (C) of FIG. 21)

By the foregoing operation, the threshold voltage cancellation process, writing process and mobility correction process are completed. Then, a process same as that in the [period TP $(5)_7$] described hereinabove in connection with the 5Tr/1C driving circuit is carried out, and the potential of the second node $ND_2$ rises and exceeds $(V_{th-EL}+V_{Cat})$. Therefore, the light emitting section ELP starts emission of light. At this time, since the current flowing through the light emitting section ELP can be obtained using the expression (5) given hereinabove, the drain current $I_{ds}$ flowing through the light emitting section ELP does not rely upon any of the threshold voltage $V_{th-EL}$ of the light emitting section ELP and the threshold voltage $V_{th}$ of the driving transistor $T_{Drv}$. In other words, the light emission amount (luminance) of the light emitting section ELP is not influenced by any of the threshold voltage $V_{th-EL}$ of the light emitting section ELP and the threshold voltage $V_{th}$ of the driving transistor $T_{Drv}$. In addition, occurrence of a dispersion in drain current $I_{ds}$ arising from a dispersion in mobility μ of the driving transistor $T_{Drv}$ can be suppressed.

Then, the light emitting state of the light emitting section ELP continues till the (m+m'−1)th horizontal scanning period. This point of time corresponds to the end of the [period TP $(2)_{-1}$].

By the operation described above, the light emitting operation of the organic EL element 10 [(n, m)th sub pixel (organic EL element 10)] is completed.

While the present invention has been described based on the preferred embodiments thereof, the present invention is not limited to the embodiments. The configuration and structure of the various components of the organic EL display apparatus described in connection with the embodiments are illustrative and can be altered suitably. While, in the embodiments, the correction voltage $V_{Cor}$ is varied smoothly in principle by variation of the image signal $V_{Sig}$, according to circumstances, the correction voltage $V_{Cor}$ may be varied stepwise. Further, in the 5Tr/1C driving circuit, 4Tr/1C driving circuit and 3Tr/1C driving circuit, the light emission controlling transistor $T_{EL_C}$ may be placed into an on state immediately before the mobility correction process is started to set the potential of the drain region of the driving transistor $T_{Drv}$ to the voltage $V_{CC}$ of the current supplying section 100. Further, the value of the correction voltage $V_{Cor}$ may be a fixed value irrespective of the value of the image signal $V_{Sig}$.

The invention claimed is:

1. A driving method for an organic electroluminescence light emitting section which uses a pixel circuit including a driving transistor and a writing transistor, the driving transistor being connected between a power supply potential and a light emitting section, the writing transistor being connected to a data line, the driving method comprising:

applying a correction voltage to a gate of the driving transistor from the data line through the writing transistor;

applying an image signal to the gate of the driving transistor from the data line through the writing transistor, said applying the correction voltage to the gate and applying the image signal to the gate occurring separately and cumulatively contributing to a potential difference between the gate of the driving transistor and a source of the driving transistor; and supplying current to the light emitting section through the driving transistor corresponding to the value of the potential difference between the gate of the driving transistor and the source of the driving transistor, wherein the value of the correction voltage is a value which depends upon the image signal applied from the data line.

2. A display apparatus comprising:

an organic electroluminescence light emitting section; and a pixel circuit including a driving transistor, and a writing transistor, the driving transistor being connected between a power supply potential and a light emitting section, the writing transistor being connected to a data line, wherein a correction voltage is applied to a gate of the driving transistor from the data line through the writing transistor, an image signal is applied to the gate of the driving transistor from the data line through the writing transistor, said applying the correction voltage to the gate and applying the image signal to the gate occurring separately and cumulatively contributing to a potential difference between the gate of the driving transistor and a source of the driving transistor, current is supplied to the light emitting section through the driving transistor corresponding to the value of the potential difference between the gate of the driving transistor and the source of the driving transistor, and the value of the correction voltage is a value that depends upon the image signal applied from the data line.

3. An electronic device comprising the display apparatus according to claim 2.

4. A display apparatus comprising:

an organic electroluminescence light emitting section; and a pixel circuit including a driving transistor, a writing transistor, and a storage capacitor, the driving transistor being connected between a power supply potential and a light emitting section, the writing transistor being connected to a data line, the storage capacitor being connected between a gate of the driving transistor and a current terminal of the driving transistor, wherein a drive transistor characteristic correction is imparted to the storage capacitor, an image signal is imparted to the storage capacitor from the data line through the writing transistor, said imparting the drive transistor characteristic correction to the storage capacitor and imparting the image signal to the storage capacitor occurring separately and cumulatively contributing to a potential difference between the gate of the driving transistor and the current terminal of the driving transistor, and current is supplied to the light emitting section through the driving transistor corresponding to the value of the potential difference between the gate of the driving transistor and the current terminal of the driving transistor.

5. An electronic device comprising the display apparatus according to claim 4.

6. The driving method according to claim 1, wherein the organic electroluminescence light emitting section comprises an anode electrode, a hole transport layer, a light emitting layer, an electron transport layer, and a cathode electrode.

7. The driving method according to claim 1, wherein the pixel circuit is part of a pixel unit, the pixel unit including a red light emitting subpixel, a green light emitting subpixel, a blue light emitting subpixel and a white light emitting subpixel.

8. The driving method according to claim 1, wherein the pixel circuit is part of a pixel unit, the pixel unit including a red light emitting subpixel, a green light emitting subpixel, a blue light emitting subpixel and a yellow light emitting subpixel.

9. The driving method according to claim 6, wherein the driving transistor is connected to the anode electrode of the light emitting section through a contact hole.

10. The display apparatus according to claim 2, wherein the organic electroluminescence light emitting section comprises an anode electrode, a hole transport layer, a light emitting layer, an electron transport layer, and a cathode electrode.

11. The display apparatus according to claim 2, wherein the pixel circuit is part of a pixel unit, the pixel unit including a red light emitting subpixel, a green light emitting subpixel, a blue light emitting subpixel and a white light emitting subpixel.

12. The display apparatus according to claim 2, wherein the pixel circuit is part of a pixel unit, the pixel unit including a red light emitting subpixel, a green light emitting subpixel, a blue light emitting subpixel and a yellow light emitting subpixel.

13. The display apparatus according to claim 10, wherein the driving transistor is connected to the anode electrode of the light emitting section through a contact hole.

14. The display apparatus according to claim 4, wherein the organic electroluminescence light emitting section comprises an anode electrode, a hole transport layer, a light emitting layer, an electron transport layer, and a cathode electrode.

15. The display apparatus according to claim 4, wherein the pixel circuit is part of a pixel unit, the pixel unit including a red light emitting subpixel, a green light emitting subpixel, a blue light emitting subpixel and a white light emitting subpixel.

16. The display apparatus according to claim 4, wherein the pixel circuit is part of a pixel unit, the pixel unit including a red light emitting subpixel, a green light emitting subpixel, a blue light emitting subpixel and a yellow light emitting subpixel.

17. The display apparatus according to claim 14, wherein the driving transistor is connected to the anode electrode of the light emitting section through a contact hole.

* * * * *